US005213547A

United States Patent [19]

Lochtefeld

[11] Patent Number: 5,213,547

[45] Date of Patent: May 25, 1993

[54] METHOD AND APPARATUS FOR IMPROVED WATER RIDES BY WATER INJECTION AND FLUME DESIGN

[75] Inventor: Thomas J. Lochtefeld, La Jolla, Calif.

[73] Assignee: Light Wave, Ltd., La Jolla, Calif.

[21] Appl. No.: 857,096

[22] Filed: Mar. 20, 1992

Related U.S. Application Data

[63] Continuation of Ser. No. 568,278, Aug. 15, 1990, abandoned.

[51] Int. Cl.[5] ..... A63G 21/18

[52] U.S. Cl. ..... 472/117; 104/70; 472/128

[58] Field of Search ..... 472/116, 117, 128, 88; 104/66-73

[56] References Cited

U.S. PATENT DOCUMENTS

| | | | |
|---|---|---|---|
| 3,598,402 | 8/1971 | Frenzl . | |
| 3,830,161 | 8/1974 | Bacon . | |
| 3,853,067 | 12/1974 | Bacon . | |
| 3,923,301 | 12/1975 | Meyers . | |
| 4,196,900 | 4/1980 | Becker . | |
| 4,198,043 | 4/1980 | Timbes et al. . | |
| 4,392,434 | 7/1983 | Durwald et al. . | |
| 4,564,190 | 1/1986 | Frenzl . | |
| 4,778,430 | 10/1988 | Goldfarb et al. . | |
| 4,805,896 | 2/1989 | Moody . | |
| 4,805,897 | 2/1989 | Dubeta . | |
| 4,836,521 | 6/1989 | Barber . | |
| 4,905,987 | 3/1990 | Frenzl . | |
| 5,011,134 | 8/1991 | Langford | 272/56.5 R |

FOREIGN PATENT DOCUMENTS 1204629 9/1970 Canada .

*Primary Examiner*—Richard E. Chilcot, Jr.

*Attorney, Agent, or Firm*—Knobbe, Martens, Olson & Bear

[57] ABSTRACT

A method and apparatus for controllably injecting, subsequent to the start of a water ride, a high velocity water flow over the water ride surface. A rider (or vehicle) that rides into such injected flow can, as the result of water-to-rider momentum transfer, either be accelerated, matched, or de-accelerated in a downhill, horizontal or uphill straight or curvilinear direction by such injected flow. Flow emitting nozzles can either be positioned above, along side or from any position along the length of the water ride surface. When a horizontal or upwardly inclined ride surface has flumed channel walls, either a special "flume within a flume" design is incorporated, or vents are positioned along the sides or bottom of the riding surface to minimize any transient surge/hydraulic jump that occurs during start-up or when a lower speed rider encounters a higher speed water flow. When the water ride surface has a down-chute portion immediately followed by a rising portion, properly injected water flows can either enhance the recovery elevation of the rider in excess of that available under conventional gravity only water ride systems, or stabilize and equalize the coefficients of friction and trajectory of differently sized and weighted participants to insure ride safety, consistency and capacity.

97 Claims, 27 Drawing Sheets

METHOD AND APPARATUS FOR IMPROVED WATER RIDES BY WATER INJECTION AND FLUME DESIGN

RELATED APPLICATIONS

This is a continuation of U.S. application Ser. No. 07/568,278, filed Aug. 15, 1990, abandoned.

BACKGROUND

This invention relates in general to water rides, specifically a mechanism and process that: 1) will safely transfer the kinetic energy of a high speed water flow to participants riding/sliding (with or without a vehicle) upon a low-friction surface and enable them to accelerate in a downhill, horizontal or uphill straight or curvilinear direction; 2) will safely stabilize and equalize the coefficients of friction and trajectory of differently sized and weighted participants on a water ride with a steep downhill portion followed by a subsequent significant uphill portion; and 3) will permit self-clearing of the transitory surge/hydraulic jump that may occur on a horizontal or upwardly inclined water ride flume.

The 80's decade has witnessed phenomenal growth in the participatory family water recreation facility, i.e., the waterpark, and in water oriented ride attractions in the traditional themed amusement parks. The current genre of water ride attractions, e.g., waterslides, river rapid rides, and log flumes, require participants to walk or be mechanically lifted and water to be pumped to a high point, wherein, gravity enables water, rider(s), and riding vehicle (if appropriate) to slide down a chute or incline to a lower elevation splash pool, whereafter the cycle repeats. Gravity or gravity induced rider momentum is the prime driving force that powers the participant down and through these traditional water ride attractions. A novel aspect of the subject invention is the employment of a high speed jet of water to propel a participant in lieu of, or in opposition to, or in augmentation with the force of gravity. With the exception of the start area, water ride attractions have not utilized the water that is pumped in a horizontal or downward direction as the object and driving mechanism for accelerating a rider down or along a run. Likewise, water ride attractions to date have not used jetted water to propel a rider up an incline to a higher elevation. By means of the aforementioned high speed water jets, the subject invention will enable the creation of water oriented amusement rides and ride experiences that have heretofore been unavailable in the recreation industry. In particular, the embodiments of the invention described herein will permit a rider(s) on the surface of a water attraction: to accelerate downhill in excess of the acceleration attributable to the force of gravity (said embodiment is hereinafter referred to as the "Downward Accelerator"); or to accelerate in a horizontal direction, (said embodiment is hereinafter referred to as the "Horizontal Accelerator"); or to accelerate in an uphill direction (said embodiment is hereinafter referred to as the "Upward Accelerator"; or to slide downward on a conventional slide and enter a flow of water of equal or slower speed and yet return in an upward direction to a higher elevation that is equal to or less than that which could be achieved through using gravity alone (said embodiment is hereinafter referred to as the "Stabilization/Equalization Process", or to slide downward on a conventional water ride attraction and return in an upward direction to an elevation higher than that which could be achieved through using gravity alone (said embodiment is hereinafter referred to as the "Elevation Enhancement Process"; or through combination of the above described embodiments with a standard downslope waterslide to create an embodiment hereinafter referred to as a "Water Coaster".

The amusement field is replete with inventions that utilize water as the means for generating rider motion and experience, however, none to date describe the improvements contemplated by the subject invention, as an examination of some representative references will reveal.

Meyers U.S. Pat. No. 3,923,301, issued Dec. 2, 1975 discloses a method of adapting a hill to provide a waterslide dug into the ground wherein a rider from an upper start pool slides by way of gravity passage upon recycled water to a lower landing pool. The structure and operation of Meyers has no relevance to the present invention.

Timbes U.S. Pat. No. 4,198,043 issued Apr. 15, 1980 discloses a modular molded plastic water slide wherein a rider from an upper start pool slides by way of gravity passage upon recycled water to a lower landing pool. The structure and operation of Timbes has no relevance to the present invention.

Becker, et al. U.S. Pat. No. 4,196,900 issued Apr. 8, 1980 discloses a conventional downslope waterslide with a simplified support construction involving a reduced number of parts at reduced cost with a conventional water pipe leading from a pump to the beginning of each slide. Becker goes on to suggest that such water pipe may include thrust nozzles at the top giving an extra push component to a person sitting there, thus making sure that a person, once boarded, does not block the slide by remaining in place. (Column 2, Lines 34–39). Becker's suggestion is customary to the entry tub of most conventional waterslides. Becker's suggestion does not contemplate the performance characteristics as described by the present invention, i.e., downhill acceleration in excess of the acceleration attributable to the force of gravity, or acceleration in a horizontal direction in excess of that force which is necessary to prevent entry tub blockage, or acceleration in an uphill direction, or elevation recovery, or multiple propulsion locations, etc. The "extra push" suggested by Becker is limited in location to the start of a slide, and limited in force to that which is necessary to avoid slide blockage by a starting slider. Conversely, the flow of water as injected by the subject invention is preferably located downstream of the conventional start as suggested by Becker. Furthermore, a preferred function of the subject invention is acceleration of a rider who is already in motion, not one who is blocking the slide by remaining in place. The suggestions of Becker are limited to existing conventional waterslide start basins, and as such, have no relevance to the present invention.

Goldfarb et al. U.S. Pat. No. 4,778,430 issued Oct. 18, 1988 discloses a waterslide toy wherein a mechanically powered conveyor lifts humanoid slide-objects from a lower slide section to the upper end of the slide section whereupon the slide-objects slide downward by way of gravity passage upon recycled water to the start point of the conveyor. The structure and operation of Goldfarb et. al. has no relevance to the present invention.

Dürwald et al. U.S. Pat. No. 4,392,434 issued Jul. 12, 1983 discloses a turbulent waterway having boats guided in a trough between an uphill starting point and a downhill terminus and a chain conveyor that prohibits slippage as it carries the boats from terminus to start. The structure and operation of Dürwal et. al. has no relevance to the present invention.

Moody U.S. Pat. No. 4,805,896 issued Feb. 21, 1989 discloses a water ride for swimmers which utilizes the linear (predominantly horizontal or downward) movement of a large quantity of water of swimming depth. Moody shares an attribute of the "Downward or Horizontal Accelerator" embodiments of the subject invention, i.e., the ability to move a participant in a predominantly horizontal or downward direction wherein the participant is moved by the water rather than through it. However, Moody can be distinguished from the subject invention as follows: The entire thrust of Moody is to provide a massive weight of water with very gradual downhill slopes to create desired swimmer movement. The ride, specifically limited to swimmers, is comprised of a large quantity of water of with a weight substantially greater than the weight of the participant and at depth sufficient to prevent the floating or swimming participant from contacting the bottom of the water channel. To move such large quantities of water, Moody specifies "High volume pumps at low water heads", (Column 3 Line 27). Conversely, the preferred embodiment for the subject invention utilizes lower volume pumps at higher water heads. Such high head pumps in concert with properly configured nozzles produce powerful focused water flows that can function at less than one inch deep. A fortiori, swimming is not a requirement, and the participant will inherently touch the bottom surface over which he/she is sliding. Additionally, the volume of water required to move a participant per Moody is ten to twenty times greater than that which would be required by a preferred embodiment of the subject invention. As to the issue of friction reduction, Moody uses a sufficient quantity of water to partially float the rider who can then accelerate by the relatively low kinetic energy of the slow moving mass of water. Conversely, the subject invention allows for acceleration by water impact (i.e., extreme momentum transfer), and does not require rider flotation to reduce the friction force. A further significant point of differentiation includes the ability to propel the participant in an upward direction (such ability was not contemplated by Moody). As a result of these differences, it is respectfully submitted that Moody teaches away from the propulsion mechanism as taught by the subject invention.

Barber U.S. Pat. No. 4,836,521 issued Jun. 6, 1989 discloses an amusement device that incorporates a circular pond in which water is rotated by jets to form a vortex and wherein a rotating member with resultant centrifugal force gives the rider the sensation of traversing the edge of a giant whirlpool. The structure and operation of Barber has no relevance to the present invention.

Dubeta U.S. Pat. No. 4,805,897 issued Feb. 21, 1989 discloses improvements to water slide systems, wherein a vertically rising water reservoir located at the upstream end of a waterslide (preferably at the beginning of the run) is properly valved to discharge a sudden quantity of water at selected intervals into the chute of the downwardly inclined waterslide. Similar to Moody (supra), Dubeta shares an attribute of several embodiments of the subject Invention, i.e., the ability to move a participant in a predominantly downrun direction wherein the participant is moved by the water rather than through it. However, Dubeta can be distinguished from the subject invention as follows: The entire thrust of Dubeta is to increase rider safety by providing intermittent floods of water that assures proper spacing for riders on a downhill waterslide run. Dubeta clarifies;

> "because the flood occurs with each rider and the rider is carried thereby in a positive manner for the entire run of the slide . . . the riders on the slide are maintained at a spaced relation relative to one another on the slide as they proceed down the same. This overcomes many of the accidents that occur with the constant flow rate system as previously discussed." (Column 6, Lines 57–64).

It is important to note that the flood of water released by Dubeta is intended to move at substantially the same rate as the design speed of the rider sliding down the flume (see also Column 5, Line 14–18). Structurally, Dubeta's preferred embodiment utilizes a storage reservoir with seven feet of head (Column 5, Line 31). Functionally, this low head flood of water insures that the rider is carried by the flood "in a positive manner for the entire run of the slide". Conversely, the preferred embodiment for the subject invention does not require any mechanism or need to release gushes of water that flow in spaced relation one after the other down the slide, rather, constant flows of water can also function to perform the intended objectives. Furthermore, the subject invention's accelerator embodiments preferably utilize head pressures in the range of 1.5 to 15 times as large as Dubeta. Such head pressure in concert with properly configured nozzles produce powerful focused water flows that result in an acceleration and in velocities that are greater than one could ever achieve by just sliding down a flume (with or without a Dubeta gush of water). Additional significant points of differentiation include the subject invention's ability to function without Dubeta's requirement of a vertically rising water tower reservoir at some location upstream from the end of the slide, and, the subject invention's ability to propel the participant in a horizontal or upward direction (such ability was not contemplated by Dubeta). As a final point of distinction, a participant in a Dubeta improvement will always be positioned downstream of the flood releasing valve prior to valve opening and gush production. In the subject invention the propellant water is already flowing at such time that the participant enters its stream. It is respectfully submitted that Dubeta, for the above stated reasons, teaches away from the propulsion mechanism as claimed by the subject invention.

Atlantic Bridge Company, Canada Pat. No. 1,204,629 discloses a conveyance device for fragile articles, e.g., fish or produce, wherein said articles are moved at a high rate of speed by way of suction and gravity and are decelerated with minimal damage by introducing said articles into a liquid bath at an acute angle so that the articles meet the liquid surface obliquely with reduced shock of impact. The structure and operation of Atlantic Bridge Company has no relevance to the present invention.

Frenzl U.S. Pat. No. 3,598,402 issued Aug. 10, 1971 is perhaps more closely related in structure to the "Upward Accelerator" embodiment of the present invention than any of the previously discussed references. Frenzl discloses an appliance for practicing aquatic sports such as surf-riding, water-skiing and swimming comprised of a vat, the bottom of which is upwardly sloping and has a longitudinal section which shows a concavity facing upwards while a stream of water is caused to flow upslope over said bottom as produced by a nozzle discharging water unto the surface of the lower end of said bottom. Provision is made for adjustment of the slope of the vat bottom around a pivotal horizontal axis to permit the appliance to be adjusted for that sport which has been selected for practice, e.g., water skiing reduced slope or surf-riding increased slope. Provision is also made for varying the speed of the water from a "torrential flow" for water skimming activities, e.g. surfboard riding, to a "river type flow" wherein the speed of the water is matched to the speed of an exercising swimmer.

However, Frenzl '402 does not recognize, either explicitly or implicitly some of the problems solved by the present invention, among which is the use of the upwardly flowing water as the means to thrust a rider up an incline and beyond the flow generating apparatus. Frenzl teaches in the instance of "torrential flow" that the function of his structure.

> "allow(s) the practicing of surf-riding and other similar sports, as the sloping of the vat bottom results in the possibility for the water skier to keep his balance in an equilibrium position depending on the one hand, on an upwardly directed force ascribable to the drag or resistance of the carrier board or boards dipped into the stream of water and, on the other hand, on a downwardly directed force produced by the component of the weight of the water skier in a direction parallel with the vat bottom. " (Frenzl, Col. 1 lines 49–57).

In the instance of a "river type flow", Frenzl teaches that the function of his structure, > "allows also practicing swimming. To this end, the swimmer sets the bottom 1 into a slightly sloping position . . . and he fills the vat almost up to its upper edge. He resorts then to low speeds for the water stream . . . The stream of water may be adjusted, so as to match the speed of the swimmer . . . " (Frenzl, Col. 4 lines 14–22).

In both flow descriptions, the entire teaching of Frenzl is for the user of the apparatus to be in equilibrium so that the aquatic sport can be practiced by the user. Either a user is in static equilibrium while skimming the surface of the water or in static equilibrium when swimming through the water. All adjustments to the appliance are directed at creating or sustaining this equilibrium.

Conversely, the teaching of the present invention is to avoid equilibrium. A rider who achieves equilibrium would oppose the objective for which the ride was designed, i.e., to propel its user up an incline and beyond. Furthermore, in this instance equilibrium is a safety hazard in that other riders who enter the device and are propelled upward could collide with a rider who is in equilibrium. It is respectfully submitted that Frenzl's structure was designed for equilibrium, and as such, teaches away from the propulsion mechanism as claimed by the subject invention.

Frenzi U.S. Pat. No. 4,905,987 issued Mar. 6, 1990 shows improvements to the appliance disclosed in the Frenzl '402 patent (described above) and in addition shows connected areas for swimming, non-swimming and a whirlpool so that water from the Frenzl '402 appliance is further utilized after outflow thereof. The primary objective of the Frenzi '987 patent is to improve the start and exit characteristics of the Frenzl '402 appliance by providing a means whereby a user can enter, ride, and exit the appliance to avoid breakdown of the torrential flow. There is, however, no suggestion in the Frenzi '987 patent that the user of the '402 portion of the structure should desire propulsion (by reason of water flow) up the floor's incline, rather, the express purpose of the '402 portion of the structure is "to carry out water gliding sports" on top of the upwardly sheeting flow. Furthermore, a Frenzi participant enters the appliance and starts his ride subsequent to the flow directing nozzle, whereas in the subject invention a participant always enters and starts the ride prior to encountering the flow directing nozzle. Finally, Frenzi does not contemplate user movement from the '402 portion of the structure to other portions (e.g., swim channel or whirlpool) of his device. In fact, Frenzi describes a catch grate as a vertical terminator that prohibits movement of a user and his riding equipment to other portions of the flow system. For the above stated reasons, it is respectfully submitted that Frenzi teaches away from the subject invention.

Frenzl U.S. Pat. No. 4,564,190 issued Jan. 14, 1986 shows improvements to the appliance for practicing aquatic sports using gliding devices (as disclosed in the Frenzl '402 patent) by introduction of a device that removes water from an upwardly sloping bottom surface which has been slowed down by friction at the boundary faces and returns the water to a pumping system to thereby increase the flow rate and thus eliminate the deleterious effects of slowed down water. Frenzl '190 is quickly distinguished from the subject invention on two bases. First, the structure and operation of Frenzl '190 is limited to an appliance for practicing aquatic sports using gliding devices. Consequently, the desired function of a Frenzl participant is to glide over the water that is re-injected into the uphill flow. Conversely, it is desired by a participant in the subject invention to be embraced by the re-injected water and either be accelerated or de-accelerated to approach the flow of this re-injected water. To glide over such re-injected water is to thwart this "embracing" objective. Secondly, a Frenzl '190 participant can enter and start his ride subsequent to the apertures that re-inject accelerated water, whereas in the subject invention a participant always enters and starts the ride prior to encountering the re-injected accelerated water. For the above stated reasons, it is respectfully submitted that Frenzl '190 teaches away from the subject invention.

Bacon U.S. Pat. No. 3,830,161 issued Aug. 20, 1974 discloses a flume amusement ride wherein water is pumped to a channel at the top of the ride, passengers in boats are mechanically conveyed to this top water channel, the boats guided by the walls of the water channel proceed to a steep down chute portion which includes two adjacent water channels into which boats are alternately directed by a gate, thus, safely increasing the dispatch interval between boats in the flume ride. After an initial descent, provision is made to use the speed attained to encounter a jump which permits the boat to climb upward upon a track over the jump and then back down to a channel splash down. As the boat rides up on the tracks the water flowing in the channel passes under these tracks in a trough. The boat does not contact the water until in comes down from the jump. The similarity of Bacon '161 to the subject invention is limited to ride profile. In function, the boat is not even in contact, with the water when it begins its upward incline, rather, the boat is on a track and its operation is analogous to a gravity driven roller coaster. Consequently, Bacon '161 has no relevance to the present invention.

Bacon U.S. Pat. No. 3,853,067 issued Dec. 10, 1974 discloses a boat amusement ride wherein water is pumped to a channel at the top of the ride, passengers in boats are mechanically conveyed to this top water channel, the boats guided by the walls of the water channel float to a steep down chute portion, the boats individually descend to the rides low point and then recover significant elevation within a common trough with the water. To facilitate start-up, a dam is provided at the top of the downchute. When enough water is accumulated behind the dam it is opened and the mass of water travels along the downchute and up the subsequent rise portion, thus "priming" the ride.

On the surface, Bacon '067 appears very similar to the "Stabilization/Equalization Process", "Elevation Enhancement Process" and "WaterCoaster" embodiments of the subject invention, however, there are four significant structural and functional distinctions. First, Bacon '067 is limited to a "boat amusement ride". The subject invention has no such limitation, riders sliding in bathing suits without the aid of a "boat" type riding device will also function admirably. Second, the water in Bacon '067 is introduced only at the "top at the beginning of the ride" (see column 2 line 36). In the subject invention, water is introduced after the rider has attained an initial start velocity in the conventional manner as known to those skilled in the art. Such introduction is by definition not at the beginning of the ride. Thirdly, Bacon '067 teaches that once being lifted to the top most portion of the ride, the water and the passenger carrying boats thereon, "will move only by gravity" (see column 2 lines 37 through 47). The subject invention teaches that rider and vehicle motion can be augmented by high speed jets of water, and that such augmentation can be in addition or in opposition to the force of gravity. Furthermore, if such augmentation occurs as the result of one of the acceleration embodiments as described herein, one may (a) ride faster downhill, (b) ride further in distance horizontally, and (c) ride uphill a greater distance than had the subject invention not been used. Fourth, Bacon identifies and proposes a solution to the problem of carrying water through the rising portion of the trough, especially during the rides start mode. Bacon introduces a dam at the top/start of the ride. When enough water has accumulated behind this dam it is opened and the mass of water travels along the downchute and up the subsequent rise portion, thus "priming" the ride. The subject invention solves the problem associated with upward water flow during the start mode by either introducing vents or reconfiguring the riding surface to facilitate water clearing in the subsequent rise portion of the ride. For the above stated reasons, it is respectfully submitted that Bacon '067 teaches away from the subject invention.

BRIEF DESCRIPTION OF THE PRESENT INVENTION

The primary objective of the present invention is to provide a safe, entertaining and functional water ride in which participants are propelled in a downward, horizontal or upward direction by means of a high velocity flow of water.

The advantages of such an attraction are numerous. First, in the instance of accelerating propulsion devices, it will enable a whole range of water ride activities that have as yet been unavailable to the public. Specifically, participants will be able to experience the thrill of riding in a downward direction at a rate of acceleration in excess of that afforded by the force of gravity. Additionally, participants will be able to ride in a horizontal direction and accelerate without the requirement of losing one's vertical elevation. More uniquely, a participant will be able to slide uphill, akin to a waterslide in reverse. Furthermore, due to the force of the propellant water, the participant can be made to achieve a height that is in excess of the initial start height. Such an embodiment will enable the advantage of creating a water powered escalator, i.e., enabling participants to move to higher elevations without the need of climbing stairs (as is currently the norm in most water recreation facilities). Additionally, this embodiment could be configured to permit handicapped individuals who cannot climb stairs to enter and ride a water oriented sliding attraction starting from the ground level.

A second objective of the present invention is to inject non-accelerating flows of water into a water ride that recovers in elevation following the bottom of a downchute portion. Such injection has the advantage of providing a stabilizing influence for the rider/vehicle, especially those instances where rider/vehicle coefficients of friction may vary.

A third objective of the present invention is the design of a water ride flume that will not only allow upward rider/vehicle movement, but will concurrently function to solve the transient surge problems associated with ride start-up and slow rider transitioning upon upwardly inclined riding surfaces.

A fourth objective of the present invention is to connect the present invention with a standard water slide/ride; and, in series to create a water slide/ride configuration that is akin to a rollercoaster. This "Water Coaster" attraction has advantage over existing water slides (and even existing roller coaster rides), in that the continuation (kinetic energy) of a slider's ride is not limited to the initial potential energy gained from climbing to the top of the slide. Rather, by timely interjection of a properly configured high speed jet of water, the kinetic energy of said jetted water can transfer and accelerate a rider to enable the rider to attain an altitude (increased potential energy) in excess of an altitude that would be achieved absent said jetted flow. The degree to which a rider will achieve "excess altitude" is a function of the velocity and amount of water that contacts and remains in contact with the rider during the course of his ascent. Upon reaching his apogee a rider transitions and either is blasted by another jet to continue his ascent, or is blasted horizontally, or, the rider descends along a path and in the manner of a standard water slide/ride to either a standard splash pool/transition zone, or to another jetted flow of stabilizing or accelerating water. Furthermore, the Water Coaster embodiment can include all the standard twists, turns, jumps, and loops normally associated with a Roller Coaster.

A fifth objective of the present invention is to create a ride out of water that is ordinarily pumped uphill in an enclosed pipe. The advantage of such an improvement is that it more efficiently makes use of an existing condition, i.e., if water is going to be pumped uphill in any event, (e.g., to service a fountain, waterslide or other gravity enhanced water attraction), then, one can obtain the benefit of riding (at minimal extra cost) such water that is already being upwardly pumped.

Other objectives and goals will be apparent from the following description taken in conjunction with the drawings included herewith.

REFERENCE NUMERALS IN DRAWINGS

Figure 1A:
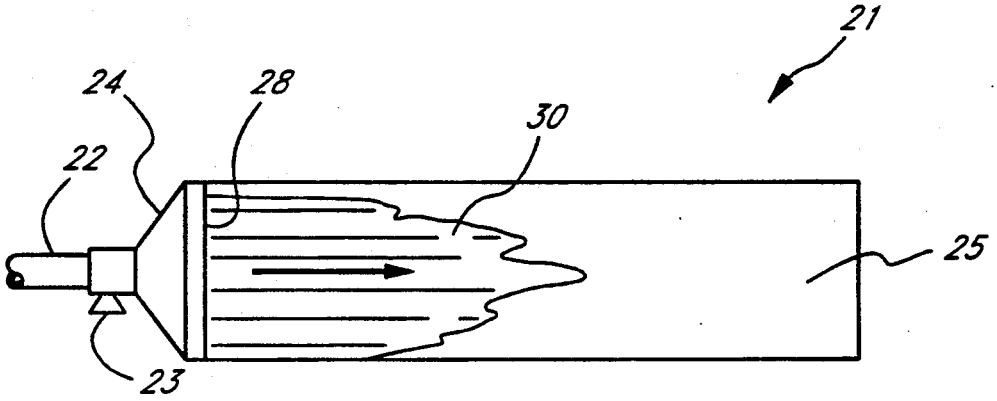
FIG. 1A is a top view of a propulsion module.

| | | | |
|---|---|---|---|
| 21 | Module | 22 | Water Source |
| 23 | Flow Control Valve | 24 | Flow Forming Nozzle |
| 25 | Smooth Riding Surface | 26 | Module Connection |
| 27 | Channel Wall | 28 | Adjustable Nozzle Aperture |
| 29 | Rider | 30 | Jet-Water Flow |
| 31 | Aperture Plate | 32 | Tunnel Arch |
| 33 | Transient Surge | 34 | Porous Vent |
| 35 | Triple Flume | 36 | Overflow Flume |
| 37 | Overflow Water | 38 | Porous Overflow Vent |
| 39 | Double Flume | 40 | Horizontal Accelerator |
| 41 | End of Horizontal Accelerator | 42 | Upward Accelerator |
| 43 | End of Upward Accelerator | 44 | Downward Accelerator |
| 45 | End of Downward Accelerator | 46 | Horizontal Non-Accelerating Propulsor |
| 47 | End of Horizontal Non-Accelerating Propulsor | | |
| 48 | Ride Continuation Path (Horizontal Non-Accelerating Propulsor) | | |
| 49 | Upward Non-Accelerating Propulsor | | |
| 50 | End of Upward Non-Accelerating Propulsor | | |
| 51 | Ride Continuation Path (Upward Non-Accelerating Propulsor) | | |
| 52 | Downward Non-Accelerating Propulsor | | |
| 53 | End of Downward Non-Accelerating Propulsor | | |
| 54 | Ride Continuation Path (Downward Non-Accelerating Propulsor) | | |
| 55 | Start Basin (prior art) | | |
| 56 | Attraction Surface (prior art) | | |
| 57 | Preferred Trajectory | | |
| 58 | Airborne Trajectory | | |
| 59 | Failed Trajectory | | |
| 60 | Attraction Surface (Stabilization/Equalization) | | |
| 61 | Start Basin (without Elevation Enhancement Process) | | |
| 62 | Attraction Surface (without Elevation Enhancement Process) | | |
| 63 | Unaided Trajectory | | |
| 64 | Unaided Zenith | | |
| 65 | Attraction Surface (Elevation Enhancement Process) | | |
| 66 | Zenith (Elevation Enhancement Process) | | |
| 69 | Water Coaster | | |

-continued

| | |
|---|---|
| 70 | Attraction Surface (Water Coaster) |
| 71 | Structural Supports |
| 72 | Start Basin (Water Coaster) |
| 73 | End Basin (Water Coaster) |
| 74 | Surge Tank |

The subject invention is comprised of several embodiments that can stand alone or be combined to function for the recreational purposes as described herein.

DETAILED DESCRIPTION OF PRESENT INVENTION

To facilitate a concise description of the multiplicity of embodiments set forth in this invention, and to avoid burdensome repetition, a modular approach has been taken to define a set of common elements that are central to each embodiment. The module is only grouped for purposes of convenience and is not intended to limit the scope of the invention, or the structure or function of the respective components that comprise the module. Furthermore, the size of the components that comprise a module is a function of intended use. The preferred embodiments as hereafter described are intended for single participant use, akin to the common waterslide. It is understood by those schooled in the art that with proper upsizing the subject invention could also accommodate multiple riders simultaneously. Likewise, with suitable adjustment for weight, friction and surface shape, the subject invention could service single or multi-passenger sliding vehicles, wheeled vehicles, or boats, thus allowing participants to become bathing suit wet or remain street clothes dry.

Figure 1B:
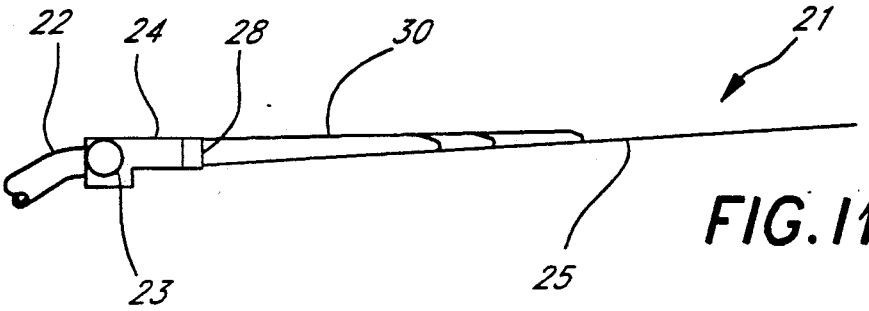
FIG. 1B is a side view of a propulsion module.
Figure 1C:
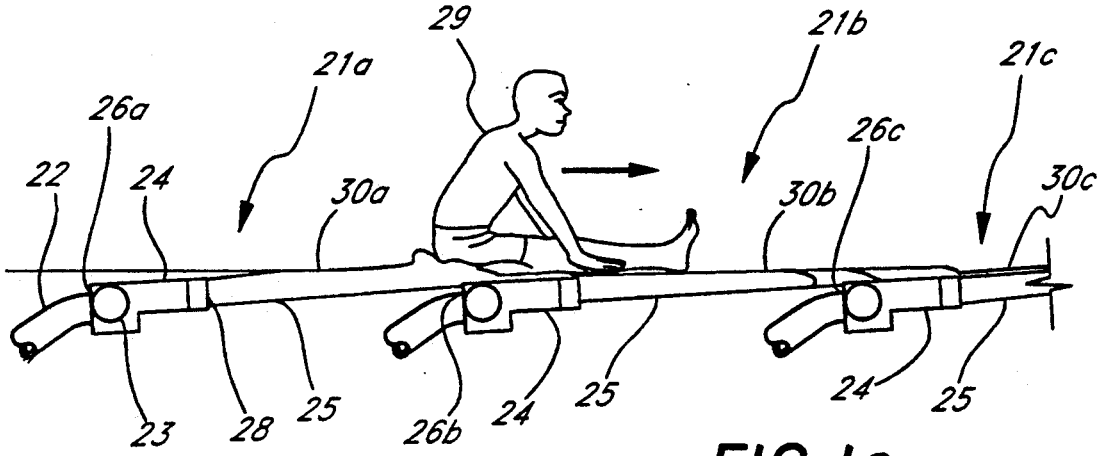
FIG. 1C is a side view of a series of connected propulsion modules and a rider theron.

Turning now to FIG. 1A (top view) and FIG. 1B (side view) there is illustrated a propulsion module 21 comprised of a high flow/high pressure water source 22; a flow control valve 23; a flow forming nozzle 24 with adjustable aperture 28; a discrete jet-water flow 30 with arrow indicating the predetermined direction of motion; and a substantially smooth riding surface 25 over which jet-water flow 30 flows. Module 21 is made of suitable materials, for example, resin impregnated fiberglass, concrete, gunite, sealed wood, vinyl, acrylic, metal or the like, and is joined by appropriate watertight seals in end to end relation. FIG. 1C (side view) depicts a rider 29 (with arrow indicating the predetermined direction of motion) sliding upon a series of connected modules. Connections 26*a*, 26*b* and 26*c* between modules 21*a*, 21*b*, and 21*c* permit an increase in overall length of the subject invention as operationally, spatially, and financially desired. Connection 26 can result from bolting, gluing, or continuous casting of module 21 in an end to end fashion. When connected, the riding surface 25 of each module need be substantially in-line with and flush to its connecting module to permit a rider 29 who is sliding thereon and the jet-water 30*a*, 30*b* and 30*c* which flows thereon to respectively transition in a safe and smooth manner. When a module has nozzles 24 that emerge from a position along the length of the riding surface 25 (as depicted in FIG. 1C), it is preferred that the non-nozzle end of the riding surface 25 extend to and overlap the top of a connecting nozzle 24 at connection 26. Further to this configuration, it is also preferred that the bottom of nozzle 24 extend and serve as riding surface 25. Module 21 can also be connected in the conventional manner to standard waterslide or water-ride attraction flumes as currently exist in the art.

Module 21 length can vary depending on desired operational performance characteristics and desired construction techniques or shipping parameters. Module 21 width can be as narrow as will permit one participant to ride in a seated or prone position with legs aligned with the direction of water flow [roughly 0.5 meters (20 inches)], and as wide as will permit multiple participants to simultaneously ride abreast or a passenger vehicle to function. The driving mechanism which generates the water pressure for the water source 22 can either be a pump or an elevated reservoir. Where a series of modules are connected, a single high pressure source or pump with a properly designed manifold could provide the requisite service, or in the alternative, a separate pump for each module could be configured. The line size of the water source 22 need be of sufficient capacity to permit the requisite configuration and pressure of jet-water flow 30 to issue from nozzle 24. The water pressure at nozzle aperture can vary depending upon desired operational characteristics. In a single participant waterslide setting, nozzle pressure can range from approximately 5 psi to 250 psi depending upon the following factors: (1) size and configuration of nozzle opening; (2) the weight and friction of rider relative to the riding surface; (3) the consistency of riding surface friction; (4) the speed at which the rider enters the flow; (5) the physical orientation of the rider relative to the flow; (6) the angle of incline or decline of the riding surface; and (7) the desired increase or decrease in speed of rider due to flow-to-rider kinetic energy transfer. In a water ride attraction that utilizes vehicles, nozzle pressure range can be higher or lower given that vehicles can be designed to withstand higher pressures than the human body and can be configured for greater efficiency in kinetic energy transfer. The flow control valve 23 is used to adjust pressure and flow as operational parameters dictate and can be remotely controlled and programmed. Nozzle 24 is formed and positioned to emit jet-water flow 30 in a direction substantially parallel to and in the lengthwise direction of riding surface 25 through adjustable aperture 28. To enable continuity in rider throughput and water flow, when modules are connected in series for a given attraction, all nozzles should be aligned in the same relative direction to augment rider movement. Riding surface 25 need be of sufficient structural integrity to support the weight of a human rider(s), vehicle, and water moving thereupon. It is also preferred that Riding surface 25 have a low-coefficient of friction to enable jet-water 30 to flow and rider 29 to move with minimal loss of speed due to drag. The condition of jet-water flow 30 (i.e., temperature, turbidity, Ph, residual chlorine count, salinity, etc.) is standard pool, lake, or ocean condition water suitable for human swimming.

Figure 2:
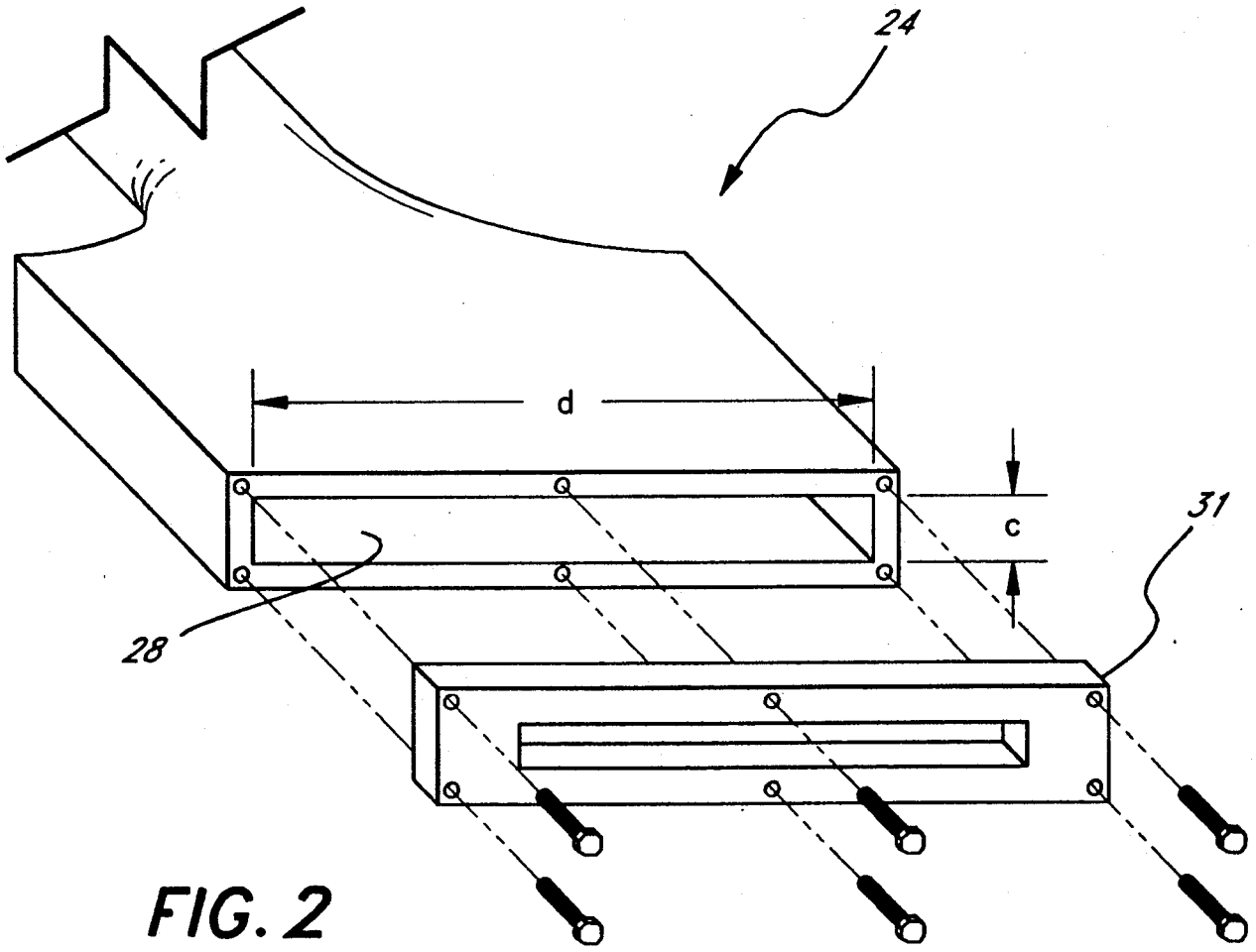
FIG. 2 depicts a nozzle with adjusting aperture sized to perform for a single participant waterslide propulsion module.

Nozzle 24 dimensions are a function of available water flow and pressure and the desired performance and capacity characteristics of the module as further described herein. FIG. 2 shows a perspective of the preferred embodiment for a nozzle 24 sized to perform for a single participant flat bottomed waterslide module. Curved bottom riding surfaces would perform more efficiently with bottom originating nozzle 24 and Aperture 28 conformed to the cross-sectional curvature of the curved riding surface. Aperture 28 of nozzle 24 can either be fixed or adjustable. The preferred embodiment uses an aperture capable of adjustment. Ideally, adjustment should allow for variations in thickness and width of jet-water flow 30. For example, but not by way of limitation, the breadth c of nozzle aperture 28 can range from ½ cm to 40 cm. The width d of nozzle aperture 28 can range from 20 cm to 200 cm. A multiplicity of adjustment devices are capable of effecting proper aperture control, e.g., screw or bolt fastened plates, welded plates, valves, moveable weirs or slots, etc. Many of such devices are capable of automatic remote control and programming. FIG. 2 shows in exploded view bolted aperture plate 31 fastened to adjust aperture opening to operational requirements. Although just one large nozzle 24 is illustrated, multiple smaller nozzles can be packaged to achieve similar flow and aperture size characteristics with satisfactory results. For multiple participant or large vehicle configurations, additional nozzles can be placed side by side to increase the horizontal flow area, or one large nozzle can function. It is also possible to vary the number and relative location of nozzle(s) 24 within a given module, so long as they serve to propel a rider or vehicle as contemplated herein.

Figure 3A:
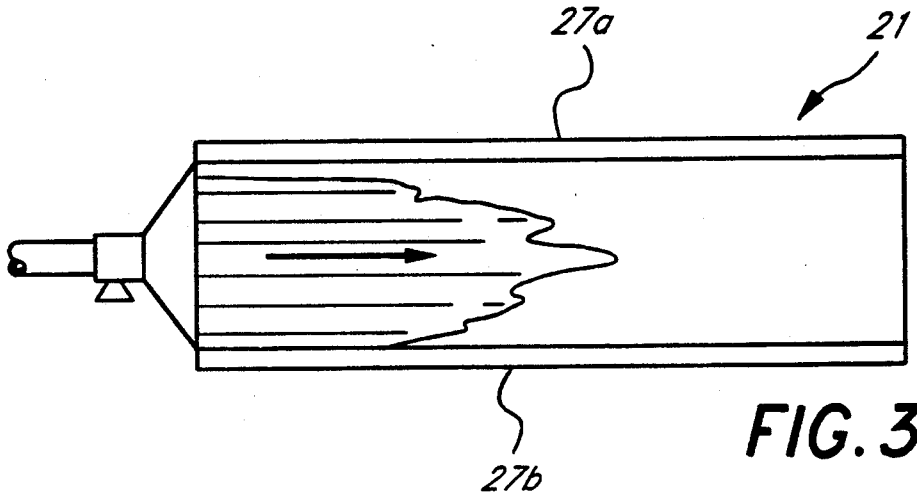
FIG. 3A is a top view of a module with right angle channel walls.
Figure 3B:
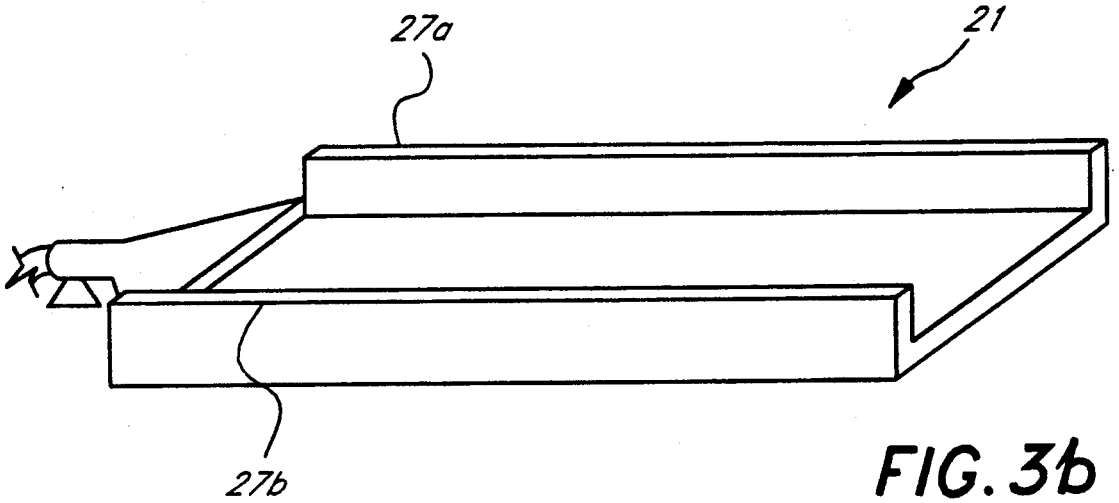
FIG. 3B is a perspective view of a module with right angle channel walls.
Figure 3C:
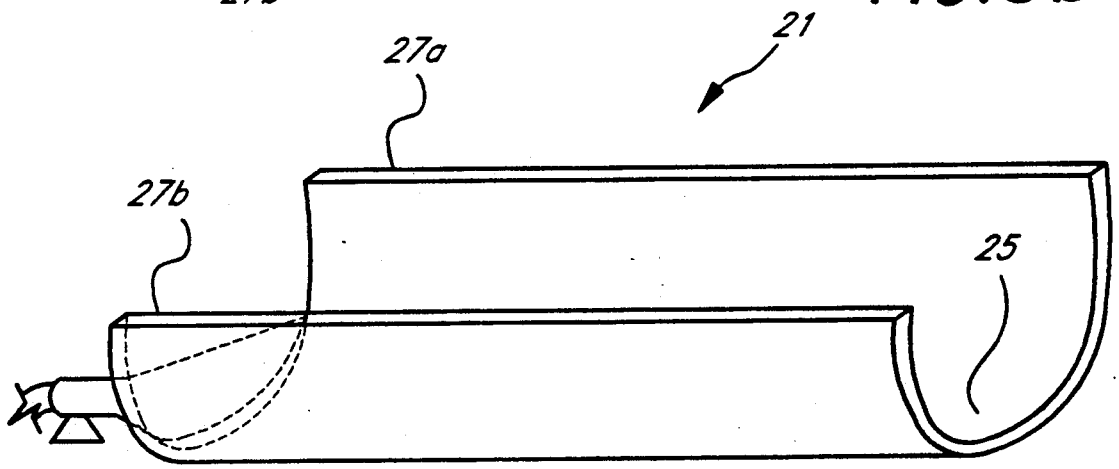
FIG. 3C illustrates a module with riding surface integrated with channel walls into a parabolic half-pipe configuration.
Figure 4A:
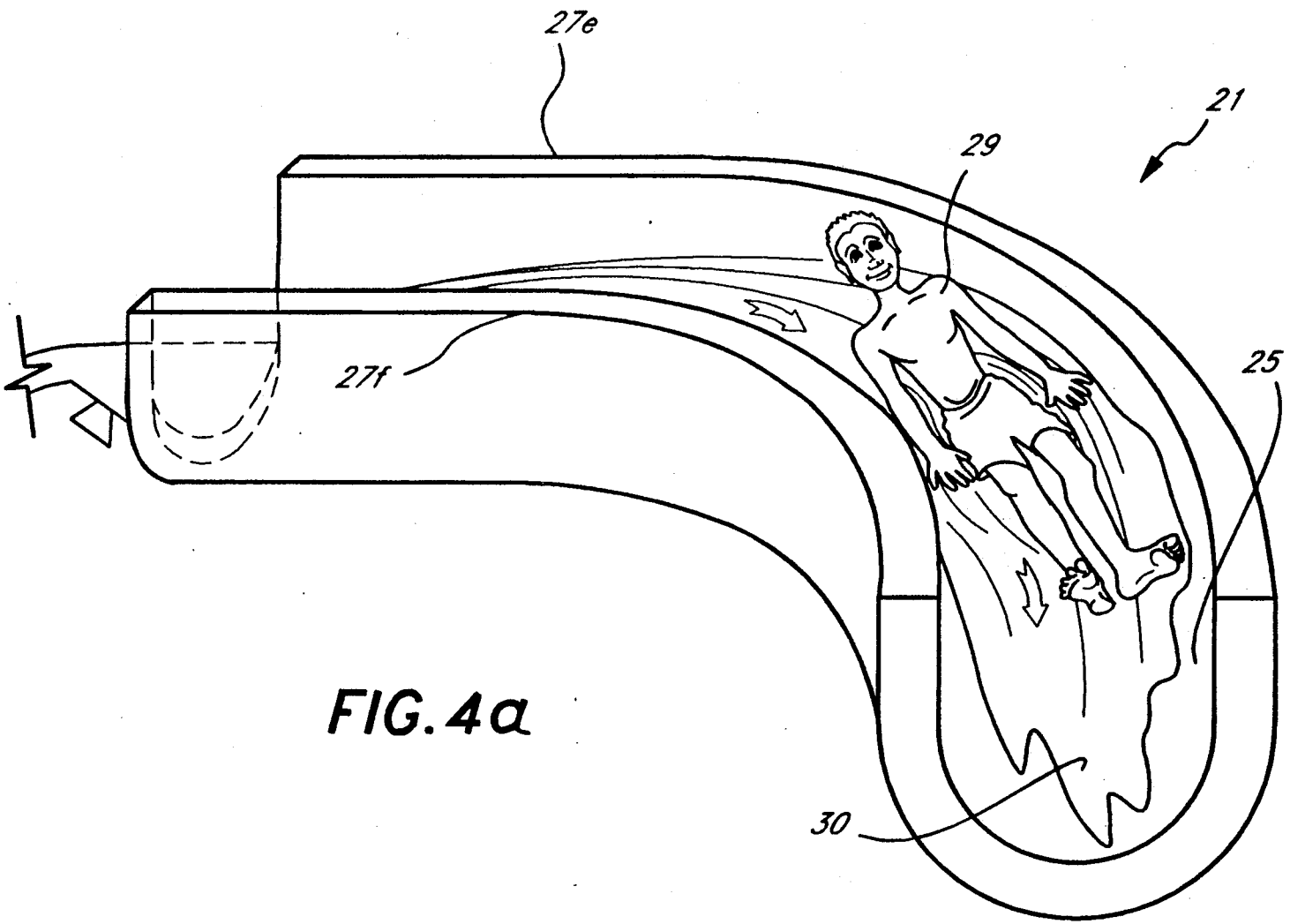
FIG. 4A depicts a rider in a half-pipe shaped module negotiating a turn.
Figure 4B:
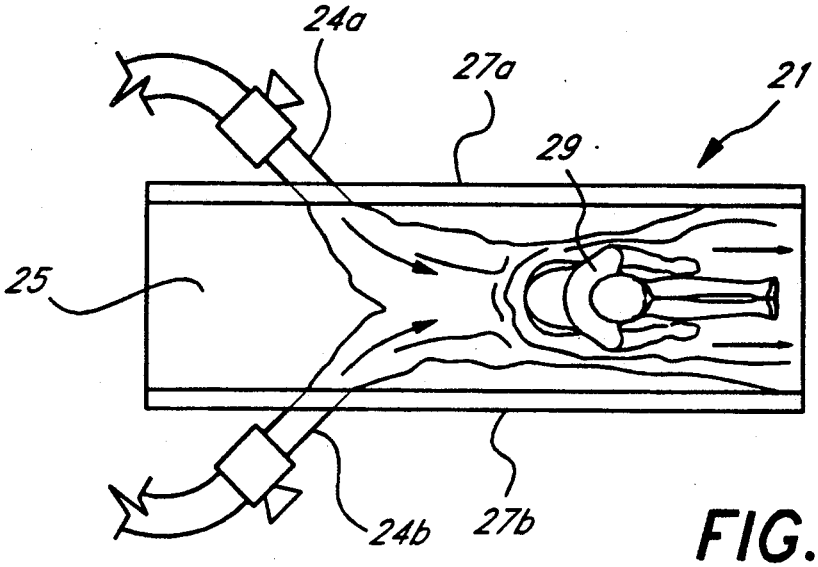
FIG. 4B shows a top view of a module with nozzles entering from the side walls.
Figure 4C:
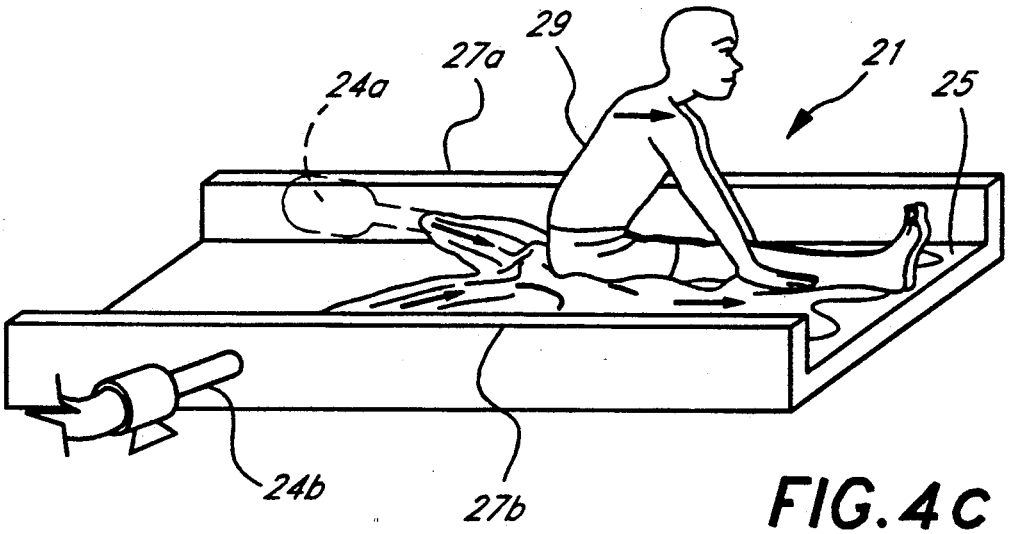
FIG. 4C shows a perspective view of a module with nozzles entering from the side walls.
Figure 4D:
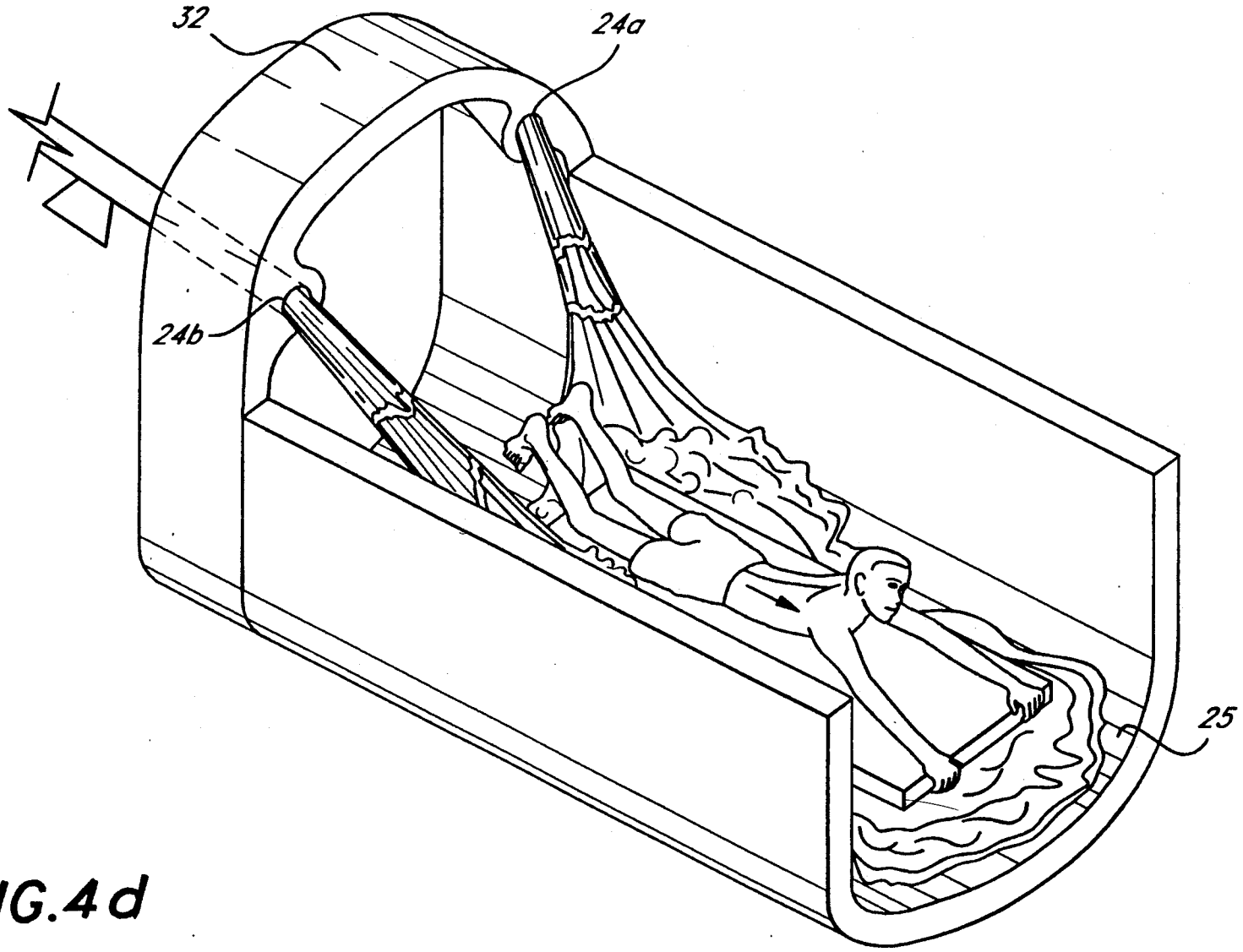
FIG. 4D shows a perspective view of a module with nozzles positioned above the rider.

Module 21 can function with or without channel walls. Furthermore, channel walls are capable of multiple configurations and can at times act as a riding surface. FIG. 1A, FIG. 1B, and FIG. 1C depicted module 21 without channel walls. FIG. 3A (top view) and FIG. 3B (perspective view) illustrates module 21 with right angle channel walls 27*a* and 27*b*. FIG. 3C shows module 21 with channel walls 27*c* and 27*d* in a half-pipe configuration, with riding surface 25 and channel walls 27 integrated into the shape of a parabola. Conventional channel wall shapes vary substantially between the ranges as described in FIG. 1A–C and FIG. 3 A–C. Functionally, when compared to a flat riding surface the addition of channel walls has three important advantages: First, as shown in FIG. 4A, module 21 with properly configured channel walls 27*e* and 27*f* will allow the introduction of compound curves to the riding surface 25 that permit rider 29 and jet-water flow 30 to ride-up the side of the channel wall in a banking turn, oscillate between walls when coming out of the turn, yet stay within the riding surface region defined by the flume channel walls 27*e* and 27*f*. Without channel walls, a rider is limited to his initial direction of motion and would not be able to negotiate a turn unless acted upon by some outside force. The second advantage of channel walls is shown in FIG. 4B (top view) and FIG. 4C (perspective view), wherein channel walls 27*a* and 27*b* due to their structural nature enable nozzles 24*a* and 24*b* to easily originate from the side rather than the bottom of module 21. When nozzle 24 is positioned on the side, it is permissible to direct jet-water flow 30 that emits from such nozzle towards the center line path of rider 29 and at an angle slightly askew from the lengthwise direction of riding surface 25 so as to insure a positive contact with rider 29. Likewise, as shown in FIG. 4D, it is possible to position nozzles 24*a* and 24*b* above the riding surface 25 on a tunnel arch 32 or some other support structure. The third advantage for channel walls is their safety function, i.e., they keep a rider within the confines of the flume and prevent untimely rider exits and injury sustaining falls from an elevated riding surface.

In counterpoint to the previously described channel wall advantage of tracking rider and water within the region defined by the flume channel walls, channel walls can have the disadvantage of confining excess water and allowing an undesirable build-up that can adversely effect the operation of module 21. This undesirable build-up is particularly acute in an upward directed flow and occasionally a problem in a horizontally directed flow. In both cases, this build-up will most likely occur during three stages of operation, (1) water flow start-up with no rider present; (2) transferring the kinetic energy of the operating high speed flow of water to a slower speed rider; and (3) cumulative build-up of injected water from a series of nozzles along a ride course. In the start-up situation (1), due to the gradual build up of water flow associated with pump/motor phase in or valve opening, the initial water flow is often of less volume, velocity or pressure than that which issues later. Consequently, this initial start water is pushed by the stronger flow, higher pressure, or faster water that issues thereafter. Such pushing results in a build-up of water (a hydraulic jump or transient surge) at the leading edge of the flow. An upward incline of the riding surface serves only to compound the problem, since the greater the transient surge, the greater the energy that is required to continue pushing such surge in an upward fashion. Consequently, the transient surge will continue to build and if unrelieved will result in overall flow velocity decay, i.e., the slowed water causes additional water to pile up and ultimately collapse back onto itself into a turbulent mass of bubbling white water that marks the termination of the predominantly unidirectional jet-water flow. In the situation of kinetic energy transfer (2), when a slow rider encounters the faster flowing water, a transient surge builds behind the rider. Likewise, if this transient surge grows to large it will choke the flow of higher speed unidirectional jetted water, thus, causing flow decay. In the situation of an excessive build up of water over time from a series of nozzles along the course of a ride (3), the interference of a preceding flow with a subsequent flow can result in an undesired transient surge and flow decay at a point near where the two flows meet. Under all three conditions, it is possible to eliminate the transient surge by immediately increasing the flow pressure and over-powering or washing the transient surge off the riding surface. However, there comes a point where the build-up of water volume is so great that for all practical purposes over-powering is either impossible, or at best a costly solution to a problem capable of less expensive solution. Such less expensive solution is possible by the introduction of vents. Modules with no (or relatively low height) channel walls are self-venting, i.e., the slower water will escape to the sides. By introducing vents to channel wall situations, one can combine the aforementioned advantages of channel walls (i.e., tracking, structure and safety) with the self-venting properties of no channel walls and simultaneously solve the start-up, rider induced, and excessive accumulation transient surge problems.

Figure 5A:
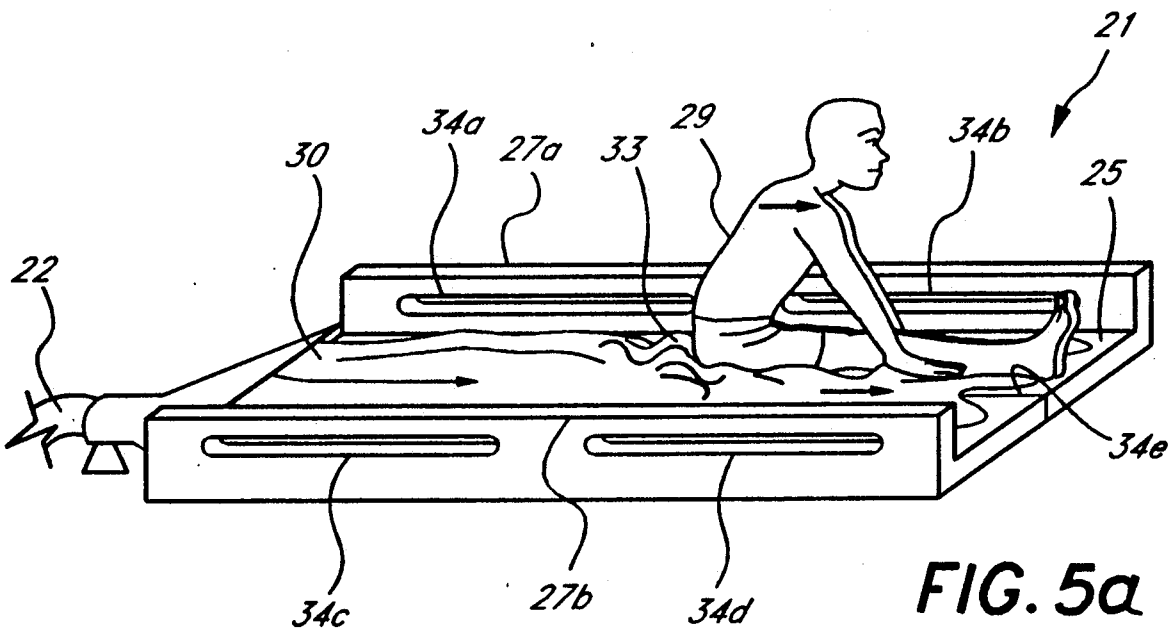
FIG. 5A depicts a module with channel walls and "porous vent" mechanism.

Two classes of vent mechanisms are identifiable for use in module 21. The first class, "porous vents", is illustrated in FIG. 5A wherein rider 29 is in an inclined module 21 with channel walls 27*a* and 27*b*. Jet-water flow 30 is already issuing from nozzle 24 when rider 29 enters its flow. Since the velocity of jet-water flow 30 is moving at a rate greater than the speed of the entering rider, a transient surge 33 will build behind the rider. This build-up can be eliminated by draining the slowed water through a porous vent 34*a*, 34*b*, 34*c*, or 34*d* along the sides of channel 27*a* and 27*b* or through porous vent 34*e* along the bottom of riding surface 25. Porous vents 34 must large enough to permit transient surge 33 to vent, yet not too large so as to adversely affect the safety or performance of a rider or riding vehicle that is moving over the surface 25. Acceptable types of porous vent openings include a multiplicity of small holes, a porous fabric, slots, grids, etc. The water once vented can be recirculated to the water source 22.

The second class of vent mechanism to be used in module 21 can be described as an overflow vent or a "flume within a flume". Two preferred embodiments specific to this class are hereinafter referred to as the Triple Flume and the Double Flume. The Triple Flume has the advantage of permitting higher degrees of predominantly straight upward incline than the Double Flume, while the Double Flume has the advantage of permitting radical uphill curves that are not available to the Triple Flume. Although the Triple Flume and the Double Flume are described in the context of module 21, they are both capable of individual attachment to conventional non-injected water rides for the self-clearing purposes as previously described.

Figure 5B:
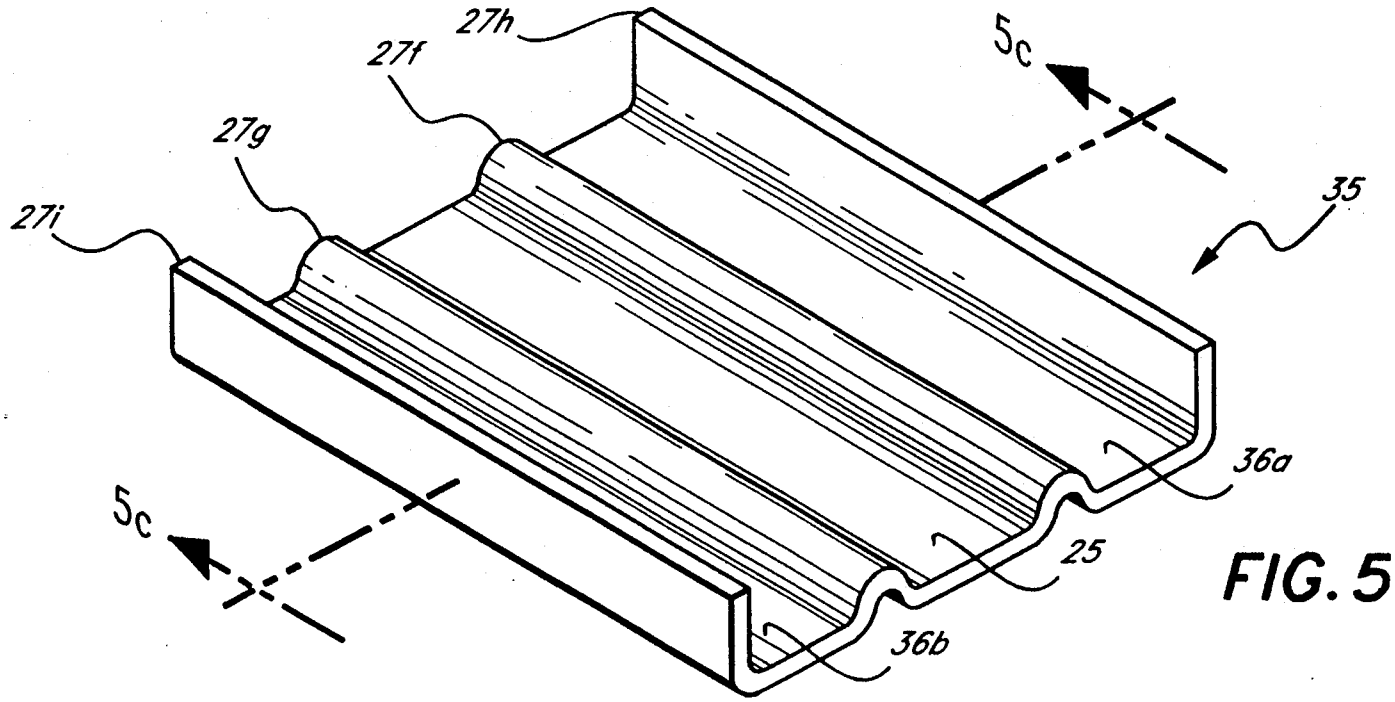
FIG. 5B is a perspective view of an "overflow vent" mechanism, further described as a Triple Flume.
Figure 5C:
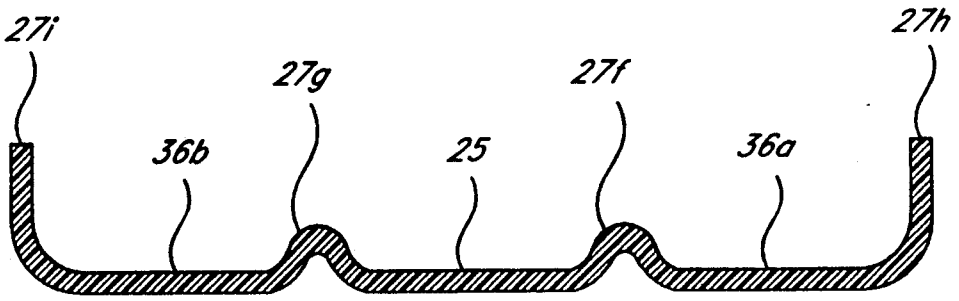
FIG. 5C shows in cross section the Triple Flume.
Figure 5D:
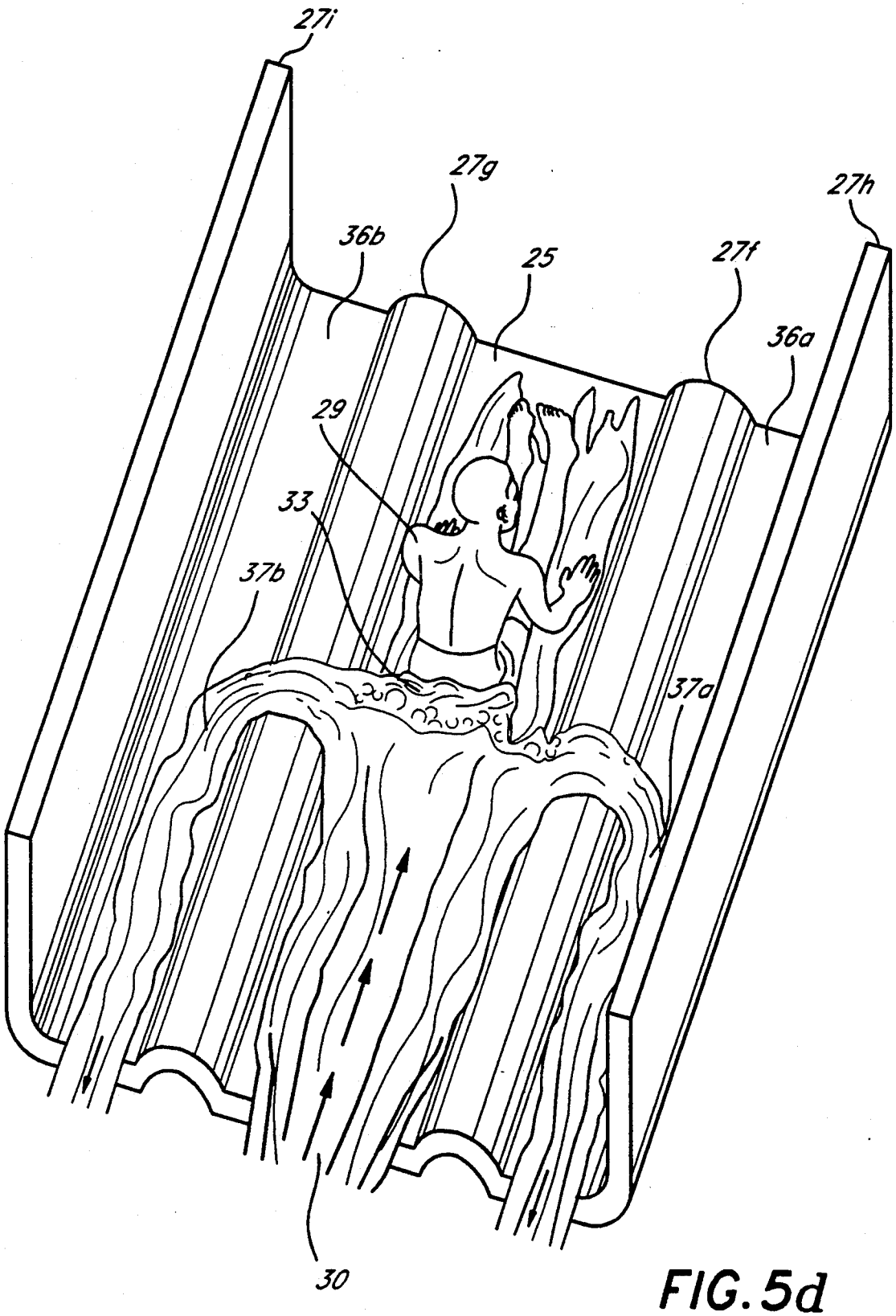
FIG. 5D depicts a rider in the Triple Flume.

FIG. 5B shows a perspective view of a Triple Flume 35 self-venting improvement to module 21. FIG. 5C shows a cross-sectional Triple Flume 35 profile. Structurally, Triple Flume 35 is comprised of riding surface 25 and two adjacent overflow flumes 36*a* and 36*b*. Riding surface 25 is integrated with or connected to two low rise channel walls 27*f* and 27*g* of approximately equal height. Overflow flume 36*a* abuts and integrates, connects, or shares low rise channel wall 27*f* and on its opposite side integrates or connects to high channel wall 27*h*. Overflow flume 36*b* abuts and integrates, connects, or shares low rise channel wall 27*g* and on its opposite side integrates or connects to high channel wall 27*i*. The orientation of Triple Flume 35 is predominantly at an upward incline with jet-water flow and rider moving in an upward direction on riding surface 25, and any overflow water that spills into overflow flume 36*a* and 36*b* moving in a downward direction due to the force of gravity. Horizontal application of Triple Flume 35 is also appropriate in those circumstances where transient surge build up interferes with the smooth jet-water flow. However, during any horizontal application overflow flume 36*a* and 36*b* must maintain a sufficient degree of slope to permit overflow water to properly drain. In Triple Flume 35, the heights of low channel walls 27*f* and 27*g* are variable depending upon a number of factors, e.g., the initial start-up water pressure and flow; the time required to achieve full operating water pressure and flow; the volume of riding surface 25 (i.e., riding surface width multiplied by wall height); the length and degree of incline of riding surface 25; the disparity of velocity between a slow entering rider and the higher speed flow; the flow volume of accumulating water; and design preference as to whether rider transfer from one flume to another is to be encouraged, etc. At a minimum, as shown in FIG. 5D, the height of low channel walls 27*f* and 27*g* must be sufficient to separate the upward jet-water flow 30 from the downward overflow water 37, as well as, facilitate tracking of a rider 29 substantially upon riding surface 25. At a maximum, low channel walls 27*f* and 27*g* must not exceed such height that will prevent the clearing of transient surge 33. From a practical view point to avoid redundancy, low channel walls 27*f* and 27*g* will always be less than that which would be required for high channel wall 27*h* and 27*i*. Overflow flumes 36*a* and 36*b* are of at least sufficient size to accommodate any overflow water 37, and may also be increased in size to function as traditional downward oriented participant riding surfaces. In this latter instance, it would be possible to have a rider moving upward on primary riding surface 25 and two riders moving downward in overflow flumes 36*a* and 36*b*. High channel walls 27*h* and 27*i* are of standard ride height to prevent unwanted rider exits from Triple Flume 35.

Figure 5E:
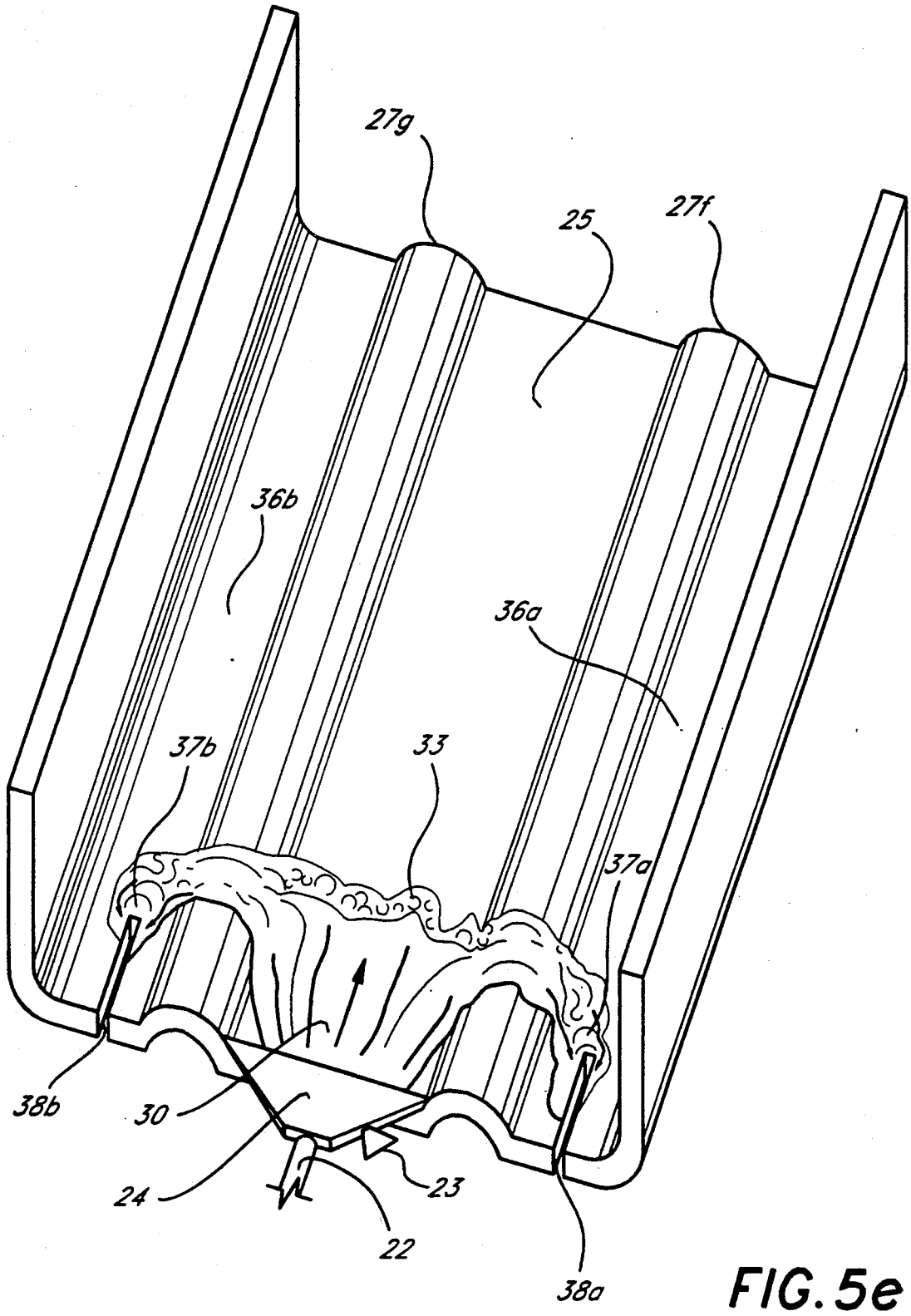
FIG. 5E is one in a series of three illustrations that depicts in time-lapse sequence the self-clearing capability of an upwardly inclined Triple Flume.
Figure 5F:
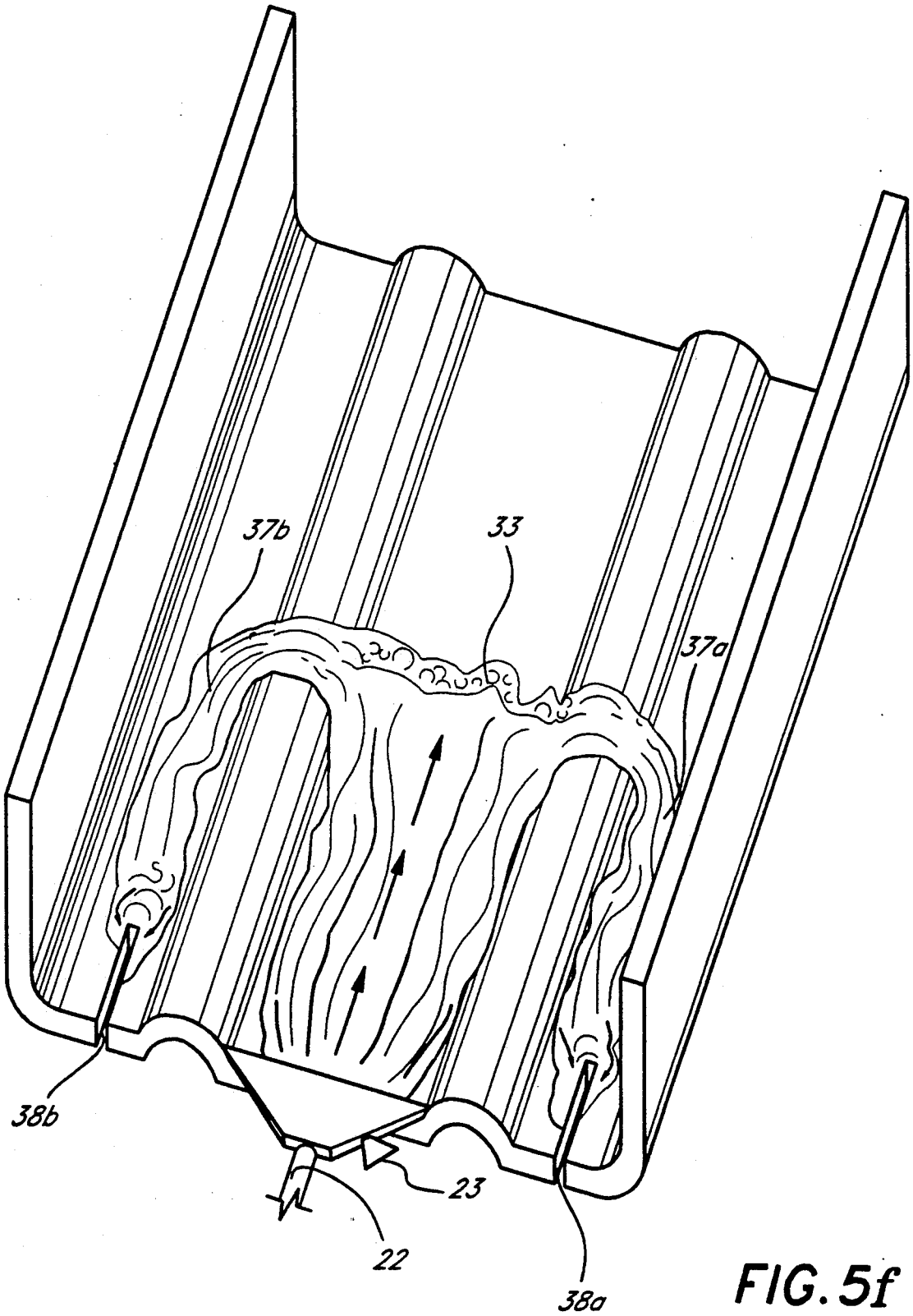
FIG. 5F is the second in a series of three illustrations that depicts in time-lapse sequence the self-clearing capability of an upwardly inclined Triple Flume.
Figure 5G:
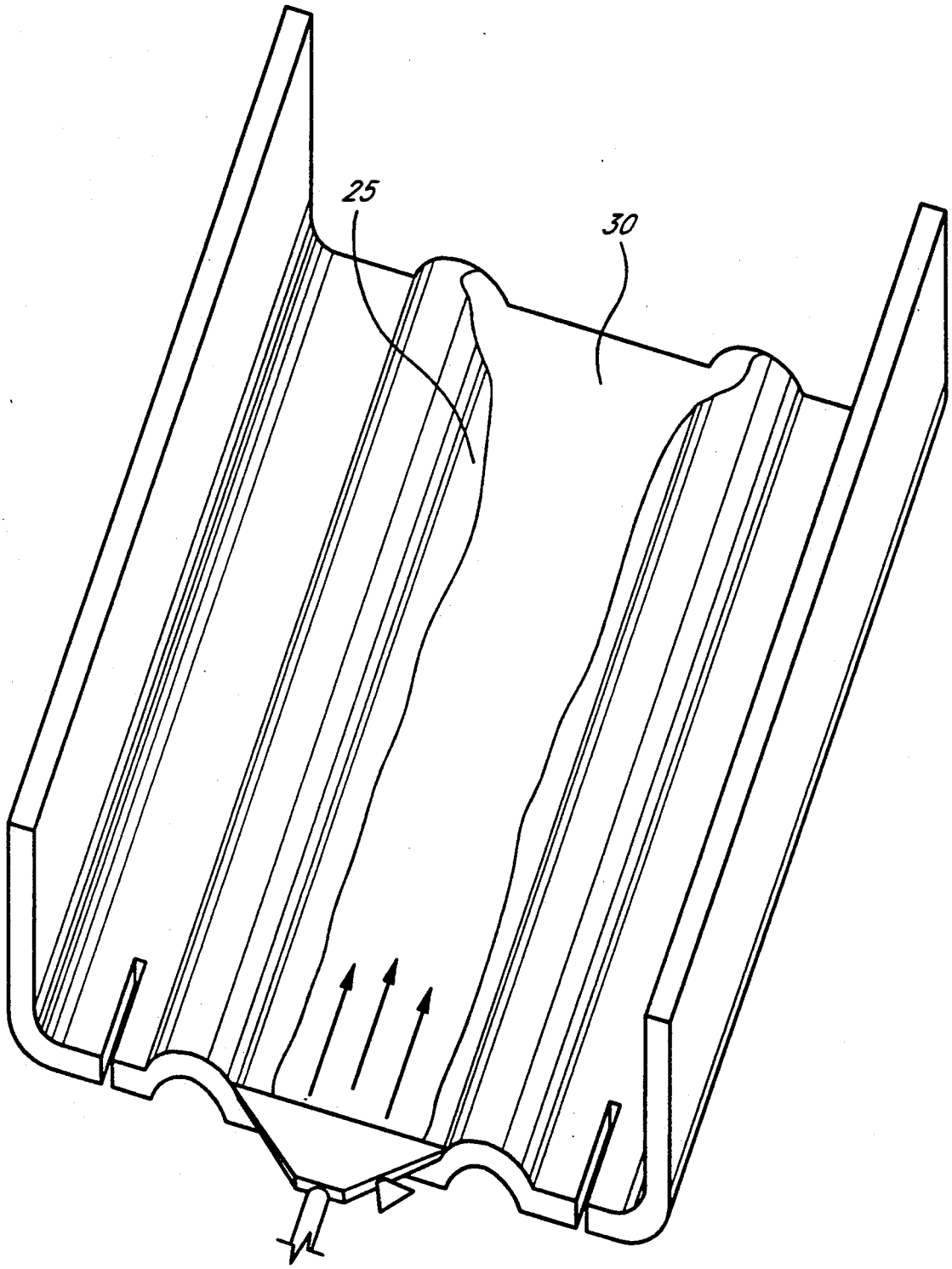
FIG. 5G is third in a series of three illustrations that depicts in time-lapse sequence the self-clearing capability of an upwardly inclined Triple Flume.

As previously discussed, one of the operational benefits of Triple Flume 35 unique design occurs primarily in the context of horizontal or upward directed flows during either the water flow start-up procedure with no rider present, or when a lower speed rider encounters a higher speed water flow, or in the situation of an excessive accumulation of injected water. In the standard start up procedure, a time lag usually exists between initial start-up operating flow and pressure and full operating flow and pressure. This delay exists due to the time it takes to get a flow control valve 23 fully open, or if already open, the time it takes to get the pump or other means of water supply up to full operating speed or efficiency. FIG. 5E, 5F, and 5G show in time lapse sequence how the design of Triple Flume 35 operates to solve the problem of a pressure/flow lag during start-up. In FIG. 5E jet-water flow 30 has commenced issue in an uphill direction from nozzle 24. As jet-water flow 30 moves up riding surface 25 the leading edge of water flow is slowed down by a combination of the downward force of gravity and friction with riding surface 25, whereupon, it is overtaken and pushed by the faster and stronger flow of water that subsequently issues from nozzle 24. The result of this flow dynamic is that a transient surge 33 begins to build. However, as transient surge 33 builds, it reaches the height of low channel walls 27*f* and 27*g* and commences to spill into overflow flumes 36*a* and 36*b*. Since overflow flumes 36*a* and 36*b* are at an incline, overflow water 37*a* and 37*b* flows downhill attributable to the force of gravity to porous overflow vents 38*a* and 38*b*, whereupon, it will drain and either be pump recycled to the water source 22 or used in some other fashion. FIG. 5F shows this start procedure moments later wherein the water pressure/flow rate from water source 22 or flow control valve 23 has increased and transient surge 33 has moved further up the incline. Overflow water 37*a* and 37*b* continues to pour in and run down to porous overflow vents 38*a* and 38*b*. FIG. 5G shows the final stage of start-up wherein the transient surge 33 has been pushed over the top of rising riding surface 25 and jet-water flow 30 now runs clear. Similar to the start-up procedure, when a lower speed rider encounters the higher speed water, or when an accumulative build-up of water results from a series of injected water flows, a transient surge may occur. In like manner, the transient surge will clear by spilling off to the overflow flumes and draining accordingly. Operationally, Triple Flume 35 is limited to predominantly straight sections since the height of the low channel walls 27*f* and 27*g* are insufficient to contain rider 29 to the inside slope of any significant arc's radius of curvature due to the centrifugal acceleration of rider 29. Consequently, if one attempted to significantly curve Triple Flume 35, the centrifugal force associated with high velocity water would cause rider and water to jump the outside low rise channel wall into the overflow flume. Despite the inability of Triple Flume 35 to allow significant changes in direction, the principal advantage that Triple Flume 35 has over existing art is its ability to achieve a smooth upward jet-water flow and retain this smooth jetted flow at high degrees of incline under a broad range of operating water flow variables.

Figure 5H:
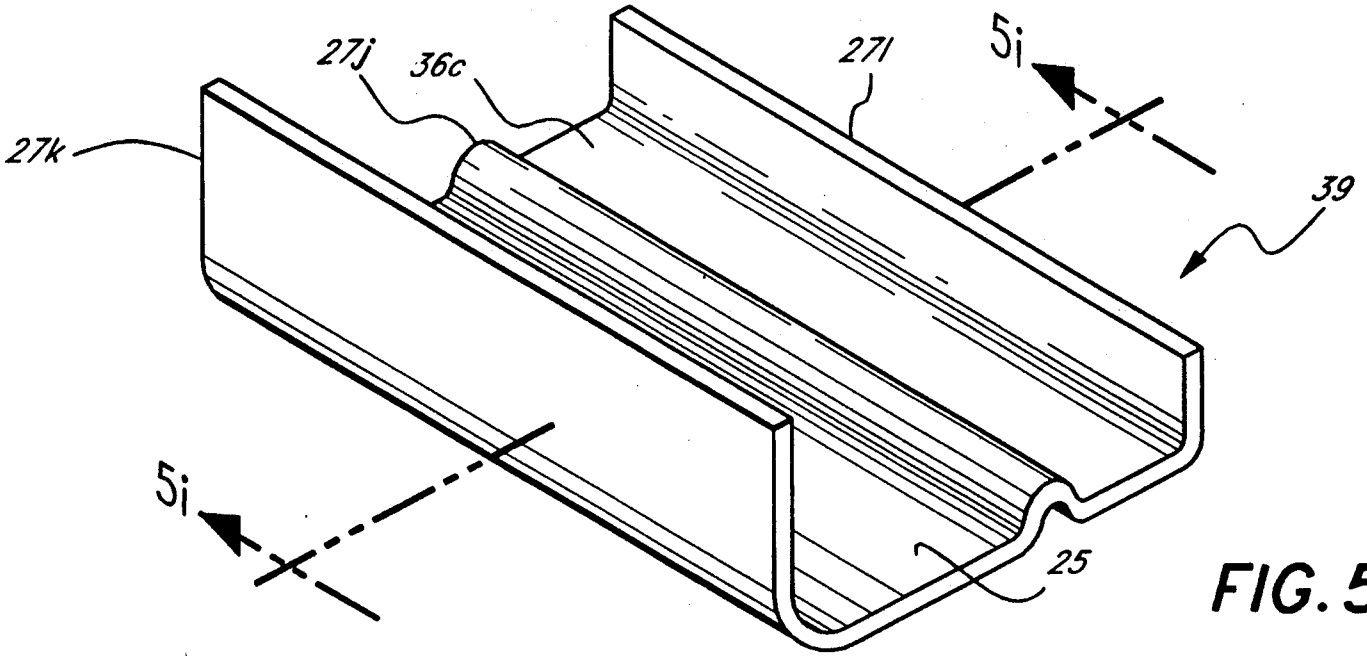
FIG. 5H is a perspective view of an "overflow vent" mechanism, further described as a Double Flume.
Figure 5I:
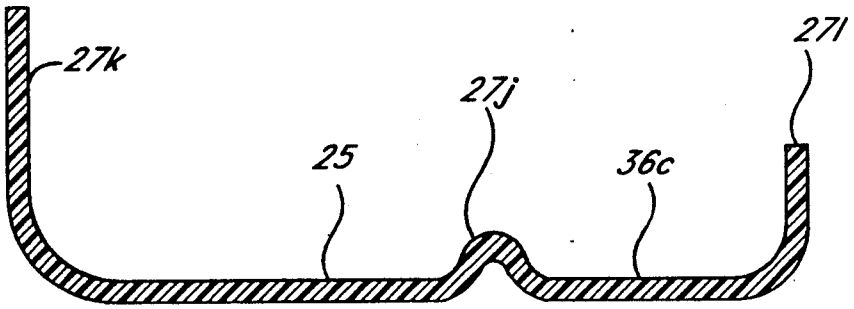
FIG. 5I shows in cross section the Double Flume.
Figure 5J:
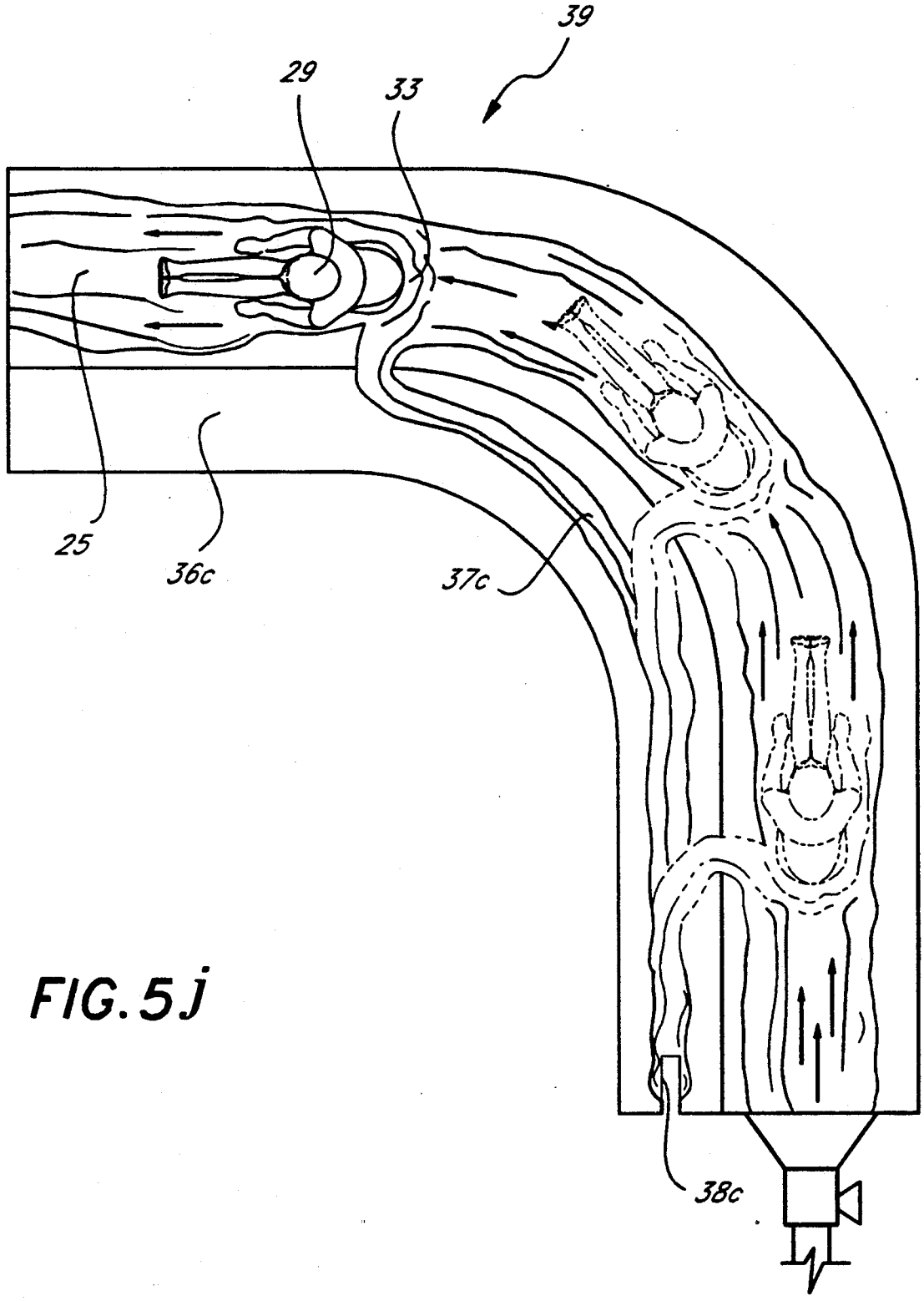
FIG. 5J shows a rider during various stages of a turn on the Double Flume.
Figure 5K:
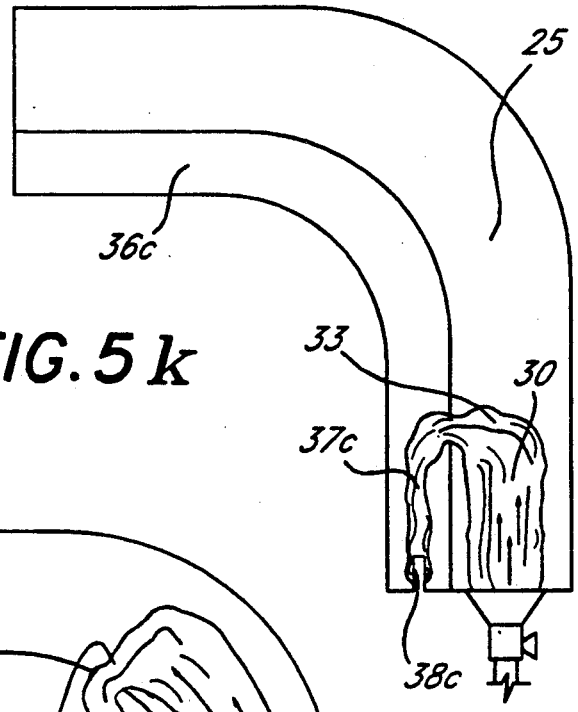
FIG. 5K is one in a series of three illustrations that depicts in time-lapse sequence the self-clearing capability of an upwardly inclined Double Flume.
Figure 5L:
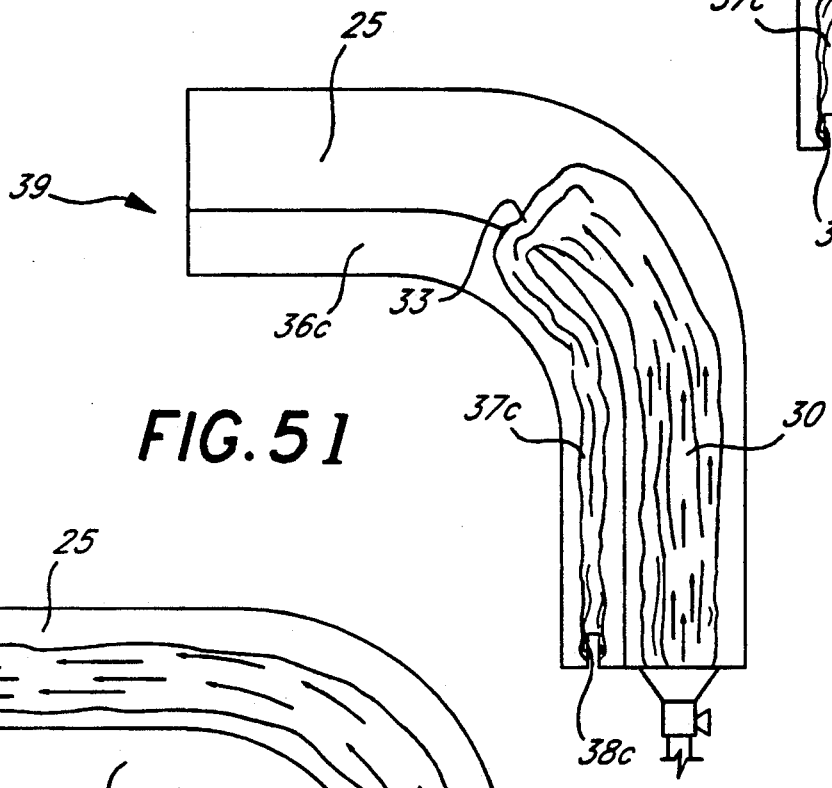
FIG. 5L is the second in a series of three illustrations that depicts in time-lapse sequence the self-clearing capability of an upwardly inclined Double Flume.
Figure 5M:
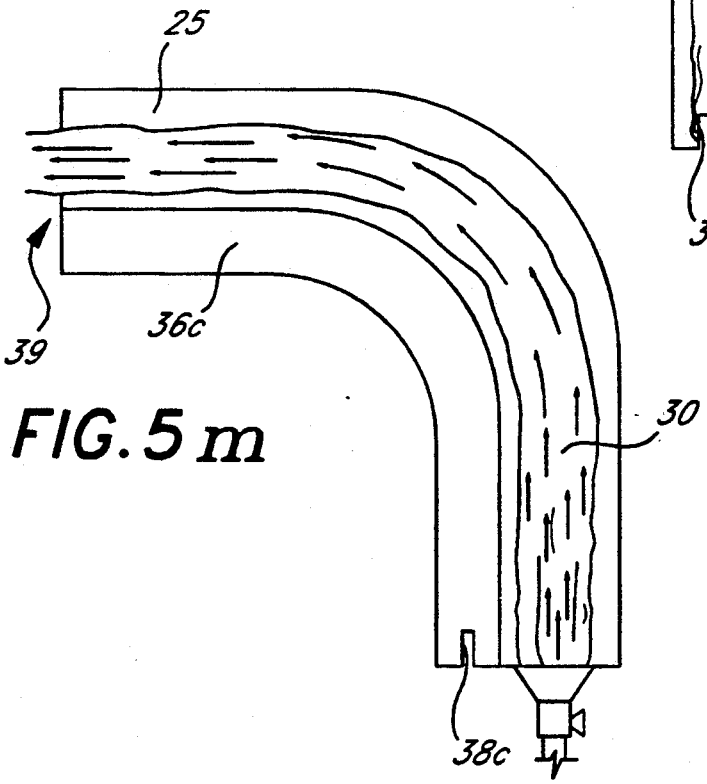
FIG. 5M is third in a series of three illustrations that depicts in time-lapse sequence the self-clearing capability of an upwardly inclined Double Flume.

FIG. 5H shows a perspective view and FIG. 5I shows a cross-section of a modified design of the overflow vent or "flume within a flume" self-venting embodiment, hereafter referred to as a Double Flume 39. Structurally, Double Flume 39 is comprised of riding surface 25 and an overflow flume 36c. Riding surface 25 is integrated or connected on one side to a low rise channel wall 27j and on the other side to a high channel wall 27k. Overflow flume 36c abuts and integrates, connects or shares low rise channel wall 27j and on its opposite side integrates or connects to a high channel wall 27l. On the one hand, as a consequence of having only one side to vent from, Double Flume 39 does not vent as efficiently as Triple Flume 35, and accordingly, is unable to achieve the high degrees of inclined steepness as Triple Flume 35. On the other hand, because of the integration of high channel wall 27k with riding surface 25, Double Flume 39 can be configured to permit high degrees of curvature with rider 29 being safely contained on the inside slope of high channel wall 27k. FIG. 5J illustrates this ability of Double Flume 39 to allow upwardly inclined turns. FIG. 5J shows rider 29 in varying stages of a turn on Double Flume 39 with portions of transient surge 33 spilling into overflow flume 36c, whereupon this overflow water 37c gravity drains to porous overflow vent 38c. The ability of Double Flume 39 to allow uphill turns as well as self-vent is a unique and significant advantage over the existing art. The radius of arc, degrees of curvature, left or right orientation and turn-to-turn connectivity/oscillation that is attainable by Double Flume 39 is substantially similar to that which is currently in use by those skilled in the art of building and operating conventional downhill water rides. However, as distinct from conventional downhill water rides, the orientation of Double Flume 39 is predominantly at an upward incline with jet-water flow and rider moving in an upward direction on riding surface 25, and any overflow water that spills into overflow flume 36c moving in a downward direction due to the force of gravity. Horizontal application of Double Flume may also be appropriate in those circumstances where transient surge build up interferes with the smooth jet-water flow. However, during any horizontal application overflow flume 36c must maintain a sufficient degree of slope to permit overflow water to properly drain. Operationally Double Flume 39 functions in a similar manner to solve the transient surge problems associated with ride start-up, rider transition, and water accumulation as Triple Flume 35 with the exception that overflow water 37c vents only on the one low rise side. FIG. 5K, FIG. 5L and FIG. 5M illustrates in time lapse sequence how Double Flume 39 operates in the start-up situation to allow self-venting and facilitate the desired clear smooth flow. In this sequence, it can be observed that as jet-water flow 30 progresses up riding surface 25, transient surge 33 builds and spills into overflow flume 36c, whereupon overflow water 37c gravity drains to vent 38c.

To safely take advantage of the functional propulsive benefits offered by module 21, it is preferred that an entering vehicle or rider 29 attain an initial start velocity prior to module 21 entry. Numerous techniques are available in the existing art to achieve such initial start velocity, for example, a conventional gravity powered declining waterslide or dry slide, or, a mechanized spring or hydraulic/pneumatic powered ram, etc. It is also preferred that the direction of entry for the vehicle or rider 29 is substantially aligned with the direction of jet-water flow 30. Such alignment is particularly important in the Accelerator embodiments as described herein, so as to insure the most efficient water-to-rider momentum transfer. It is possible for a rider or vehicle to enter jet-water flow 30 in an unaligned manner or in direct opposition to its flow. Such entry will result in a larger transient surge and greater velocity reduction, however, care must be taken to avoid tumbling and injury that could result from the angled and impacting jetted water.

The final element of module 21 that requires description is the velocity of jet-water flow 30 as issued from nozzle 24 relative to the velocity of any object (e.g., a vehicle or rider 29) that slides into or enters jet-water flow 30. This "relative" velocity will vary depending upon the functional purpose of module 21. If acceleration of an entering object is desired, then, the velocity of the water will be in excess of the object in the pre-determined direction of flow. This instance is further described in the following Horizontal, Upward and Downward Accelerator embodiments. If no acceleration or de-acceleration is desired, then, the velocity of jet-water flow 30 will be equal to or less than the velocity of the entering object. This instance is later described in the Non-Accelerating Propulsor embodiments herein.

Figure 6A:
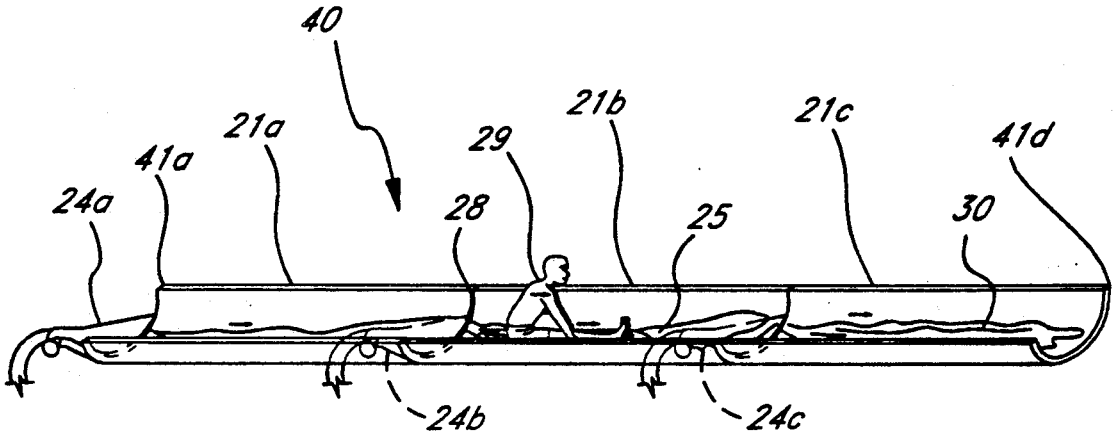
FIG. 6A depicts a generalized view of a three module Horizontal Accelerator with rider.

DESCRIPTION OF HORIZONTAL ACCELERATOR:

Turning now to FIG. 6A, there is illustrated a preferred embodiment hereinafter referred to as Horizontal Accelerator 40 comprised of one or more modules 21a, 21b, and 21c, et seq. The extreme ends 41a and 41b of the Horizontal Accelerator 40 can be joined to known water attraction rides (e.g., a standard waterslide or flume ride) to serve as a continuation thereof and as an improvement thereto. The extreme ends 41a and 41b can also be joined to other embodiments of the invention disclosed herein. As further illustrated in FIG. 6B, the two distinguishing features of the Horizontal Accelerator 40 are that: (1) the orientation of each module 21 is substantially normal to the force of gravity with nozzle 24 and aperture 28 directing jet-water flow 30 substantially parallel to riding surface 25, and at least that portion of riding surface 25 positioned closest to nozzle 24 laying horizontal and normal to the force of gravity; and (2) that jet-water flow 30 that issues from nozzle 24 moves at a velocity in excess of the velocity of rider 29 in the predetermined direction of flow. It should be noted that riding surface 25 subsequent to that portion closest to nozzle 24 can gradually vary in incline so as to facilitate connection to other embodiments of the invention disclosed herein or to other known water attraction rides.

From the description above, a number of advantages of Horizontal Accelerator 40 becomes evident:

(a) Contrary to conventional attractions, the horizontal layout of the embodiment eliminates the need for a loss of elevation in order to accelerate a participant over a given distance.

(b) The sight, sound, and sensation of horizontal acceleration induced by high speed jets of water impacting a rider is a thrilling participant and observer experience. Furthermore, the rider can gain speed for increased thrill and in set up for subsequent conventional waterslide maneuvers, e.g., twists, turns, jumps, drops, finale, etc.

(c) Increased rider velocity due to acceleration by the high speed jets of water will result in higher through-put capacity over a given period of time. Higher through-put capacity results in higher participant satisfaction and increased revenue for ride operators.

(d) For those installations where rider acceleration is a function of increased attraction elevation, the present embodiment will permit acceleration without the cost of building to the higher elevation.

OPERATION OF HORIZONTAL ACCELERATOR

Figure 6B:
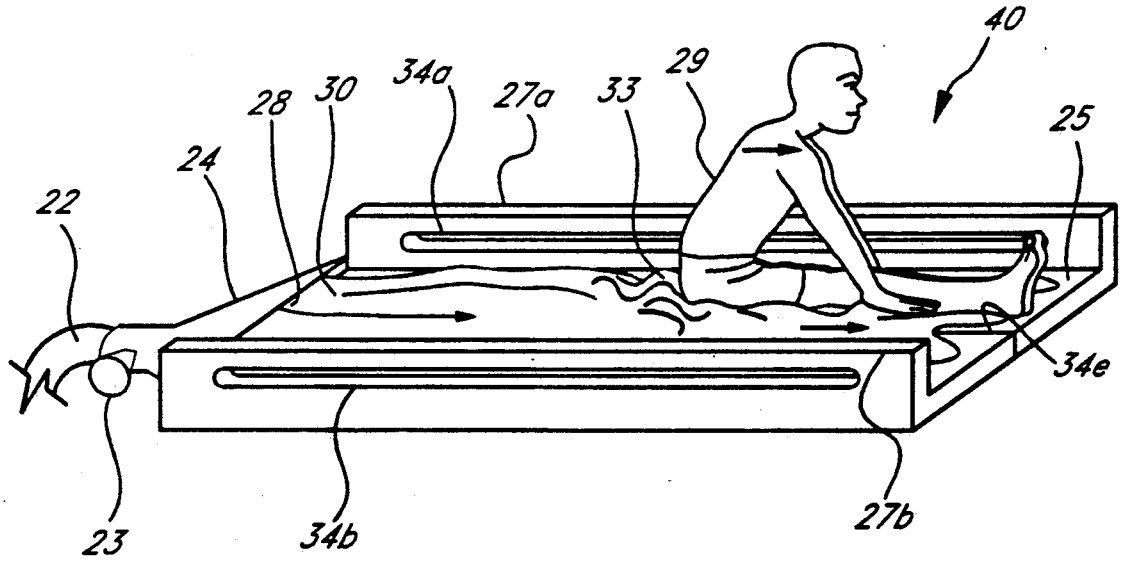
FIG. 6B depicts a Horizontal Accelerator in operation.

For purposes of operating Horizontal Accelerator 40, it is assumed that a rider (or rider with vehicle) has attained an initial start velocity in the conventional manner as known to those skilled in the art. Upon achieving this initial start velocity, rider 29 first enters the Horizontal Accelerator 40 at that end which is nearest nozzle 24 and moves along its length as shown in FIG. 6B. Jet-water flow 30 originating from water source 22, is already issuing from nozzle 24 when rider 29 enters its flow. Since the velocity of jet-water flow 30 is moving at a rate greater than the speed of the entering rider 29, a transfer of momentum from the higher speed water to the lower speed rider causes the rider to accelerate and approach the speed of the more rapidly moving water. Flow control valve 23 and adjustable aperture 28 permits adjustment to water flow velocity, thickness, width, and pressure thus ensuring proper rider acceleration. During this process of transferred momentum, a small transient surge 33 will build behind the rider. Transient surge 33 build-up can be minimized (if desired) by allowing excess build-up to flow over and off the sides of the riding surface 25. If rider 29 is in a channel, this build up can either be eliminated by venting transient surge 33 through porous vents 34*a* and 34*b* along channel walls 27*a* and 27*b*; or by way of porous vent 34*e* that is incorporated into riding surface 25. Other vent mechanisms, e.g., Triple Flume or Double Flume, could also serve to solve the transient surge problem. Since Horizontal Accelerator 40 can be comprised of one or more modules 21*a*, 21*b*, 21*c*, et seq., (as shown in FIG. 6A) and assuming these modules are properly aligned in substantially the same direction, rider 29 can move from module 21*a* to module 21*b* to module 21*c*, et seq. with corresponding increases in acceleration caused by the progressive increase in water velocity issued from each subsequent nozzle 24*a*, 24*b*, 24*c*, et seq., until a desired maximum acceleration is reached. It will be obvious to those skilled in the art that the Horizontal Accelerator can be connected at both ends to known water attraction rides as a continuation thereof, and as an improvement thereto. Furthermore, the extreme ends can also be joined to other embodiments of the invention disclosed herein.

Accordingly, it should now be apparent that the Horizontal Accelerator embodiment of this invention can be used in a water ride attraction to accelerate a rider in lieu of the force of gravity and without a loss of vertical altitude. It should also be noted, that water build-up and the transient surge that results from the impact of high speed jetted water with a slow speed rider can be removed through proper design of the riding surface and/or channel wall. In addition, the Horizontal Accelerator has the following advantages:

It permits acceleration without the requisite cost of building to a higher elevation.

It allows a rider to experience the sight, sound, and sensation of horizontal acceleration induced by high speed jets of water. This experience is exciting for participant and observer. Furthermore, it permits a participant to gain speed for increased thrill and in set up for subsequent conventional waterslide maneuvers, e.g., twists, turns, jumps, drops, finale, etc.

It allows increases to rider velocity which results in higher participant through-put and ride capacity, thus, resulting in greater rider satisfaction and enhanced operator revenue.

DESCRIPTION OF UPWARD ACCELERATOR

Figure 7A:
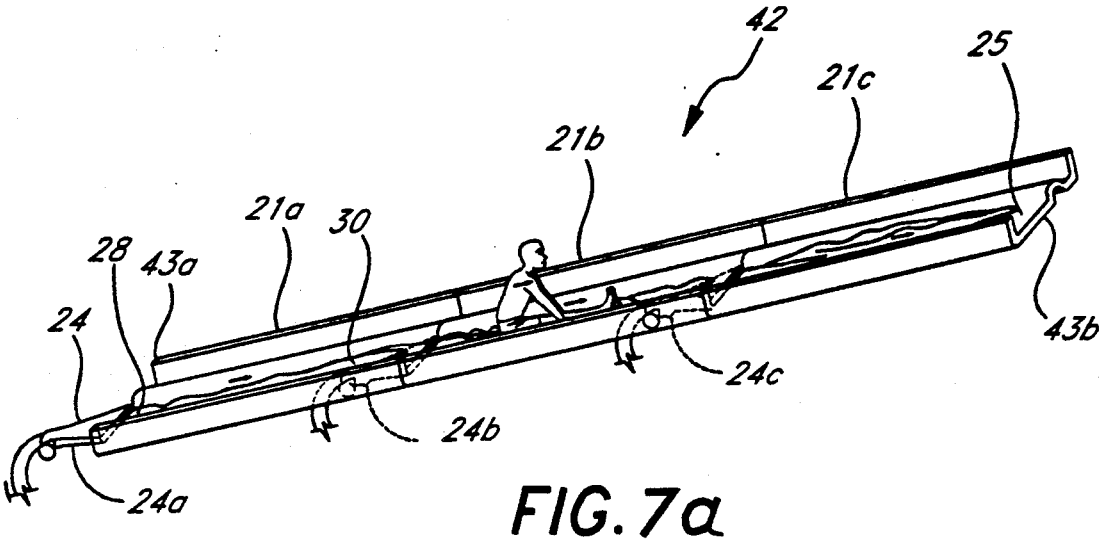
FIG. 7A depicts a generalized view of a three module Upward Accelerator with rider.

Turning now to FIG. 7A, we see an illustration of a preferred embodiment hereinafter referred to as an Upward Accelerator 42 comprised of one or more modules 21*a*, 21*b*, and 21*c*, et seq. The extreme ends 43*a* and 43*b* of Upward Accelerator 42 can be joined to known water attraction rides (e.g., a standard waterslide or flume ride) to serve as a continuation thereof and as an improvement thereto. The extreme ends 43*a* and 43*b* can also be joined to other embodiments of the invention disclosed herein. As further illustrated in FIG. 7B the two distinguishing features of Upward Accelerator 42 are that: (1) the orientation of module 21 is at substantially an upward incline with that portion of riding surface 25 positioned closest to nozzle 24 being inclined upwardly from the horizontal, and nozzle 24 and aperture 28 directing jet-water flow 30 substantially parallel to riding surface 25 and at an angle directed with nozzle 24 and aperture 28 pointing upwardly from the horizontal; and (2) that jet-water flow 30 that issues from nozzle 24 moves at a velocity in excess of the velocity of rider 29 in the predetermined direction of flow. It should be noted that riding surface 25 subsequent to that portion closest to nozzle 24 can gradually vary in incline so as to facilitate connection to other embodiments of the invention disclosed herein or to other known water attraction rides.

From the description above, a number of advantages of Upward Accelerator 42 become evident:

(a) The upwardly inclined layout of the embodiment permits acceleration in an upward direction. Such performance reduces or eliminates the traditional need for a loss of elevation in order to accelerate a participant over a given distance.

(b) The sight, sound, and sensation of upward acceleration induced by high speed jets of water impacting a rider is a thrilling participant and observer experience. Furthermore, the rider can gain speed for increased thrill and in set up for subsequent conventional waterslide maneuvers, e.g., twists, turns, jumps, drops, finale, etc.

(c) Increased rider velocity due to acceleration by the high speed jets of water will result in higher through-put capacity over a given period of time.

(d) Acceleration in the upward direction can reduce or eliminate the need for participants to walk to a higher elevation before boarding the attraction. Such reduction can reduce costs for associated stairs, walkways, elevators and other participant or vehicle conveyance systems.

OPERATION OF UPWARD ACCELERATOR

Figure 7B:
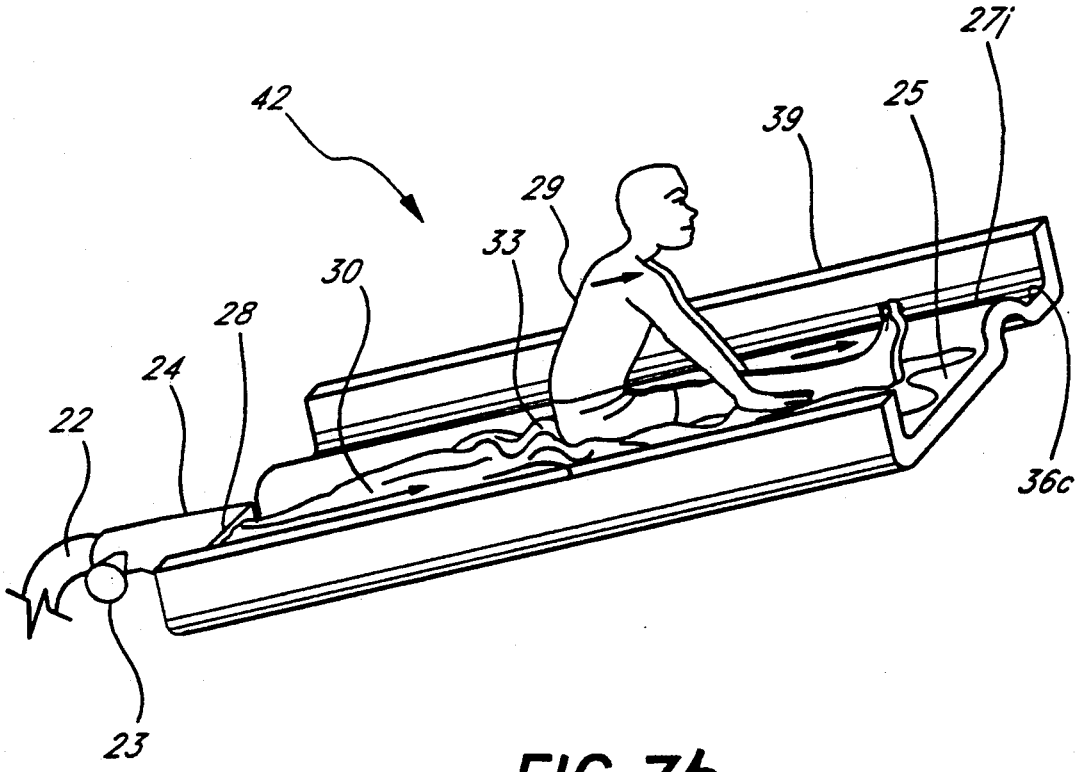
FIG. 7B depicts a Upward Accelerator in operation.

For purposes of operating Upward Accelerator 42, it is assumed that a rider (or rider with vehicle) has attained an initial start velocity in the conventional manner as known to those skilled in the art. Upon achieving this initial start velocity, rider 29 first enters Upward Accelerator 42 at that end which is nearest nozzle 24 and moves along its length as shown in FIG. 7B. Jet-water flow 30 originating from water source 22, is already issuing from nozzle 24 through adjustable aperture 28 when rider 29 enters its flow. Since the velocity of jet-water flow 30 is moving at a rate greater than the speed of the entering rider 29, a transfer of momentum from the higher speed water to the lower speed rider causes the rider to accelerate and approach the speed of the more rapidly moving water. Flow control valve 23 and adjustable aperture 28 permits adjustment to water flow velocity, thickness, width, and pressure thus ensuring proper rider acceleration. During this process of transferred momentum, a small transient surge 33 will build behind the rider. Transient surge 33 can be minimized by allowing excess build-up to flow over and off the sides of the riding surface 25. If rider 29 is in Double Flume 39 as illustrated, this build up can be eliminated by venting transient surge 33 over the low channel wall **27*j* and down overflow flume 36*c* to drain. Other vent mechanisms, e.g., Triple Flume or porous vents, could also serve to solve the transient surge problem. Since Upward Accelerator 42 can be comprised of one or more modules 21*a*, 21*b*, 21*c*, et seq., (as shown in FIG. 7A) rider 29 can move from module 21*a* to module 21*b* to module 21*c*, et seq. with corresponding increases in acceleration caused by the progressive increase in water velocity issued from each subsequent nozzle 24*a*, 24*b*, 24*c*, et seq., until a desired maximum acceleration is reached. It will be obvious to those versed in the art that Upward Accelerator 42**, as an improvement thereto, can be connected at both ends to conventional water attraction rides and to other embodiments of the invention disclosed herein.

Accordingly, it should be apparent that the Upward Accelerator embodiment of this invention can be used in a water ride attraction to accelerate a rider in opposition to the force of gravity and in an upward direction. Water that was conventionally pumped upward in enclosed pipes to a higher elevation can now be ridden for the amusement of the participant and the economy of the attraction operator. It should also be noted that the transient surge that results from the impact of high speed jetted water with a slow speed rider can be removed through proper design of the riding surface and/or channel wall. In addition, the Upward Accelerator has the following advantages:

Its upwardly inclined layout permits acceleration in an upward direction. Such performance eliminates the traditional need for a loss of elevation in order to accelerate a participant over a given distance.

It allows a rider to experience the sight, sound, and sensation of upward acceleration induced by high speed jets of water. This experience is exciting for participant and observer. Furthermore, the rider can gain speed for increased thrill and in set up for subsequent conventional waterslide maneuvers, e.g., twists, turns, jumps, drops, finale, etc.

It allows increases to rider velocity which results in higher participant through-put and ride capacity, thus, resulting in greater rider satisfaction and enhanced operator revenue.

It permits rider ascent to higher elevations without the requisite cost of building stairs, walkways, elevators, or other conveyance structures or mechanisms to such higher elevations.

DESCRIPTION OF DOWNWARD ACCELERATOR

Figure 8A:
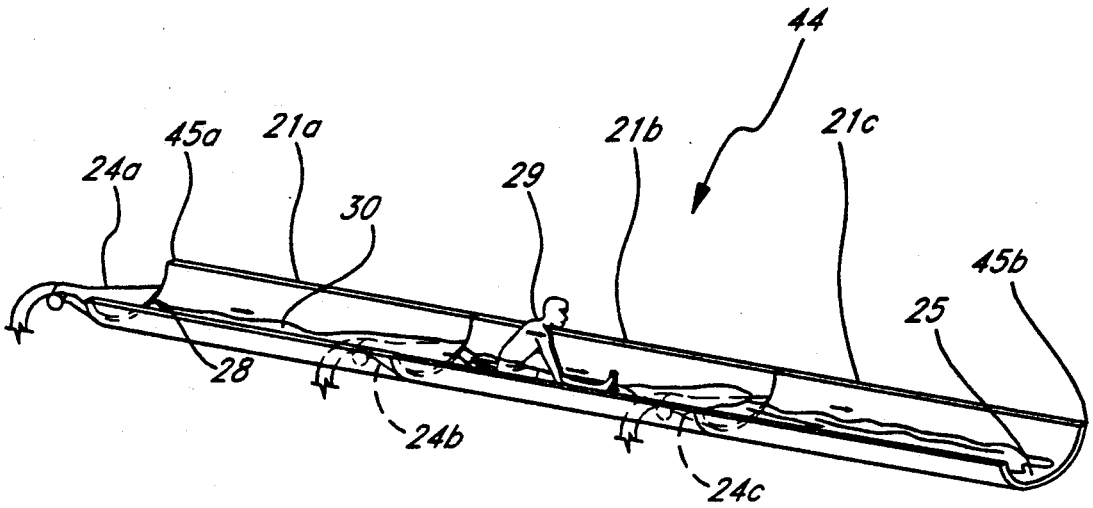
FIG. 8A depicts a generalized view of a three module Downward Accelerator with rider.

Turning now to FIG. 8A, we see an illustration of a preferred embodiment hereinafter referred to as a Downward Accelerator 44 comprised of one or more modules **21*a*, 21*b*, and 21*c*, et seq. The extreme ends 45*a* and 45*b* of the Downward Accelerator can be joined to known water attraction rides (e.g., a standard waterslide or flume ride) to serve as a continuation thereof and as an improvement thereto. The extreme ends 45*a* and 45*b* can also be joined to other embodiments of the invention disclosed herein. As further illustrated in 7B, the two distinguishing features of Downward Accelerator 44 are that: (1) the orientation of each module 21 is at substantially a downward incline with that portion of riding surface 25 positioned closest to nozzle 24 being inclined downwardly from the horizontal, and nozzle 24 and aperture 28 directing jet-water flow 30 substantially parallel to riding surface 25 and at an angle directed with nozzle 24 and aperture 28 pointing downwardly from the horizontal; and (2) that jet-water flow 30 that issues from nozzle 24 moves at a velocity in excess of the velocity of rider 29 in the predetermined direction of flow. It should be noted that riding surface 25 subsequent to that portion closest to nozzle 24** can gradually vary in incline so as to facilitate connection to other embodiments of the invention disclosed herein or to other known water attraction rides.

From the description above, a number of advantages of Downward Accelerator 44 become evident:

(a) The downwardly inclined layout of the embodiment permits acceleration in a downward direction in excess of the acceleration due to the force of gravity. Such performance enhances the traditional ride characteristics of conventional water ride attractions.

(b) The sight, sound, and sensation of downward acceleration induced by high speed jets of water impacting a rider is a thrilling participant and observer experience. Furthermore, the rider can gain speed for increased thrill and in set up for subsequent conventional waterslide maneuvers, e.g., twists, turns, jumps, drops, finale, etc.

(c) Increased rider velocity due to acceleration by the invention will result in higher through-put capacity over a given period of time.

OPERATION OF DOWNWARD ACCELERATOR

Figure 8B:
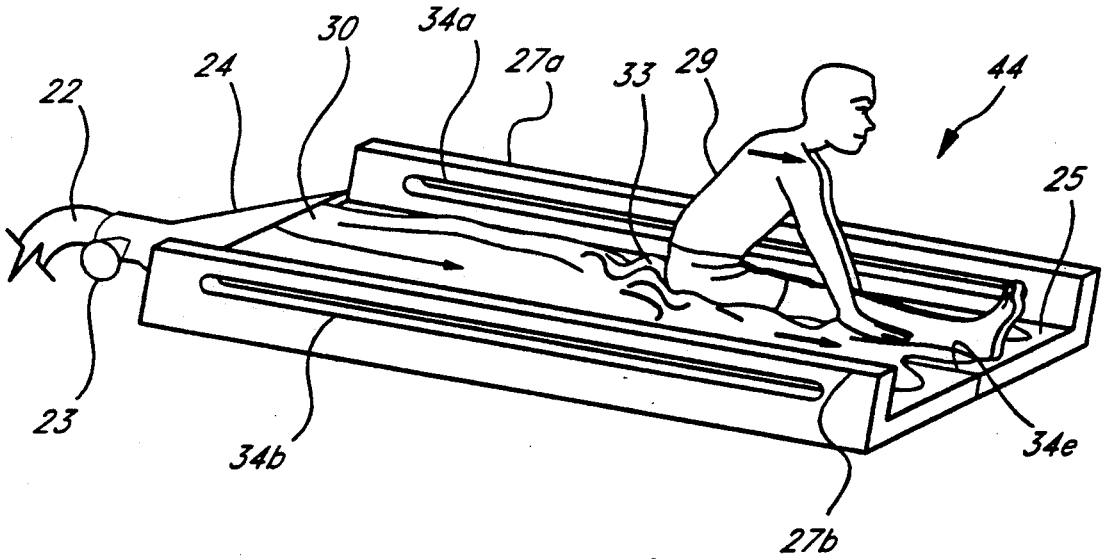
FIG. 8B depicts a Downward Accelerator in operation.

For purposes of operating Downward Accelerator 44, it is assumed that a rider (or rider with vehicle) has attained an initial start velocity in the conventional manner as known to those skilled in the art. Upon achieving this initial start velocity, rider 29 first enters Downward Accelerator 44 at that end which is nearest nozzle 24 and moves along its length as shown in FIG. 8B. Jet-water flow 30 originating from water source 22, is already issuing from nozzle 24 and aperture 28 when rider 29 enters its flow. Flow control valve 23 and adjustable aperture 28 permits adjustment to water flow velocity, thickness, width, and pressure thus ensuring proper rider acceleration. Since the velocity of jet-water flow 30 is moving at a rate greater than the speed of the entering rider 29, a transfer of momentum from the higher speed water to the lower speed rider causes the rider to accelerate and approach the speed of the more rapidly moving water. During this process of transferred momentum, a small transient surge 33 may build behind the rider. Transient surge 33 can be minimized (if desired) by allowing excess build-up to flow over and off the sides of the riding surface 25. If the rider 29 is in a channel this build up can either be eliminated by venting transient surge 33 through porous vents 34*a* and 34*b* along channel walls 27*a* and 27*b*; or by way of porous vent 34*e* that is incorporated into riding surface 25. Other vent mechanisms, e.g., Triple Flume or Double Flume, could also serve to solve the transient surge problem. Since Downward Accelerator 44 can be comprised of one or more modules 21*a*, 21*b*, 21*c*, et seq., (as shown in FIG. 8A) rider 29 can move from module 21*a* to module 21*b* to module 21*c*, et seq. with corresponding increases in acceleration caused by the progressive increase in water velocity issued from each subsequent nozzle 24*a*, 24*b*, 24*c*, et seq., until a desired maximum acceleration is reached. It will be obvious to those versed in the art that Downward Accelerator 44, as an improvement thereto, can be connected at both ends to conventional water attraction rides and to other embodiments of the invention disclosed herein.

Accordingly, it will be apparent that the Downward Accelerator embodiment of this invention can be used in a water ride attraction to augment the force of gravity in the downward direction. In addition, the Downward Accelerator has the following advantages:

Its downward inclined layout permits acceleration in the downward direction in excess of the force of gravity. Such performance can minimize the linear distance required in order to accelerate a participant to a desired velocity. Reductions in required linear distance can reduce overall costs by reducing the amount of materials and requisite structural height normally associated with conventional "gravity powered" systems.

It allows a rider to experience the sight, sound, and sensation of a dramatic change in downward acceleration induced by high speed jets of water. This experience is exciting for participant and observer. Furthermore, the rider can gain speed for increased thrill and in set up for subsequent conventional waterslide maneuvers, e.g., twists, turns, jumps, drops, finale, etc.

It allows increases to rider velocity which results in higher participant through-put and ride capacity, thus, resulting in greater rider satisfaction and enhanced operator revenue.

DESCRIPTION OF HORIZONTAL, UPWARD, AND DOWNWARD NON-ACCELERATING PROPULSORS

In the context of a water ride that incorporates a riding surface with downward incline followed by an upward incline with subsequent leveling or down-curve of the same riding surface, problems arise when a rider's kinetic energy at the bottom of the rise is insufficient to overcome the forces of drag on a riders travel from this bottom portion to the top of the upward incline. In this situation, a rider cannot make it over the rise and either stops in route to the top, or slides back down to settle at the bottom. Conversely, if the kinetic energy of the rider at the bottom of a rise is substantially in excess of any drag force that the rider may encounter from the bottom of the rise to its top, and if the subsequent flattening or down-curve occurs with a sufficiently short radius of arc, then, the rider may attain an airborne trajectory that is potentially unsafe. Since the forces of drag on water ride attractions are not always constant, e.g., changing ride surface conditions, changing rider/-vehicle conditions, changing water conditions, etc., it is desirable in the interest of ride safety, consistency, capacity and fun, to introduce a mechanism that promotes rider stabilization as well as equalization of differing rider's coefficients of friction. The following Non-accelerating Propulsor Embodiments serve to accomplish these stated objectives. Similar to its "Accelerator" counterpart, Non-accelerating Propulsor embodiments utilize module 21 format. Consequently, Non-accelerating Propulsor modules can be connected in series as desired.

Figure 9:
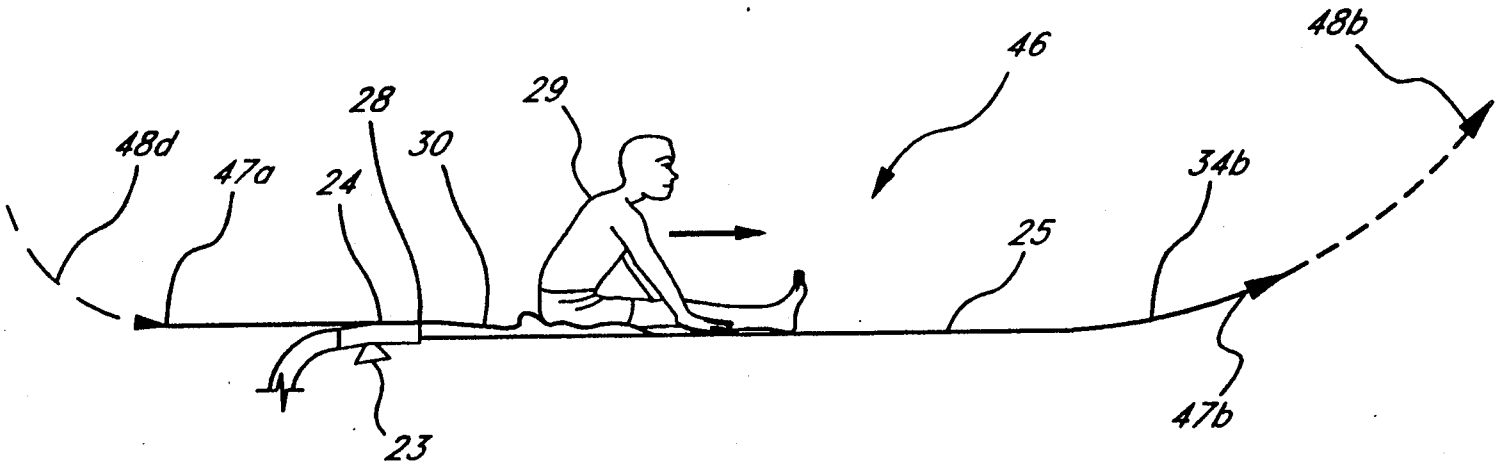
FIG. 9 shows a generalized view of the Horizontal Non-Accelerating Propulsor.

Turning now to FIG. 9, there is illustrated a preferred embodiment hereinafter referred to as a Horizontal Non-Accelerating Propulsor 46. Extreme ends 47*a* and 47*b* of Horizontal Non-Accelerating Propulsor 46 can be joined to known water attraction rides (e.g., a standard waterslide or flume ride) or to other embodiments of the invention disclosed herein to serve as a continuation thereof and as an improvement thereto. A ride continuation path 48 is indicated by corresponding dashed lines 48*a* and 48*b* with arrows pointing in the pre-determined direction of motion. Four distinguishing features of Horizontal Non-Accelerating Propulsor 46 are: (1) the location of Horizontal Non-Accelerating Propulsor 46 is subsequent to the start of rider 29; (2) the orientation of Horizontal Non-Accelerating Propulsor 46 is substantially normal to the force of gravity with nozzle 24 and aperture 28 directing jet-water flow 30 substantially parallel to riding surface 25, and at least that portion of riding surface 25 positioned closest to nozzle 24 laying horizontal and normal to the force of gravity; (3) that jet-water flow 30 that issues from nozzle 24 moves at a velocity equal to or less than the velocity of rider 29 in the predetermined direction of flow; and (4) that riding surface 25 subsequent to that portion closest to nozzle 24 will eventually curve to an upward incline. It should be noted that riding surface 25 subsequent to its upward curvature can gradually vary in incline along its length so as to facilitate connection to other embodiments of the invention disclosed herein or to other known water attraction rides.

Figure 10:
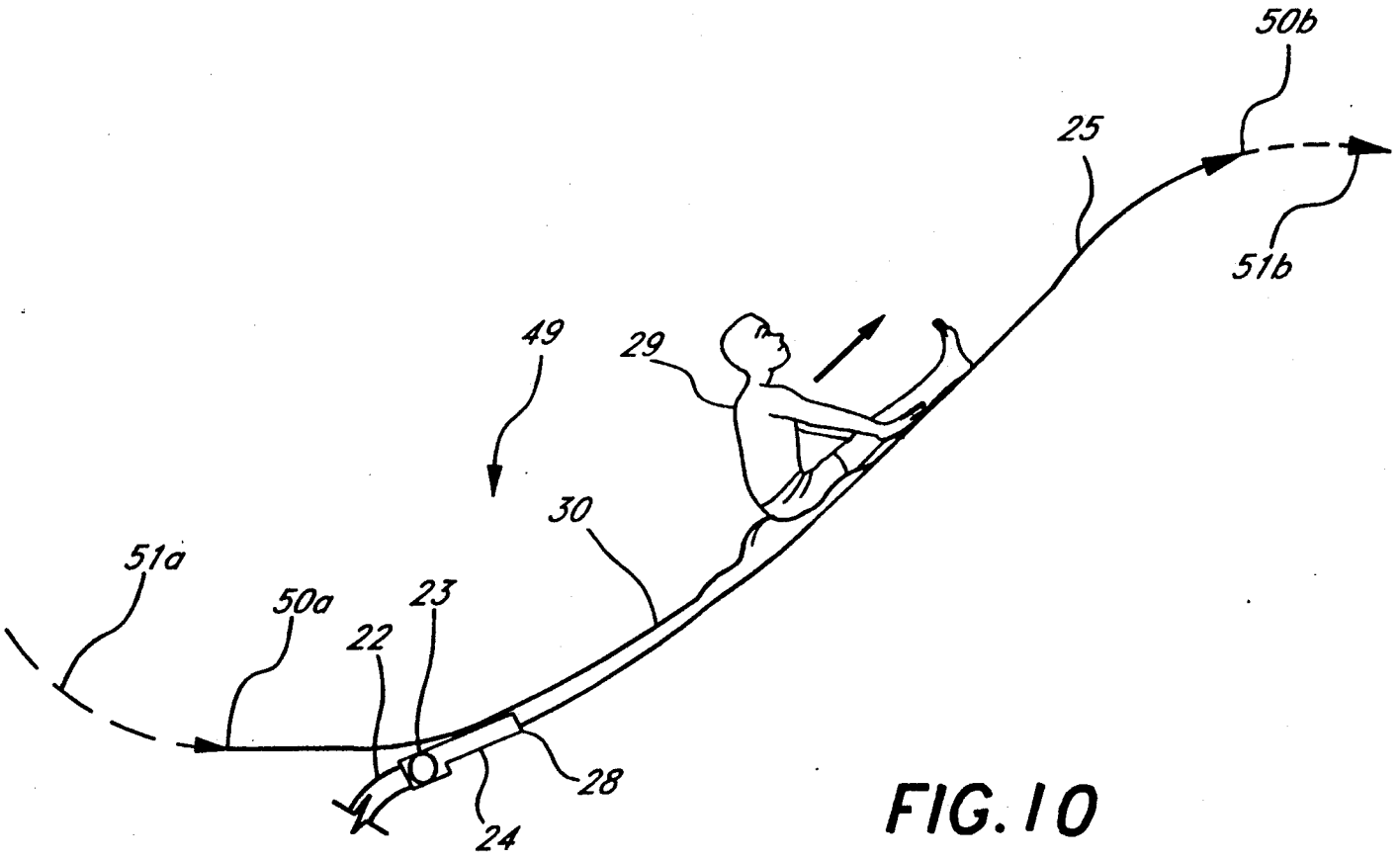
FIG. 10 shows a generalized view of the Upward Non-Accelerating Propulsor.

Turning now to FIG. 10, there is illustrated a preferred embodiment hereinafter referred to as an Upward Non-Accelerating Propulsor 49. The extreme ends 50*a* and 50*b* of Upward Non-Accelerating Propulsor 49 can be joined to known water attraction rides (e.g., a standard waterslide or flume ride) or to other embodiments of the invention disclosed herein to serve as a continuation thereof and as an improvement thereto. A ride continuation path 51 is indicated by corresponding dashed lines 51*a* and 51*b* with arrows pointing in the pre-determined direction of motion. Three distinguishing features of Upward Non-Accelerating Propulsor 49 are: (1) the location of Upward Non-Accelerating Propulsor 49 is subsequent to the start of rider 29; (2) the orientation of Upward Non-Accelerating Propulsor 49 is at substantially an upward incline with that portion of riding surface 25 positioned closest to nozzle 24 being inclined upwardly from the horizontal, and nozzle 24 and aperture 28 directing jet-water flow 30 substantially parallel to riding surface 25; (3) that jet-water flow 30 that issues from nozzle 24 moves at a velocity equal to or less than the velocity of rider 29 in the predetermined direction of flow. It should be noted that riding surface 25 subsequent to that portion closest to nozzle 24 can gradually vary in incline along its length so as to facilitate connection to other embodiments of the invention disclosed herein or to other known water attraction rides.

Figure 11:
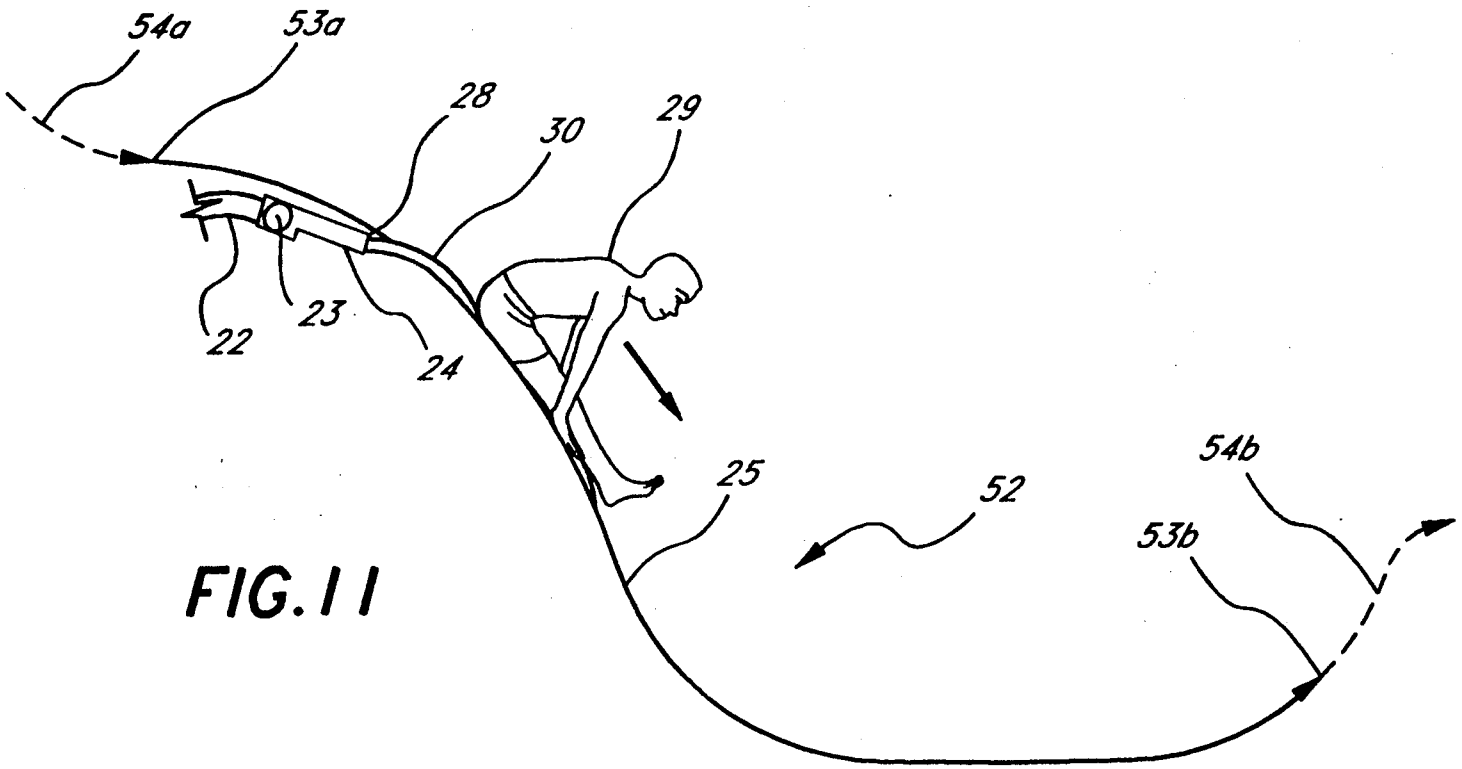
FIG. 11 shows a generalized view of the Downward Non-Accelerating Propulsor.

Turning now to FIG. 11, there is illustrated a preferred embodiment hereinafter referred to as a Downward Non-Accelerating Propulsor 52. The extreme ends 53*a* and 53*b* of Downward Non-Accelerating Propulsor 52 can be joined to known water attraction rides (e.g., a standard waterslide or flume ride) or to other embodiments of the invention disclosed herein to serve as a continuation thereof and as an improvement thereto. A ride continuation path 54 is indicated by corresponding dashed lines 54*a* and 54*b* with arrows pointing in the pre-determined direction of motion. Four distinguishing features of Downward Non-Accelerating Propulsor 52 are: (1) the location of Downward Non-Accelerating Propulsor 52 is subsequent to the start of rider 29; (2) the orientation of Downward Non-Accelerating Propulsor 52 is at substantially a downward incline with that portion of riding surface 25 positioned closest to nozzle 24 being inclined downwardly from the horizontal, and nozzle 24 and aperture 28 directing jet-water flow 30 substantially parallel to riding surface 25; (3) that jet-water flow 30 that issues from nozzle 24 moves at a velocity equal to or less than the velocity of rider 29 in the predetermined direction of flow; and (4) that riding surface 25 subsequent to that portion closest to nozzle 24 will eventually curve to an upward incline. It should be noted that riding surface 25 subsequent to its upward curvature can gradually vary in incline along its length so as to facilitate connection to other embodiments of the invention disclosed herein or to other known water attraction rides.

From the description above, a number of advantages of the Horizontal, Upward, and Downward Non-Accelerating Propulsors become evident:

(a) The injection of additional water flow to the riding surface acts to stabilize a rider who eventually moves in an uphill direction. Furthermore, under circumstances where rider/vehicle coefficients of friction vary the injection of additional water flow will tend to equalize the performance standard for a broader spectrum of riders/vehicles that eventually move in an upward direction.

(b) The sight, sound, and sensation of a rider encountering an injected flow of water is a thrilling participant and observer experience. Furthermore, the rider can stabilize his position for safety and in set up for subsequent conventional waterslide maneuvers, e.g., twists, turns, jumps, drops, finale, etc.

(c) Increased rider stabilization and coefficient of friction equalization due to injected water flows will result in higher through-put capacity over a given period of time due to elimination of aberrant rider performance. Higher through-put capacity results in higher participant satisfaction and increased revenue for ride operators.

OPERATION OF HORIZONTAL, UPWARD, AND DOWNWARD NON-ACCELERATING PROPULSORS

For purposes of operating the Horizontal, Upward, and Downward Non-Accelerating Propulsors, it is assumed that a rider(s) (or rider(s) and vehicle) has attained an initial start velocity in the conventional manner as known to those skilled in the art. FIG. 9 illustrates Horizontal Non-Accelerating Propulsor 46 in operation, with rider 29 first entering the module at that end which is nearest nozzle 24, moving along its length, and eventually rising in elevation as indicated by dashed path 48*b*.

FIG. 10 illustrates Upward Non-Accelerating Propulsor 49 in operation, with rider 29 first entering the module at that end which is nearest nozzle 24, moving along its length, and continuing a rise in elevation as indicated by dashed path 51*b*.

FIG. 11 illustrates Downward Non-Accelerating 52 in operation, with rider 29 first entering the module at that end which is nearest nozzle 24, moving along its length, and eventually rising in elevation as indicated by dashed path 54*b*.

For all three Propulsor embodiments, jet-water flow 30 is already issuing from nozzle 24 when rider 29 enters its flow. The velocity of jet-water flow 30 originating from water source 22, is moving at a rate equal to or less than the speed of the entering rider 29. If rider 29 is moving at a velocity in excess of jet-water flow 30, a transfer of momentum from the lower speed water to the higher speed rider causes the rider to de-accelerate and approach the speed of the slower moving water. Flow control valve 23 and adjustable aperature 28 permits adjustment to water flow velocity, thickness, width, and pressure thus ensuring proper rider stabilization and coefficient of friction equalization. During the process of transferred momentum or during ride start-up as previously described, a small transient surge may build. Transient surge can be minimized (if desired) by allowing excess build-up to flow over and off the sides of the riding surface 25. If the transient surge builds within a channel, this build up can either be eliminated by venting the transient surge through porous vents along the sides and bottom of the channel, or by way of Double Flume or Triple Flume, all as previously described. It will be obvious to those skilled in the art that the Horizontal, Upward, and Downward Non-Accelerating Propulsors can be connected at both ends to known water attraction rides as a continuation thereof, and as an improvement thereto. Furthermore, the extreme ends can also be joined to other embodiments of the invention disclosed herein.

Accordingly, it should now be apparent that the Horizontal, Upward, and Downward Non-Accelerating Propulsor embodiments of this invention can be used in a water ride attraction to stabilize and equalize a wide range of rider/vehicles that have varying coefficients of friction. It should also be noted, that the transient surge that results from the impact of a higher speed rider with a lower speed jet-water flow can be removed through proper design of the riding surface and/or channel wall. In addition, the Horizontal, Upward, and Downward Non-Accelerating Propulsors have the following advantages:

It allows a rider to experience the sight, sound, and sensation of encountering an injected flow of water. This experience is a thrilling for participant and observer alike. Furthermore, it permits a rider to stabilize his position for safety and in set up for subsequent conventional waterslide maneuvers, e.g., twists, turns, jumps, drops, finale, etc.

It allows increased rider stabilization and coefficient of friction equalization due to injected water flows which result in higher through-put capacity over a given period of time due to elimination of aberrant rider performance, thus, resulting in greater rider satisfaction and enhanced operator revenue.

DESCRIPTION AND OPERATION OF THE STABILIZATION/EQUALIZATION PROCESS

Figure 12:
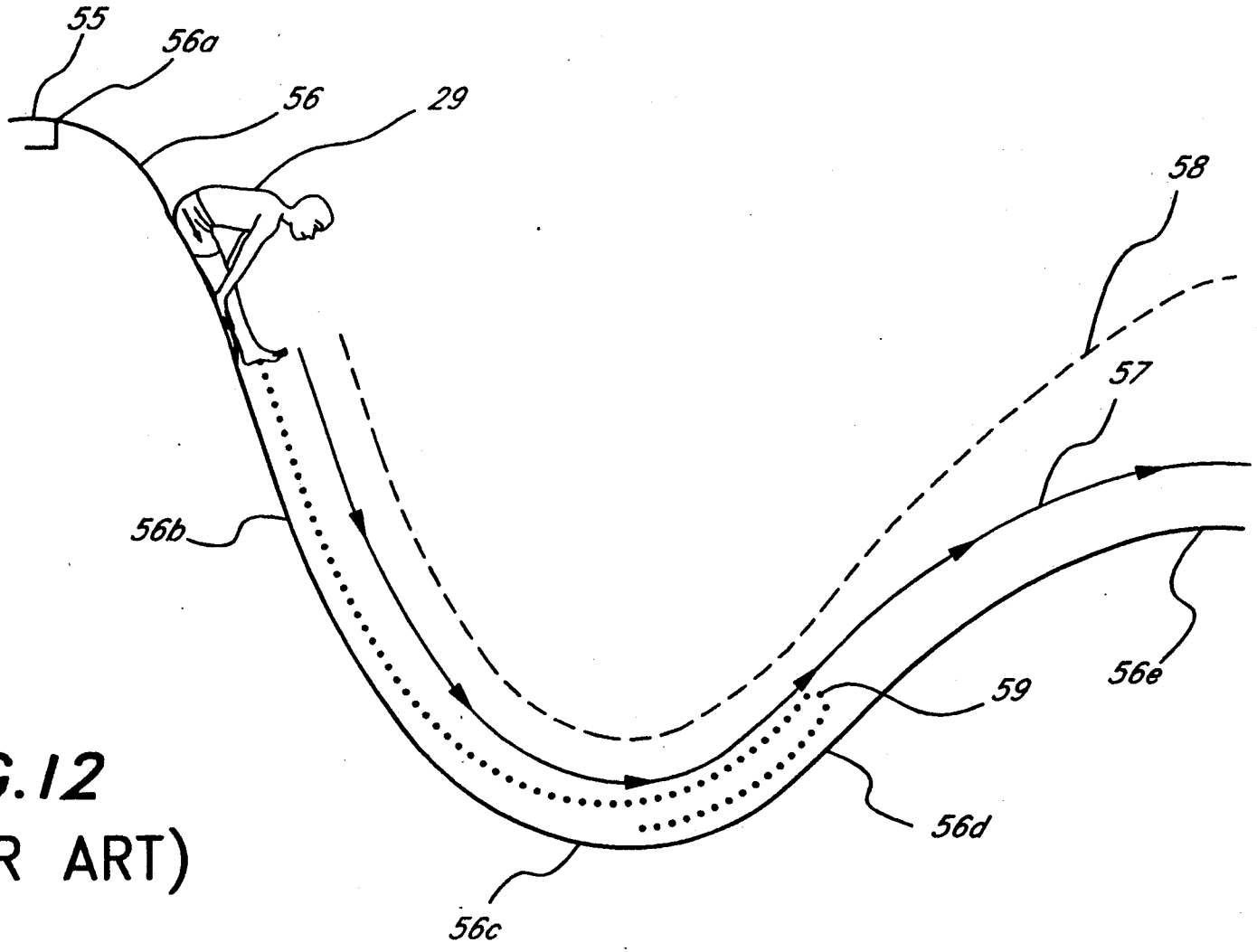
FIG. 12 (PRIOR ART)
FIG. 12 illustrates the problems that occurred in the prior art when varying riders encountered a section profile of a water amusement ride wherein partial altitude recoupment occurs.

To understand the function and solutions offered by the Stabilization/Equalization Process, one first needs to understand a context in which the process can arise. FIG. 12 illustrates a representative section profile of the prior art in water amusement rides wherein partial altitude recovery occurs but the Stabilization/Equalization Process is not employed. Rider 29 (with or without vehicle) enters a conventional start basin 55 and commences a descent in the conventional (gravity only) manner on the prior art attraction surface 56. Attraction surface 56 although continuous, may be sectionalized for the purposes of description into a top of downchute portion 56*a*, a downchute portion 56*b*, a bottom of downchute portion 56*c*, a rising portion 56*d* that extends upward from the downchute bottom 56*c*, and a top 56*e* of the rising portion 56*d*. Given a conventional water ride start, a certain average velocity of rider 29 at the top of downchute portion 56*a*, and a certain average loss of energy due to the forces of drag associated with rider 29 sliding through portions 56*a*, 56*b*, 56*c*, and 56*d*, it will be observed that rider 29 will follow a preferred trajectory 57 as indicated in FIG. 12 by a solid arrow line. Where the velocity of rider 29 at top of downchute portion 56*a* is greater than the average planned for in design, and/or, loss of energy due to the forces of drag associated with rider 29 sliding through portions 56*a*, 56*b*, 56*c*, and 56*d* is less than average, rider 29 would follow an airborne trajectory 58 as shown in FIG. 12 by the dashed line. Conversely, where the velocity of rider 29 at top of downchute portion 56*a* is less than the average planned for in design, and/or, loss of energy due to the forces of drag associated with rider 29 sliding through portions 56*a*, 56*b*, 56*c*, and 56*d* is greater than average, rider 29 would follow a failed trajectory 59 as show in FIG. 12 by the dotted line.

Rider instability, or unequal coefficients of friction for a broad spectrum of differing riders or ride conditions will inevitably lead to delays in rider dispatch due to rider inability to successfully traverse the uphill altitude recovery section as typified by failed trajectory 59. Furthermore, such instability or inequality may lead to rider injury in the event the curve of the uphill altitude recovery section enables a high velocity rider to follow the path of airborne trajectory 58, or in the event a second rider sliding along downchute portion 56*b* should collide with a prior failed trajectory rider at bottom of downchute portion 56*c*. Consequently, it is desired for purposes of ride safety, consistency, capacity and fun to introduce injected flows of water subsequent to a riders start to stabilize a rider, or equalize differing riders coefficients of friction during rider travel from top of downchute portion 56*a* through to top 56*e* and beyond as typified by preferred trajectory 57.

Figure 13:
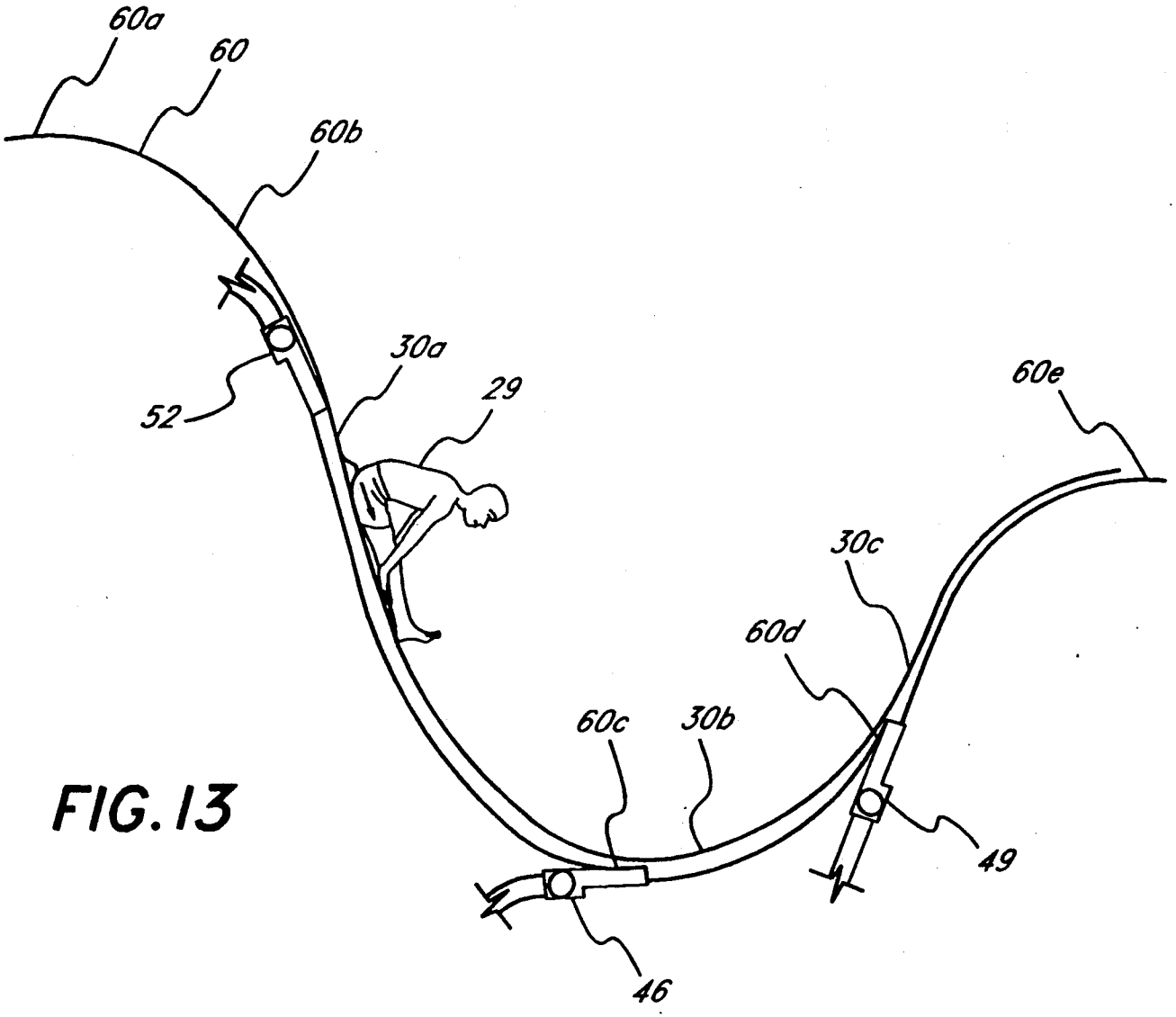
FIG. 13 is a generalized view of a section profile of a water amusement ride that solves the problems as illustrated in FIG. 12 and is described as the Stabilization/Equalization Process.

The Stabilization/Equalization Process, whereby such additional injections of water may safely be introduced, is illustrated in FIG. 13. FIG. 13 shows a similar ride profile to FIG. 12, however, the FIG. 13 water amusement ride section profile indicates potential locations for Downward Non-Accelerating Propulsor 52, Horizontal Non-Accelerating Propulsor 46, and Upward Non-Accelerating Propulsor 49 thus enabling the Stabilization/Equalization Process.

The Stabilization/Equalization Process is comprised of properly locating and activating at least one or more of the Propulsors 52, 46, or 49 along an appropriately configured attraction surface 60 at a point just prior to top 60*e*; and passing rider 29 through one or more of the injected jet water flows 30*a*, 30*b* and 30*c*, respective generated by Propulsors 52, 46, or 49 in route from top of downchute portion 60*a* to top 60*e*; and causing the injected water to have a velocity equal to or less than the velocity of the rider 29; and causing sufficient amounts of injected water to remain in contact with rider 29 during the course of travel from top of downchute portion 60*a* to top 60*e*, such flowing water acting to stabilize rider 29 and equalize the coefficients of friction for a broad spectrum of ride variables, e.g., ride surface, vehicle surface, water flow consistency, rider bathing attire, rider skill or lack thereof, etc.

Accordingly, it should be apparent that the Stabilization/Equalization Process as envisioned by this invention can be used in a water ride attraction to allow participants to consistently enjoy altitude recovery in a manner that is superior to recovery absent injected flows of water. Furthermore, once the destination elevation is achieved a participant can use regained potential energy to travel to other downhill rides in the conventional manner, or be powered by one of the other embodiments as contemplated herein.

DESCRIPTION AND OPERATION OF THE ELEVATION ENHANCEMENT PROCESS

Figure 14:
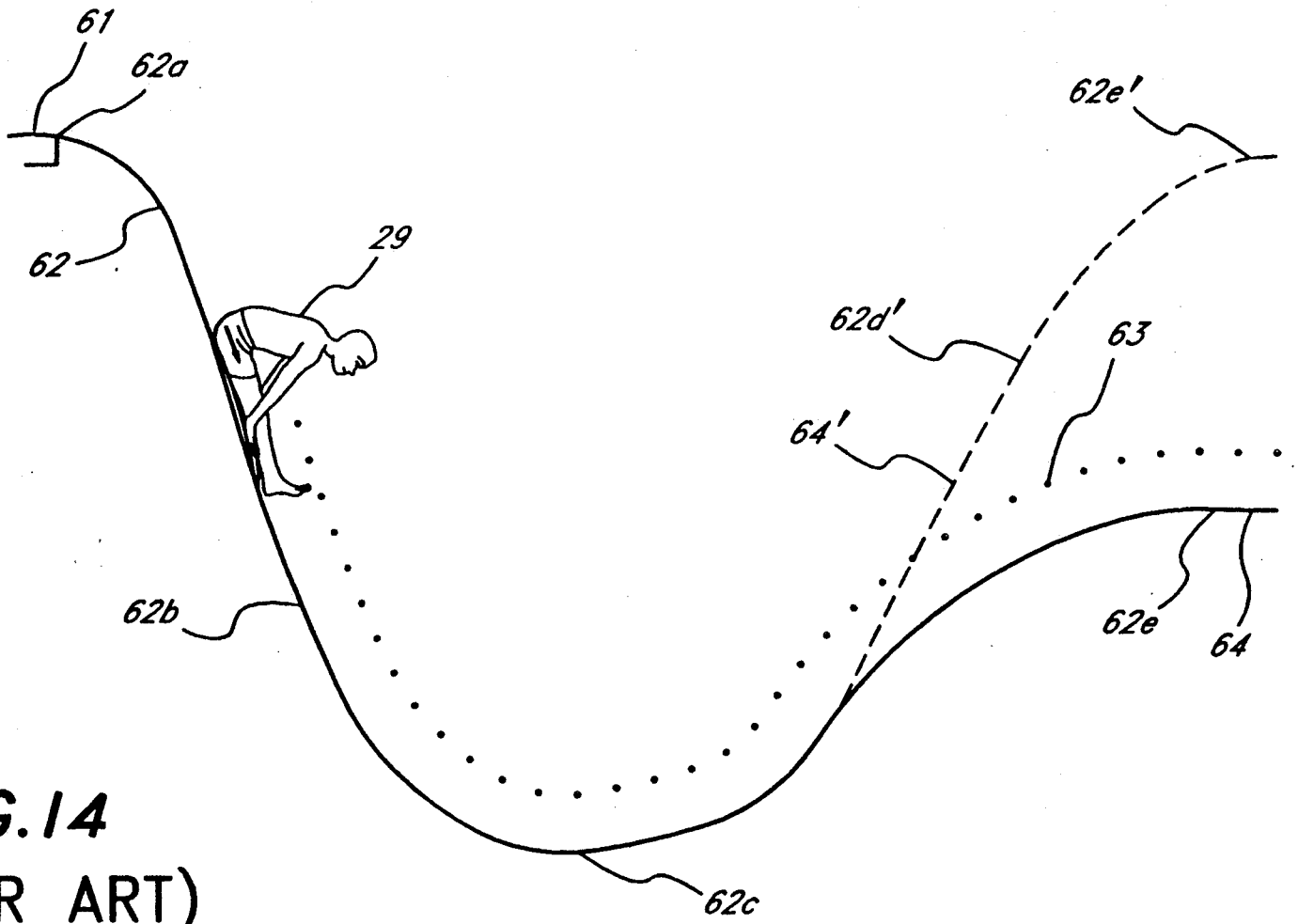
FIG. 14 (PRIOR ART)
FIG. 14 illustrates the limitations that occurred in the prior art when varying riders encountered a section profile of a water amusement ride wherein partial altitude recoupment occurs.

To understand the function and solutions offered by the Elevation Enhancement Process, one first needs to understand a context in which the process can arise. FIG. 14 illustrates a section profile of a water ride wherein partial altitude recovery occurs but the Elevation Enhancement Process is not employed. Rider 29 (with or without vehicle) enters the start basin 61 and commences a descent in the conventional (gravity only) manner on attraction surface 62. Attraction surface 62 although continuous, may be sectionalized for the purposes of description into a top of downchute portion 62*a*, a downchute portion 62*b*, a bottom of downchute portion 62*c*, a rising portion 62*d* that extends upward from downchute bottom 62*c*, and a top 62*e* of rising portion 62*d*. Given a conventional water ride start, a certain average velocity of rider 29 at the top of downchute portion 62*a*, and a certain average loss of energy due to the forces of drag associated with rider 29 sliding through portions 62*a*, 62*b*, 62*c*, and 62*d*, it will be observed that rider 29 will follow an unaided trajectory 63 as shown in FIG. 14 by dotted the line, whereupon, rider 29 will reach an unaided zenith 64. Absent any other outside influence, the maximum recovery of elevation as indicated by unaided zenith 64 will always be less than the starting elevation as indicated by start basin 61 due to the aforementioned drag forces. This is a significant limitation that is intrinsic to conventional water rides. Consequently, if the profile of attraction surface 62 was altered by extending rising portion 62*d* and raising top 62*e* as indicated by a dashed extension of rising portion 62*d*' and a raised top 62*e*', rider 29 would still be limited to the recovery elevation as indicated by an unaided zenith 64'. In order for rider 29 to overcome this limitation on recovery elevation and to reach raised top 62*e*', additional energy need be introduced to offset the energy lost due to the forces of drag. An Elevation Enhancement Process, whereby such additional energy may safely be introduced by way of Horizontal, Upward or Downward Accelerators, is illustrated in FIG. 15.

Figure 15:
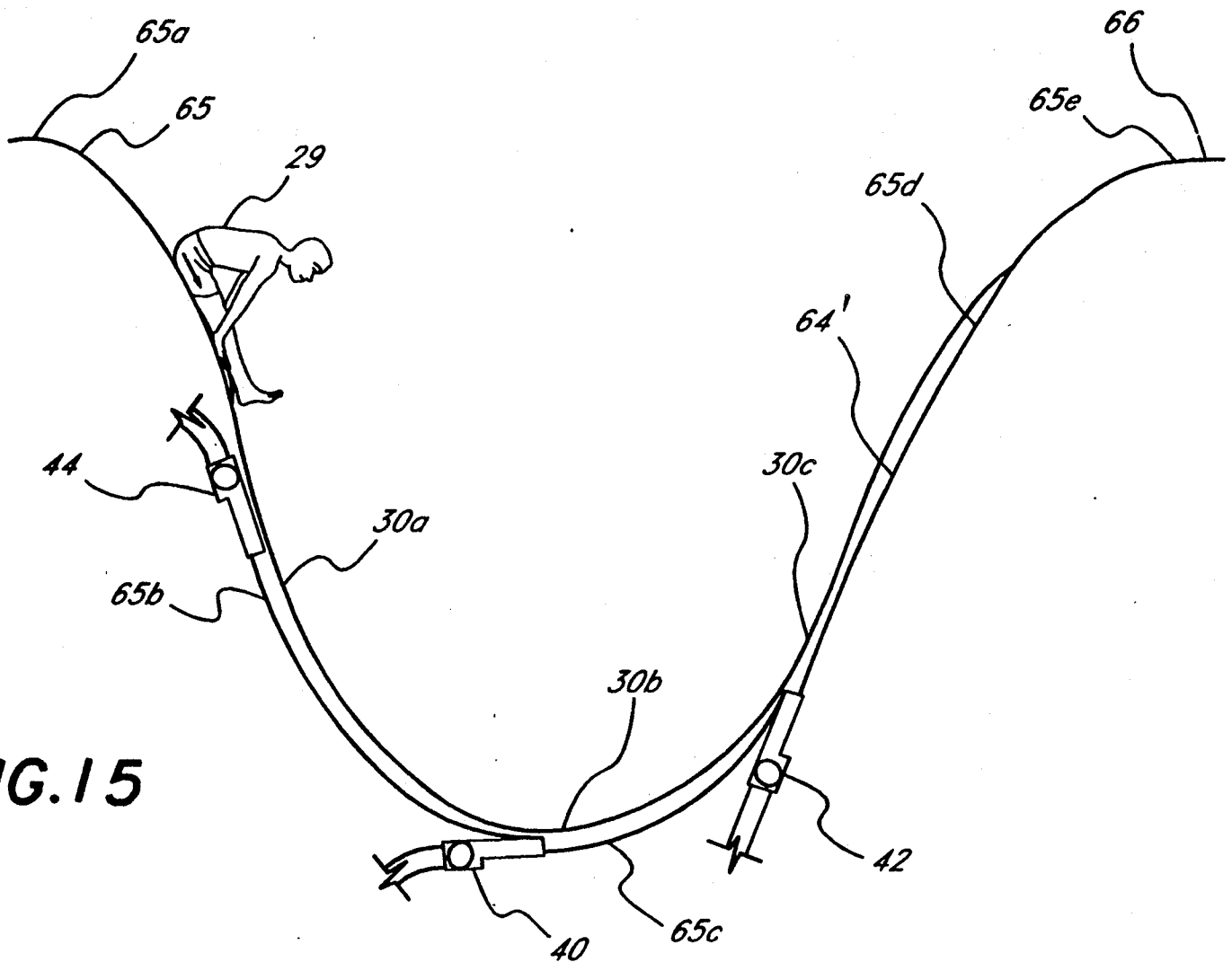
FIG. 15 is a generalized view of a section profile of a water amusement ride that overcomes the limitations as illustrated in FIG. 14 and is described as the Elevation Enhancement Process.

The Elevation Enhancement Process as depicted in FIG. 15, is comprised of properly locating and activating at least one or more of the Accelerators, i.e., Downward Accelerator 44, or Horizontal Accelerator 40, or Upward Accelerator 42, along an appropriately configured attraction surface 65 at a point just prior to the elevation of unaided zenith 64'; and rider 29 passing through and being accelerated by one or more of the high speed jet-water flows 30a, 30b and 30c, respectively generated by Accelerators 44, 40, or 42 in route from top of downchute portion 65a to top 65e; and rider 29 receiving a transfer of momentum (additional kinetic energy) from the issuing high speed water flow(s) that is at a minimum sufficient to propel rider 29 to the top 65e and achieve zenith 66.

Accordingly, it will be apparent that the Elevation Enhancement Process as envisioned by this invention can be used in a water ride attraction to raise the destination elevation of water attraction participants in excess of that which can be achieved from gravity alone. Furthermore, once this destination elevation is achieved a participant can use regained or newly gained potential energy to travel to other downhill rides, or be powered by yet another Accelerator to additional heights or to greater speeds, or just exit the ride at substantially the same elevation as started. In addition, the Elevation Enhancement Process has the following advantages:

(1) The Elevation Enhancement Process permits riders and vehicles to safely attain heights in excess of those available under conventional gravity driven systems.

(2) Increased participant thrill by allowing rider(s) to enjoy greater and more rapid changes in angular momentum.

(3) Extended ride length.

DESCRIPTION OF WATER COASTER

Figure 16:
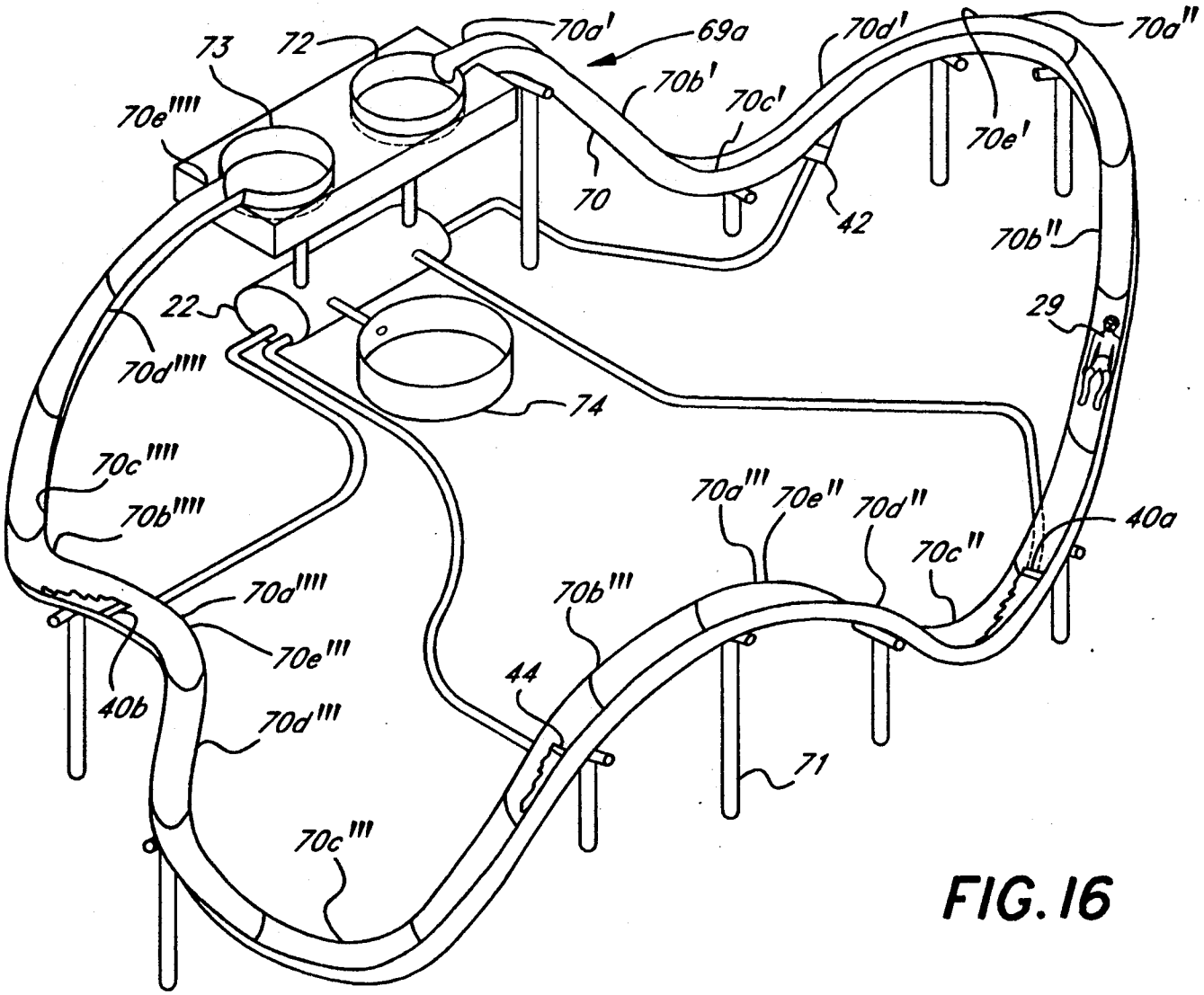
FIG. 16 depicts the Water Coaster embodiment of the subject invention highlighting Accelerator technology and the Elevation Enhancement Process.

The Water Coaster embodiment combines existing water slide and water ride attraction technology with new technology disclosed by the Horizontal Accelerator, Upward Accelerator, Downward Accelerator, Downward Non-Accelerating Propulsor, Horizontal Non-Accelerating Propulsor, Upward Non-Accelerating Propulsor, the Stabilization/Equalization Process, and the Elevation Enhancement Process. To avoid cluttered drawings and facilitate a written description that is more easily understood, two drawings of the Water Coaster are included herein. FIG. 16 highlights Accelerator technology and the Elevation Enhancement Process as incorporated into a Water Coaster 69a, and FIG. 17 highlights Propulsor technology and the Stabilization/Equalization Process as incorporated into a Water Coaster 69b.

Turning to FIG. 16, a Water Coaster 69a commences with a conventional start basin 72 followed by an attraction surface 70 made of suitable material, for example, resin impregnated fiberglass, concrete, gunite, sealed wood, vinyl, acrylic, metal or the like, which can be made into segments and joined by appropriate watertight seals in end to end relation. Attraction surface 70 is supported by suitable structural supports 71, for example, wood, metal, fiberglass, cable, earth, concrete or the like. Attraction surface 70 although continuous, may be sectionalized for the purposes of description into a first horizontal top of a downchute portion 70a' to which conventional start basin 72 is connected, a first downchute portion 70b', a first bottom of downchute portion 70c', a first rising portion 70d' that extends upward from the downchute bottom 70c', and a first top 70e' of rising portion 70d'; thereafter, attraction surface 70 continues into a second top of downchute portion 70a'', a second downchute portion 70b'', a second bottom of downchute portion 70c'', a second rising portion 70d'' that extends upward from downchute bottom 70c'', and a second top 70e'' of rising portion 70d''; thereafter, attraction surface 70 continues into a third top of downchute portion 70a''', a third downchute portion 70b''', a third bottom of downchute portion 70c''', a third rising portion 70d''' that extends upward from downchute bottom 70c''', and a third top 70e''' of rising portion 70d'''; thereafter, attraction surface 70 continues into a fourth top of downchute portion 70a''', a fourth downchute portion 70b''', a fourth bottom of downchute portion 70c''', a fourth rising portion 70d''' that extends upward from downchute bottom 70c''', and a fourth top 70e''' of rising portion 70d''' which connects to ending basin 73 in an area adjacent start basin 72 and the first top of downchute portion 70a'.

Upward Accelerator 42 is located in and made a part of attraction surface 70 at first rising portion 70d' that extends upward from the downchute bottom 70c'; Horizontal Accelerator 40a is located in and made a part of attraction surface 70 at the second bottom of the downchute portion 70c''; Downward Accelerator 44 is located and made a part of attraction surface 70 at third downchute portion 70b'''; and Horizontal Accelerator 40b is located in and made a part of attraction surface 70 at the fourth top of downchute portion 70a'''. Structural supports 71 provide foundation for Water Coaster 69a.

Water Source 22 provides high pressure water to Accelerators 40, 42, and 44 as well as a normal water flow to conventional start basin 72. Start overflow and rider transient surge build up is eliminated by venting the slowed water over the outside edge of the riding surface; or through openings along the bottom and sides of the channel; or by Triple Flume or Double Flume all as previously described. A surge tank 74 acts as a low point reservoir to collect and facilitate re-pumping of vented water as well as hold water on system shutdown.

Figure 17:
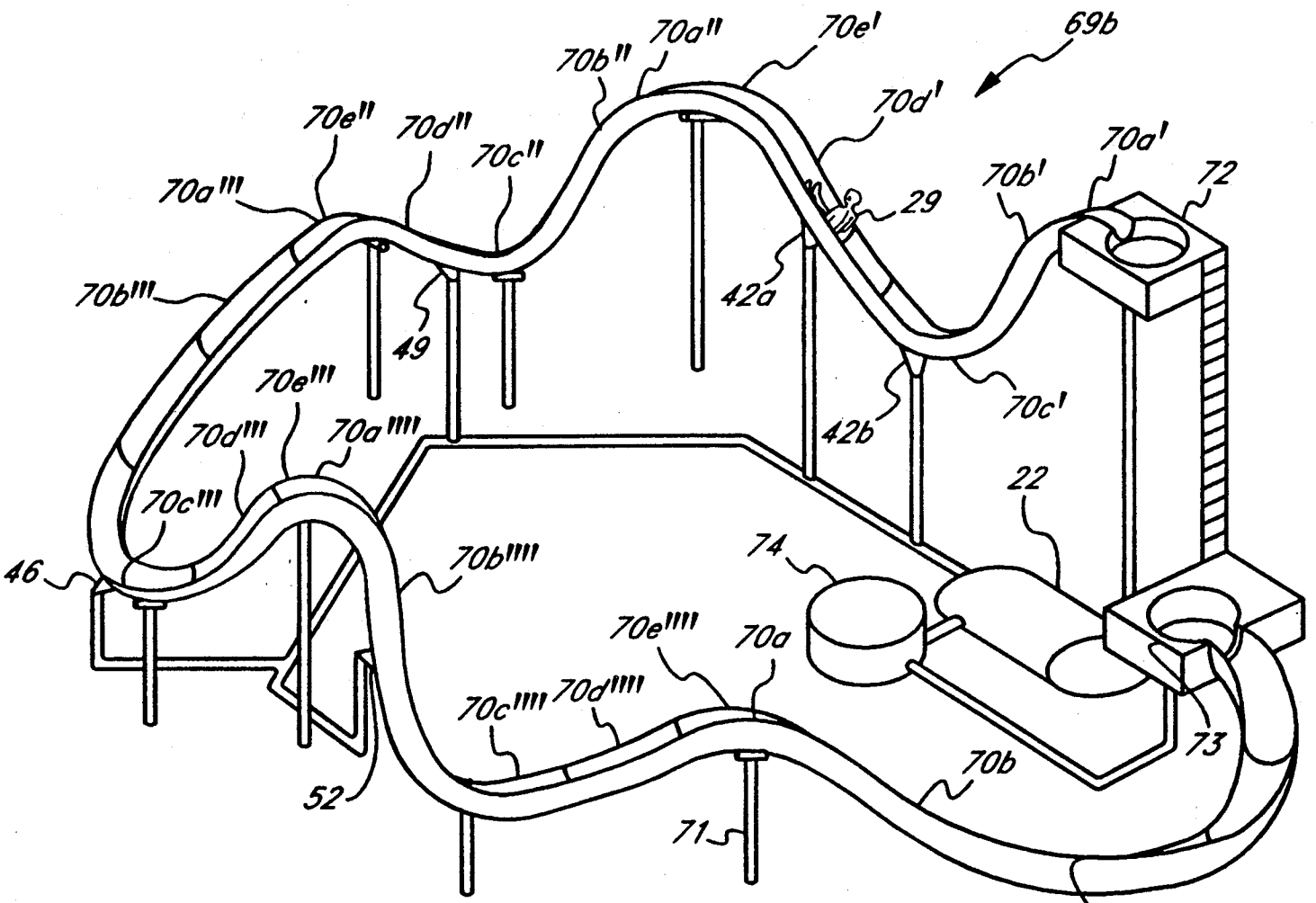
FIG. 17 depicts the Water Coaster embodiment of the subject invention highlighting Propulsor technology and the Stabilization/Equalization Process.

Turning to FIG. 17, a Water Coaster 69b commences with a conventional start basin 72 followed by a first top of a downchute portion 70a', a first downchute portion 70b', a first bottom of downchute portion 70c', a first rising portion 70d' that extends upward from downchute bottom 70c', and a first top 70e' of the rising portion 70d'; thereafter, attraction surface 70 continues onto a second top of downchute portion 70a'', a second downchute portion 70b'', a second bottom of downchute portion 70c'', a second rising portion 70d'' that extends upward from downchute bottom 70c'', and a second top 70e'' of rising portion 70d''; thereafter, attraction surface 70 continues into a third top of downchute portion 70a''', a third downchute portion 70b''', a third bottom of downchute portion 70c''', a third rising portion 70d''' that extends upward from downchute bottom 70c''', and a third top 70e''' of rising portion 70d'''; thereafter, attraction surface 70 continues into a fourth top of downchute portion 70a'''', a fourth downchute portion 70b'''', a fourth bottom of downchute portion 70c'''', a fourth rising portion 70d'''' that extends upward from downchute bottom 70c'''', and a fourth top 70e'''' of rising portion 70d''''; thereafter, attraction surface 70 continues into a final top of downchute portion (70a), a final downchute portion (70b) and a final bottom of the down chute portion (70c) which connects to ending basin 73 in an area below start basin 72.

Two Upward Accelerators 42a and 42b are located in and made a part of attraction surface 70 at first rising portion 70d'; Upward Non-Accelerating Propulsor 49 is located in and made a part of attraction surface 70 at second rising portion 70d''; Horizontal Non-Accelerating Propulsor 46 is located in and made a part of attraction surface 70 at the third bottom of downchute portion 70c'''; Downward Non-Accelerating Propulsor 52 is located and made a part of attraction surface 70 at fourth downchute portion 70b''''. Structural supports 71 provide foundation for Water Coaster 69b.

Water Source 22 provides high pressure water to Accelerators 42a and 42b, and Non-Accelerating Propulsors 49, 46 and 52, as well as a normal water flow to conventional start basin 72. Start overflow and rider transient surge build up is eliminated by venting the slowed water over the outside edge of the riding surface; or through openings along the bottom and sides of the channel; or by Triple Flume of Double Flume all as previously described. A surge tank 74 acts as a low point reservoir to collect and facilitate re-pumping of vented water as well as hold water on system shutdown. Analogous to the traditional roller coaster, there are numerous possibilities regarding the layout and design of the Water Coaster 69 as illustrated herein including: reconfiguring ride surface profile; reconfiguring the length, width, height and angle of the ride surface; repositioning and recombination of Accelerators or Propulsors as functionally adjusted to the newly configured ride surface and profile; repositioning the start and ending basins; connecting the start and end to form a continuous loop; permitting the use of riding vehicles and multiple riders; connecting to other rides or attractions; and adding special light, sound and themeing effects. All such possibilities are subject to the design, construction and operational guidelines as currently exist in the industry and as limited or expanded by the disclosures herein.

From the description above, a number of advantages of the Water Coaster 69 becomes evident:

(1) The physical profile of "gravity only" water ride attractions is no longer limited by functional necessity to a gradual decline from the top of the attraction to its bottom. Rather, through combination of the Downward, Horizontal, or Upward Accelerators or Propulsors with the conventional water ride attraction, and through utilization of the Elevation Recovery and Stabilization/Equalization Processes, the Water Coaster permits a functional physical profile that is akin to a standard roller coaster and capable of the ups, downs, overs, unders, twists, loops and rolls associated therewith.

(2) Length of ride is no longer dependent upon starting elevation.

(2) Ride profile elevation changes can exceed the initial start height.

(3) Connection of the start and end points can provide an "endless loop" ride, or connection can be to another attraction.

(4) The ride start basin and the ride end basin can be adjacent or connected at substantially the same elevation; or the end basin can be at a higher elevation than the start.

(5) Multiple riders, riding vehicles, and special effects can be accommodated.

OPERATION OF WATER COASTER

Referring to FIG. 16, with water source 22 in operation, rider 29 (with or without vehicle) enters the start basin 72 and commences a descent in the conventional manner over the top of downchute portion 70a' and thereafter to a first downchute portion 70b', and a first bottom of downchute portion 70c'. Upon entering a first rising portion 70d' that extends upward from downchute bottom 70c', rider 29 encounters an Upward Accelerator 42 that accelerates and enhances the elevation of rider 29 to a first top 70e' of rising portion 70d'; thereafter, rider 29 continues onto a second top of downchute portion 70a'', and a second downchute portion 70b''. Upon entering a second bottom of downchute portion 70c'', rider 29 encounters a Horizontal Accelerator 40a that accelerates and enhances the elevation of rider 29 to a second rising portion 70d'' that extends upward from downchute bottom 70c'', and to a second top 70e'' of rising portion 70d''; thereafter, rider 29 continues onto a third top of downchute portion 70a'''. Upon entering a third downchute portion 70b''', rider 29 encounters Downward Accelerator 44 that accelerates (and eventually enhances the elevation of) rider 29 to a third bottom of downchute portion 70c''', to a third rising portion 70d''' that extends upward from downchute bottom 70c''', and to a third top 70e''' of rising portion 70d'''. Upon entering a fourth top of downchute portion 70a'''', rider 29 encounters a Horizontal Accelerator 40b that accelerates (and eventually enhances the elevation of) rider 29 to a fourth downchute portion 70b'''', a fourth bottom of downchute portion 70c'''', a fourth rising portion 70d'''' that extends upward from downchute bottom 70c'''', and a fourth top 70e'''' of rising portion 70d'''', wherein rider 29 terminates his ride in a conventional ending basin 73 and exits.

Water Source 22 provides high pressure water to Accelerators 42, 40a, 40b, and 44 as well as a normal water flow to conventional start basin 72. The velocity of water that issues from each respective Accelerator 42, 40a, 40b, or 44 can be different depending upon the flow required to overcome friction, transfer momentum and propel rider 29 to the top of a successive rise. Start overflow and rider transient surge build up is eliminated by venting the slowed water over the outside edge of the riding surface; or through openings along the bottom and sides of the channel; or by Triple Flume or Double Flume all as previously described. A surge tank 74 acts as a low point reservoir to collect and facilitate re-pumping of vented water as well as hold water on system shutdown.

Turning to the variation of the Water Coaster 69b as depicted in FIG. 17 with water source 22 in operation, rider 29 (with or without vehicle) enters the start basin 72 and commences a descent in the conventional manner over a top of downchute portion 70a' and thereafter to a first downchute portion 70b', and a first bottom of downchute portion 70c'. Upon entering a first rising portion 70d' that extends upward from downchute bottom 70c', rider 29 encounters two Upward Accelerators 42a and 42b that accelerates and enhances the elevation of rider 29 to a first top 70e' of rising portion 70d'; thereafter, rider 29 continues onto a second top of downchute portion 70a'', a second downchute portion 70b'', and a second bottom of downchute portion 70c''. Upon entering a second rising portion 70d'' that extends upward from downchute bottom 70c'' rider 29 encounters an Upward Non-Accelerating Propulsor 49 that stabilizes/equalizes rider 29 over a second top 70*e*'' of rising portion 70*d*''. Thereafter, rider 29 continues onto a third top of downchute portion 70*a*''', and a third downchute portion 70*b*'''. Upon entering a third bottom of downchute portion 70*c*''' rider 29 encounters a Horizontal Non-Accelerating Propulsor 46 which stabilizes/equalizes rider 29 onto a third rising portion 70*d*''' that extends upward from downchute bottom 70*c*''', and a third top 70*e*''' of rising portion 70*d*'''; thereafter, rider 29 continues into a fourth top of downchute portion 70*a*'''' and encounters a Downward Non-Accelerating Propulsor 52 which stabilizes/equalizes rider 29 on a fourth downchute portion 70*b*'''' and onward to a fourth bottom of downchute portion 70*c*'''', a fourth rising portion 70*d*'''' that extends upward from downchute bottom 70*c*'''', and a fourth top 70*e*'''' of rising portion 70*d*''''; thereafter, rider 29 continues into a final top of downchute portion (70*a*), a final downchute portion (70*b*) and a final bottom of down chute portion (70*c*) which connects to ending basin 73 whereupon rider 29 exits.

Water Source 22 provides high pressure water to Accelerators 42*a* and 42*b*, and Non-Accelerating Propulsors 49, 46 and 52, as well as a normal water flow to conventional start basin 72. The velocity of water that issues from each respective Non-Accelerating Propulsors 49, 46, and 52 can be different depending upon the flow required to stabilize/equalize rider 29 to the top of a successive rise. Start overflow and rider transient surge build up is eliminated by venting the slowed water over the outside edge of the riding surface; or through openings along the bottom and sides of the channel; or by way of Triple Flume or Double Flume all as previously described. A surge tank 74 acts as a low point reservoir to collect and facilitate re-pumping of vented water as well as hold water on system shutdown.

Analogous to a roller coaster or a conventional flume ride, there are various ramifications regarding the operation of Water Coaster 69 described herein, including: the use of single or multi-passenger riding vehicles or boats that allow the rider to get wet or stay dry; increasing the capacity of Water Coaster 69 to permit multiple riders; connecting Water Coaster 69 to other amusement attractions; and enhancing Water Coaster 69 through the addition of special light, sound and themeing effects. All such possibilities are subject to the design, construction and operational guidelines as currently exist in the industry and as expanded by the disclosures herein.

Accordingly, it is now apparent that Water Coaster 69 as envisioned by this invention will permit a participant to ride a water attraction that has the profile and ride characteristics akin to a roller coaster. In addition, Water Coaster 69 has the following advantages:

it allows a rider to experience within one ride the sight, sound, and sensation of upward, downward and horizontal acceleration induced by high speed jets of water. This experience is exciting for participant and observer. Furthermore, the rider can gain speed for increased thrill and in set up for subsequent conventional waterslide maneuvers, e.g., twists, turns, jumps, drops, finale, etc.

it permits riders and vehicles to safely attain elevation recovery in excess of that available under conventional gravity driven systems through the Elevation Enhancement Process.

it engenders rider safety and consistency in performance through the Stabilization and Equalization Process.

it increases participant thrill by allowing rider(s) to enjoy greater and more rapid changes in angular momentum, and;

it can, if desired create an endless loop.

Although the description above contains many specifications, these should not be construed as limiting the scope of the invention but as merely providing illustrations of some of the presently preferred embodiments of this invention. For example, the module(s) which comprise the Horizontal, Upward, and Downhill Accelerators or Propulsors can have multiple nozzles instead of one; the Water Coaster can be shaped, proportioned and profiled substantially different than illustrated, such as serpentine, circular, convoluted, helical, parabolic, sinusoidal, etc.; the vehicles used within a water ride can have wheels or be on a track; a rider can enter the flow of water at an angle other than parallel to the line of flow; the flow of water could be cycled off/on at appropriate times to take advantage of the spacing that occurs between riders and effect a more efficient use of water flow.

Thus, the scope of the invention should be determined by the appended claims and their legal equivalents, rather than by the examples given.

I claim:

1. A water slide for amusement parks, water parks, and the like, wherein a user travels uphill and downhill along said slide, said slide comprising:

an elongate narrow ride surface adapted to receive and support said user riding thereon in a sitting or prone position;

a plurality of water jets spaced apart and positioned along said ride surface at predetermined locations;

a thin sheet of water along said ride surface to reduce frictional forces acting on said user;

said water jets being oriented tangentially with respect to said ride surface so as to contact said user as said user passes by each of said locations, each of said jets having a preselected velocity which may be selectively greater, less than, or the same as the velocity of said user at each of said jet locations, whereby said user's velocity may be changed to safely control said user depending upon the location of said jets along said ride.

2. The water slide of claim 1, wherein said jets inject water on said surface parallel to and in the direction of travel of said user.

3. The water slide of claim 1, wherein said jets inject water on said surface substantially against the direction of travel of said user.

4. The water slide of claim 1, wherein said velocity and/or the volume of said water jet is sufficient to decrease the velocity of said user as said water contacts said user.

5. The water slide of claim 1, wherein said velocity and/or the volume of said water jet is sufficient to increase the velocity of said user as said water contacts said user.

6. The water slide of claim 1, wherein said water contacting said user has a velocity and/or volume sufficient to increase the velocity of said user, whereby said user reaches and passes over the apex of an inclined section of said ride section in order to avoid a collision with a subsequent user traveling on said ride surface.

7. The water slide of claim 1, wherein said water contacting said user has a velocity and/or volume sufficient to decrease the velocity of said user, whereby said user maintains contact with said ride surface in order to avoid becoming airborne over the apex of said inclined section.

8. The water slide of claim 1, wherein said water depth is adjustable.

9. The water slide of claim 1, wherein said water sheet is sufficiently wide enough to substantially span the width of said ride surface.

10. The water slide of claim 1, wherein said ride surface has a concave cross-sectional shape.

11. The water slide of claim 1, wherein at least a portion of said ride surface extends longitudinally along a curvilinear path, wherein said ride surface has a containment wall along the outer radius of said curvilinear portion to maintain said user safely on said ride surface.

12. The water slide of claim 1, wherein said ride surface is adapted to permit said user to travel in a predetermined direction on said ride surface in a prone position.

13. The water slide of claim 1, wherein said ride surface is adapted to permit said user to travel in a predetermined direction on said ride surface in a horizontal position.

14. The water slide of claim 1, wherein said ride surface is adapted to permit said user to travel in a predetermined direction on said ride surface in a vehicle.

15. The water slide of claim 1, wherein said water jets are powered from a source under pressure coupled to said jets.

16. The water slide of claim 1, wherein each of said water jets comprises a nozzle.

17. The water slide of claim 16, wherein said nozzle is adjustable.

18. The water slide of claim 16, wherein said water flowing from said nozzle is approximately ½ cm to 40 cm in depth.

19. The water slide of claim 1, further comprising means for venting water from said ride surface.

20. The water slide of claim 1, wherein at least a portion of said ride surface has a substantially planar bottom surface and two sidewalls.

21. The water slide of claim 20, wherein said sidewalls of said ride surface have slits of a predetermined height and width to provide a self-clearing exit of excess water that builds up on said ride surface as said water is propelled onto said ride surface.

22. The water slide of claim 20, wherein a nozzle for propelling said water is located on said sidewall of said ride surface.

23. The water slide of claim 22, wherein said nozzle conforms to the shape of a portion of the cross section of said ride surface.

24. The water slide of claim 1, having a plurality of nozzles located on said ride surface.

25. A water ride for amusement parks, water parks and the like, comprising:

a ride surface adapted to receive and support a user travelling thereon in a predetermined direction, said ride surface having elevational changes thereon, whereby said user moves along said ride surface at least in part by the force of gravity; and a nozzle located along said ride surface adapted so as to propel a flow of jetted water in substantially the same direction of travel as said user, at a predetermined velocity on said ride surface, said jetted water flow affecting the velocity of said user on said ride surface by momentum transfer, whereby said velocity and elevation of said user traveling along said elevational changes of said ride surface may be increased or decreased or safely controlled by adjusting said predetermined velocity of said jetted water flow.

26. The water ride of claim 25, wherein said jetted flow affects the trajectory of said user such that said trajectory conforms to a predetermined are of travel over the apex of an inclined portion of said elevational changes.

27. The water ride of claim 25, wherein said jetted flow causes said user to conform to a uniform trajectory.

28. The water ride of claim 25, wherein said jetted flow equalizes the coefficient of friction of said user, relative to any other user, whereby the trajectories of differing users are equalized.

29. The water ride of claim 25, wherein said jetted water flow being propelled has a velocity and volume sufficient to increase the velocity of said user as said user passes over said ride surface, whereby said user is propelled to reach and pass over the apex of the inclined portions of said elevational changes.

30. The water ride of claim 25, wherein said ride surface has at its starting point, with respect to said pre-determined direction, a starting pool from which said user may exit and enter onto said ride surface.

31. The water ride of claim 25, wherein said ride surface has at its finishing point, with respect to said pre-determined direction, a splash pool into which said user riding on said surface and travelling thereon in said predetermined direction can exit after riding on said ride surface.

32. The water ride of claim 25, wherein said ride surface has, at either its starting point and/or finishing point, with respect to said predetermined direction, an interconnected separate water ride.

33. The water ride of claim 25, wherein said ride surface has, at either its starting point and/or finishing point, with respect to said predetermined direction, an interconnected conventional water slide.

34. The water ride of claim 25, wherein said ride surface has, at either its starting point and/or finishing point, with respect to said predetermined direction, an interconnected flume ride, such that said user can enter onto said ride surface from said flume ride, or can exit from said ride surface and onto said flume ride.

35. The water ride of claim 25, wherein said ride surface is, at either its starting point or finishing point, with respect to said predetermined direction, interconnected to another ride surface, such that said user can enter from said other ride surface onto said ride surface, or exit from said ride surface and onto said other ride surface.

36. The water ride of claim 25, wherein said ride surface is adapted to allow said user to travel in said predetermined direction on said ride surface in an innertube.

37. The water ride of claim 25, wherein said ride surface is adapted to allow said user to travel in said predetermined direction on said ride surface in a wheeled vehicle.

38. The water ride of claim 25, wherein said ride surface is adapted to allow said user to travel in said predetermined direction on said ride surface in a boat.

39. The water ride of claim 25, wherein said ride surface is adapted to allow said user to travel in said predetermined direction on said ride surface in a multi-passenger sliding vehicle.

40. The water ride of claim 25, wherein said nozzle adapted to propel said jetted water flow is coupled to a source of water under pressure such that said jetted water flow is injected onto said ride surface through said nozzle.

41. The water ride of claim 40, wherein the source of pressurized water emanates from a pump.

42. The water ride of claim 25, wherein a surge tank is provided to store said water vented from said ride surface and to provide a source of water.

43. The water ride of claim 25, wherein said ride surface has a venting means located longitudinally along the sides of said ride surface for venting excess water from said ride surface, which can build up and otherwise impede the velocity of said user on said ride surface.

44. The water ride of claim 25, wherein said ride surface has venting slits of a predetermined height and width longitudinally positioned along said ride surface, such that excess water injected onto said ride surface from said nozzle is vented from said ride surface through said slits, such that said user traveling on said ride surface is not impeded by the build-up of excess water on said ride surface.

45. A water ride for amusement parks, water parks and the like, comprising:

a ride surface adapted to receive and support a user thereon travelling in a predetermined direction, said ride surface having elevational changes thereon; and means for injecting a shallow stream of water in said predetermined direction onto said ride surface at a predetermined velocity and volume, said water stream contacting said user and affecting a transfer of momentum which affects the velocity of said user travelling on said ride surface and controls the trajectory of said user relative to any declined or inclined portion of said ride surface, whereby said user can be safely maintained on said ride surface.

46. A water ride for amusement parks, water parks and the like, said ride comprising:

a ride surface adapted to receive and support a user travelling thereon in a predetermined direction; and a water jet positioned along said ride surface, said water jet propelling a thin sheet of water onto said ride surface at a predetermined velocity, said jetted water having sufficient volume and speed, such that said jetted water affects said user and causes a transfer of momentum which controls the velocity at which said user travels on said ride surface.

47. The water ride of claim 46, wherein said ride surface has a finishing point with respect to said predetermined direction, wherein at said finishing point, a splash pool is located such that said user, after riding on said ride surface, can exit into said splash pool from said ride surface.

48. The water ride of claim 46, wherein said jetted water is directed upon said ride surface in a direction substantially tangential to said predetermined direction of said user.

49. A water ride, wherein a user moves from a first location to a second location in a predetermined direction, comprising:

a ride surface having a first channel adapted to receive and support said user;

means for propelling water onto said first channel at a predetermined velocity; and a ride segment on said ride surface having a second channel located parallel and adjacent said first channel, and extending in a longitudinal direction with respect thereto, said second channel being adapted to receive the slower moving excess water overflowing from said first channel and onto said second channel.

50. The water ride of claim 49, wherein said excess water moving slower than said user travelling on said surface overflows from said first channel to said second channel, such that said excess water does not build up on said first channel, whereby the velocity of said water and of said user travelling on said first channel is not substantially impeded by said excess water.

51. The water ride of claim 49, wherein said first channel and said second channel are separated by a common wall of a predetermined height, said height being adopted to allow said excess water to overflow and exit from said first channel and onto said second channel, so that said velocity of said stream and said user on said first channel is not substantially impeded by said slower moving excess water building up on said first channel.

52. The water ride of claim 49, wherein said common wall is of sufficient height to deter said user travelling on said first channel from sliding across said common wall and over onto said second channel.

53. The water ride of claim 49, wherein said second channel and said first channel are integrally formed.

54. The water ride of claim 49, wherein said second channel has a means for draining said exiting water overflowing from said first channel.

55. The water ride of claim 49, wherein said second channel allows said exiting water overflowing from said first channel to run downhill, wherein slits are located on said second channel along or at the bottom of said downhill portion of said second channel to drain said excess water from said second channel.

56. The water ride of claim 49, wherein the size of said second channel is sufficiently large enough to accommodate and drain substantially all of said exiting water overflowing from said first channel.

57. The water ride of claim 49, wherein said ride segment is located on a horizontal portion of said ride surface.

58. The water ride of claim 49, wherein said ride segment is located between a declined portion of said ride surface and an inclined portion.

59. The water ride of claim 49, wherein said ride segment is located on an inclined portion of said ride surface.

60. The water ride of claim 49, wherein said ride segment is located on a curved portion of said ride surface.

61. The water ride of claim 49, wherein a portion of said ride segment is curved, said user riding on said ride surface being maintained on said ride surface by an outside containment wall of sufficient height, said sidewall being located along the outside radius of said first channel, and said second channel being located along the inside radius of said first channel.

62. The water ride of claim 49, wherein said outer walls of said first and second channels are of sufficient height to maintain said user on said ride surface.

63. The water ride of claim 49, wherein said ride segment has a third channel located parallel and adjacent said first channel, said third channel being located such that said first channel is located between said second channel and said third channel, said third channel being adapted to receive said water exiting from said first channel in substantially the same manner as said second channel.

64. The water ride of claim 63, wherein the outer sidewalls on said second and third channels are sufficient in height to maintain said user on said ride surface.

65. The water ride of claim 63, wherein said ride segment is located on a horizontal portion of said ride surface.

66. The water ride of claim 63, wherein said ride segment is located between a declined portion of said ride surface and an inclined portion.

67. The water ride of claim 63, wherein said ride segment is located on an inclined portion of said ride surface.

68. The water ride of claim 63, wherein said second and third channels have a means for draining said exiting water overflowing from said first channel.

69. The water ride of claim 63, wherein said second and third channels allow said exiting water overflowing from said first channel to run downhill to drain.

70. The water ride of claim 63, wherein said second and third channels are sufficiently large enough to accommodate and drain substantially all of said exiting water overflowing from said first channel.

71. A module for a water ride wherein a user rides in a sitting or prone position in a predetermined direction between a starting point and an ending point, the module comprising:

a ride segment for receiving said user, said segment being positioned between said starting point and said ending point;

a water injection nozzle located adjacent said ride segment; and water emanating from said nozzle and flowing upon said ride segment in said predetermined direction and at a predetermined velocity, said water contacting said user as said user passes over said ride segment, said water having flow characteristics sufficient to affect a change in the velocity at which said user travels over said segment.

72. A segment of a water ride for amusement parks, water parks, and the like for transporting a user in a predetermined direction from a first location to a second location, said segment comprising:

a ride surface adapted to receive and support said user and having two ends;

a connector on each end of said ride surface for connecting said ride surface to and between said first and second locations; and means for propelling a stream of water onto said ride surface, said means adapted so as to direct said stream at a predetermined velocity and substantially in said predetermined direction, said stream of water affecting said user and causing a transfer of momentum which affects the velocity of said user travelling on said ride surface, whereby said velocity of said user may be safely controlled on said ride surface.

73. The water ride segment of claim 72, wherein said first location comprises a first water ride and said second location comprises a second water ride, said water ride segment transporting said user from said first water ride to said second water ride.

74. A method of improving a water ride, comprising the steps of:

providing a ride surface adapted to receive and support a user travelling thereon in a predetermined direction;

propelling a stream of water onto said ride surface at a predetermined velocity and substantially in said predetermined direction; and causing said stream of water to contact said user to affect a transfer of momentum that effects the velocity of said user on said surface.

75. The method as defined in claim 74, including propelling said stream of water at a velocity which is greater than the velocity of said user passing by said means on said surface in the absence of said stream of water, wherein the velocity of said user is increased by the effect of momentum transfer.

76. The method as defined in claim 74, including propelling said stream of water at a velocity which is less than the velocity of said user passing by said means on said surface in the absence of said stream of water, wherein the velocity of said user is decreased by the effect of momentum transfer.

77. The method as defined in claim 74, including propelling said stream of water at a velocity and volume which maintains the user in a predetermined trajectory upon said ride surface.

78. The method as defined in claim 74, wherein the step of propelling water includes providing a nozzle which originates from any point along said ride surface.

79. The method as defined in claim 74, wherein said propelling step includes propelling said stream from a source of water under pressure, wherein a means for propelling said stream is coupled to said source.

80. The method as defined in claim 74, including providing a ride surface having a means for venting said stream of water.

81. A method for improving a water ride wherein a user moves from a first location to a second location in a predetermined direction, comprising the steps of:

providing a ride surface having a first channel adapted to receive and support said user;

providing a means for propelling a stream of water onto said first channel at a predetermined velocity; and providing a ride segment on said ride surface having a second channel located parallel and adjacent said first channel and extending in a longitudinal direction with respect thereto, said second channel being adapted to receive excess water exiting and overflowing from said first channel, whereby the velocity of said stream of water and of said user travelling on said first channel is not substantially impeded by said exiting water.

82. The method of claim 81, including providing a common wall of a predetermined height between said first channel and said second channel, said height being sufficient to allow said water to exit from said first channel and onto said second channel, while deterring said user from sliding across said wall from said first channel to said second channel.

83. The method of claim 81, including adapting said second channel to allow said exiting water overflowing from said first channel to run downhill to drain.

84. The method of claim 81, including positioning said ride segment on a horizontal portion of said ride surface.

85. The method of claim 81, including positioning said ride segment between a declined portion of said ride surface and an inclined portion.

86. The method of claim 81, including positioning said ride segment on an inclined portion of said ride surface.

87. The method of claim 81, including positioning said ride segment on a curved portion of said ride surface.

88. The method of claim 81, including adapting a portion of said ride segment so that it extends along a curvilinear path, said user riding on said curvilinear portion being maintained on said ride segment by a containment wall of sufficient height, said containment wall being located along the outside radius of said first channel, and said second channel being located along the inside radius of said first channel.

89. The method of claim 81, including adapting said outer walls of said first and second channels so that they are of sufficient height to maintain said user on said ride surface.

90. The method of claim 81, including the step of providing said ride segment with a third channel located parallel to and adjacent said first channel, said third channel being positioned such that said first channel is between said second channel and said third channel, said third channel being adapted to receive said water exiting from said first channel in the same manner as said second channel.

91. The method of claim 90, including positioning sidewalls on said second and third channels so that they are of sufficient height to maintain said user on said ride surface.

92. The method of claim 90, including positioning said ride segment on a horizontal portion of said ride surface.

93. The method of claim 90, including positioning said ride segment between a declined portion of said ride surface and an inclined portion.

94. The method of claim 90, including positioning said ride segment on an inclined portion of said ride surface.

95. The method of claim 90, including adapting said second and third channels with a means for draining said exiting water.

96. The method of claim 90, including adapting said second and third channels to allow said exiting water overflowing from said first channel to run downhill to drain.

97. The method of claim 90, including adapting said second and third channels such that they are of at least sufficient size to drain said exiting water overflowing from said first channel.

* * * * *